US005861590A

United States Patent [19]

Amonett

[11] Patent Number: 5,861,590

[45] Date of Patent: Jan. 19, 1999

[54] CAM-OPERATED TIME QUIET CYCLE SELECTOR

[75] Inventor: Daniel Keith Amonett, Indianapolis, Ind.

[73] Assignee: Emerson Electric Co., St. Louis, Mo.

[21] Appl. No.: 654,494

[22] Filed: May 28, 1996

[51] Int. Cl.[6] ..... H01H 7/08; H01H 7/12; H01H 7/16; H01H 7/00

[52] U.S. Cl. ..... 200/38 B; 200/11 R; 200/38 A; 200/38 D

[58] Field of Search ..... 200/11 R, 38 R–38 D

[56] References Cited

U.S. PATENT DOCUMENTS

| | | | |
|---|---|---|---|
| 3,866,022 | 2/1975 | Underwood et al. | 200/38 R |
| 4,146,760 | 3/1979 | Voland | 200/38 A |
| 4,149,046 | 4/1979 | Bolin | 200/38 A |
| 4,355,217 | 10/1982 | Cushing | 200/38 R |
| 4,413,164 | 11/1983 | Obermann | 200/38 R |
| 4,497,985 | 2/1985 | Courter et al. | 200/38 R |
| 4,497,986 | 2/1985 | Zink et al. | 200/38 R |
| 4,560,846 | 12/1985 | Klopp et al. | 200/38 R |
| 4,626,635 | 12/1986 | Mahon | 200/38 A |
| 4,649,239 | 3/1987 | Duve | 200/38 R |
| 4,796,484 | 1/1989 | Eder | 74/568 T |
| 4,827,460 | 5/1989 | Mahon et al. | 368/113 |
| 4,856,096 | 8/1989 | Mahon et al. | 200/38 C |
| 4,892,983 | 1/1990 | Bogda et al. | 200/38 R |
| 4,948,928 | 8/1990 | Willigman | 200/38 R |
| 4,983,790 | 1/1991 | Bogda et al. | 200/30 R |
| 5,113,124 | 5/1992 | Hamilton | 318/578 |
| 5,182,461 | 1/1993 | Baran | 307/41 |

*Primary Examiner*—Peter S. Wong
*Assistant Examiner*—Bao Q. Vu
*Attorney, Agent, or Firm*—Eric R. Waldkoetter; Mark D. Becker

[57] ABSTRACT

An appliance timer has features to facilitate automated assembly or manual assembly. A timer housing base accepts timer components from two directions, and installation of components in either direction is along a straight axis. A motor in the timer engages a gear train which runs a drive cam. The drive cam imparts motion to a camstack which then engages timer blade switches, and the blade switches operate the appliance. A subinterval is also supplied on the timer to allow periodic operation of a switch without the use of the camstack. The timer also features a quiet manual advance which removes the blade switches from communication with the camstack to allow an operator to select various timer programs without any of the clicking noises that are usually associated with timer program selection. Furthermore, a detent slider is positioned in communication with the camstack to provide a tactile feel for the operator of the timer when selecting between various timer programs.

35 Claims, 23 Drawing Sheets

FIG. 11a
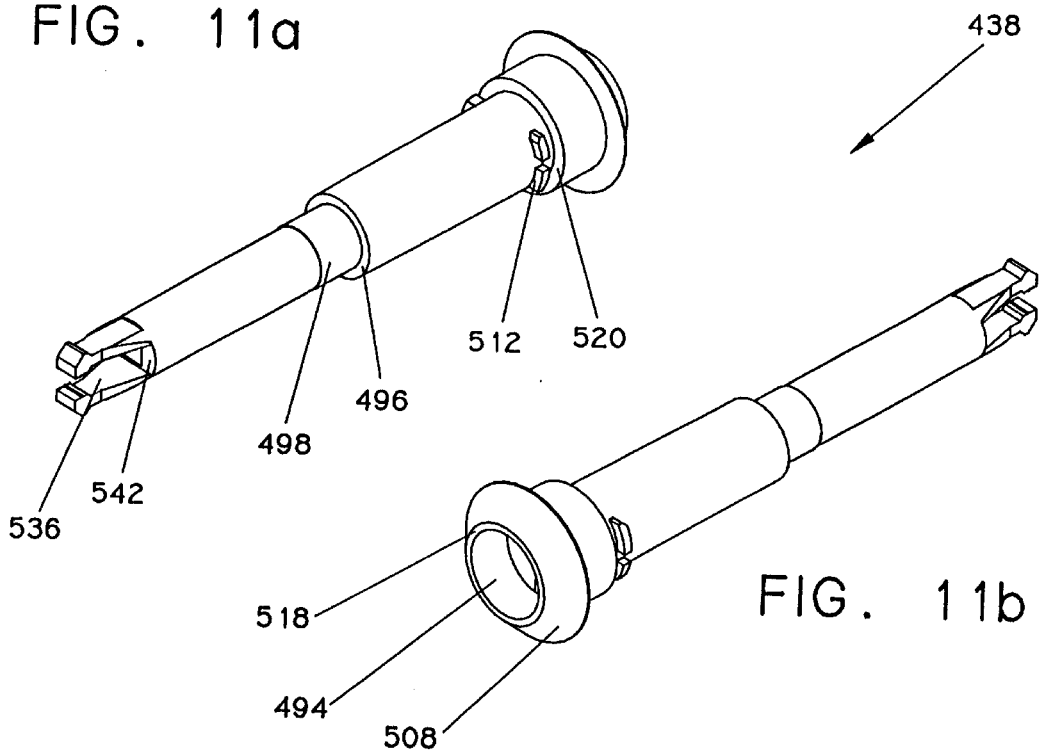
FIG. 11b
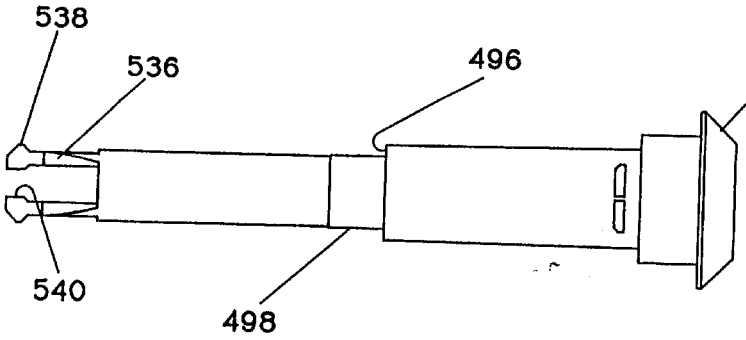
FIG. 11c
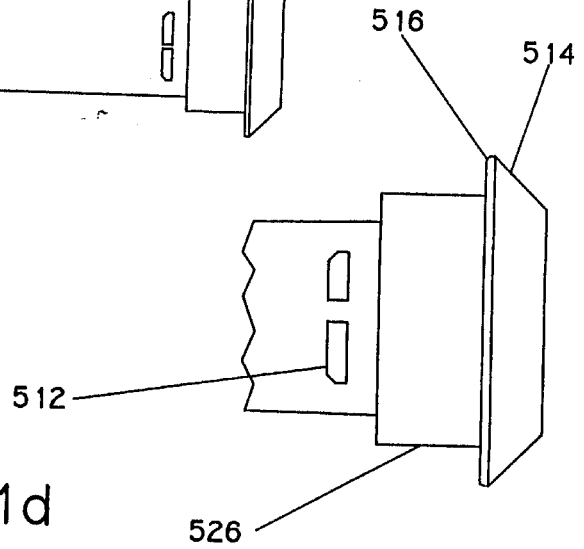
FIG. 11d

CAM-OPERATED TIME QUIET CYCLE SELECTOR

This application is related to the following copending applications filed on the same day as this application entitled: Cam-Operated Timer 08/654,160, filed May 28, 1996, Cam-Operated Timer Motor 08/654,506, filed May 28, 1996, Timer Camstack And Clutch 08/653,860, filed May 28, 1996, Cam-Operated Timer Pawl Drive 08/654,495, filed May 28, 1996, Cam-Operated Timer Blade Switches 08/653,875, filed May 28, 1996, Cam-Operated Timer Subinterval Switch 08/654,366, filed May 28,1996, and Cam-Operated Timer Test Procedure 08/653,874, filed May 28, 1996. All of the preceding copending applications are incorporated herein by this reference, and the preceding copending applications are not admitted to be prior art by their mention here.

BACKGROUND

This invention relates to electrical circuit makers and breakers that are cam-operated.

Cam-operated timers have been used for years to control the functioning of appliances such as clothes washing machines, clothes dryers, and dishwashers. Cam-operated timers used in appliances operate to control various appliance functions in accordance with a predetermined program. Examples of appliance functions that can be controlled by a cam-operated timer are: agitation, washing, spinning, drying, detergent dispensing, hot water filling, cold water filling, and water draining.

Cam-operated timers typically have a housing with a control shaft that serves as an axis of rotation for a drum-shaped cam which may be referred to as a camstack. The camstack is connected to a drive system that is powered by an electric motor to rotate the camstack. Camstack program profiles or blades carry the control information to operate blade switches. When the camstack rotates, the cam blades are engaged by switches that open and close in response to the cam blade program. A knob is generally placed in the end of the control shaft which extends through the appliance control console for an appliance operator to select an appliance program.

Cam-operated timers are complex electro-mechanical devices having many mechanical components interoperating with each other under close tolerances. One of the primary reasons that previous cam-operated timer have not been assembled with a great deal of automation equipment is that the timer design requires components to be assembled from a variety of axes. Manual assembly of a complex device such as a cam-operated timer compared to automated assembly can require more time and generate more quality defects. Automated assembly of a cam-operated timer is desirable because automated assembly should be quicker and have less quality defects than can be achieved economically with manual assembly.

Some previous cam-operated timers have employed a metal housing to contain timer components. The metal housing is typically formed from two or more pieces of sheet metal that are fastened together to form a partially enclosed housing. A metal housing is typically required to be electrically insulated from the appliance and also typically requires connection of a grounding strap. Additionally a metal housing does not dampen the clicking sounds that can be generated by a cam-operated timer's drive or cam followers. The partially enclosed housing can permit contaminates such as dust or lint to enter the cam operated timer and interfere with electrical contacts or other mechanical components. Since the metal housing is typically formed from two or more pieces of metal, maintenance of close component tolerances in relation to each other can be difficult. An example of a metal enclosure is disclosed in U.S. Pat. No. 4,228,690 issued to Ring.

Some previous cam-operated timers designed for relatively simple applications, such as a refrigerator freezer defrost timer, have employed a plastic housing to contain timer components. An example of a plastic enclosure for a cam-operated timer that does employ a small camstack is disclosed in U.S. Pat. No. 4,636,595 issued to Smock et al. An example of a plastic enclosure for a cam-operated timer that does not employ a camstack, but a pancake cam, is disclosed in U.S. Pat. No. 4,760,219 issued to Daniell et al.

Cam-operated timers are typically installed in appliance consoles where space can be very limited with fasteners. A ground strap is usually run from the cam-operated metal housing to the appliance console. A cam-operated timer requiring separate fasteners and a ground strap is difficult for an appliance manufacturer to automate installation of the cam-operated timers into their appliance.

Previous cam-operated timers have been tested for proper operation by connecting the timer switches to an electrical analysis device, directing current through the timer's motor, and allowing the gear train to drive the camstack which then operates the switches of the timer. If the electrical characteristics of the timer match predetermined criteria, then the timer passes the test and is ready for sale. The amount of time that is required for a typical timer to complete a revolution of its camstack when driven by its motor and gear train is often in excess of one hour. This means that the testing time for previous cam-operated timers is also in excess of one hour.

SUMMARY

It is an object of the invention to design a cam-operated timer that has a housing designed to accept components assembled from a limited number of straight axes to simplify assembly and permit greater automation of assembly.

It is another object of the invention to design a cam-operated timer with components to be installed and positioned in relation to each other in a housing with integral molded mounting details, so there is less tolerance variation in the installation of timer components.

It is a further object of the invention to have a cam-operated timer housing that is formed from a material that electrically insulates electrical components and enclose timer components to provide protection from contaminates, and eliminates the need for a ground strap.

It is still another object of the invention for the cam-operated timer to permit an appliance manufacturer to install the cam-operated timer in an appliance without separate fasteners such as screws or nuts and bolts and without a ground strap.

It is yet another object of the invention to have cam-operated timer mounting fasteners integral to the timer housing, so the cam-operated timer can be installed in an appliance console without the need for separate mounting hardware, and installation of the cam-operated timer in the appliance control console can be automated.

Another object of the invention is to allow the camstack to be freely spun during a testing stage following substantial assembly of the timer so that the amount of time required for timer testing is greatly reduced.

The cam-operated timer apparatus and method that includes the above objects of the invention comprises the following. A housing having a base with a first open side, a second open side and details in the base pointing toward the first open side to accept cam-operated timer components. A cover enclosing the first open side having details pointing toward the base to accept cam-operated timer components. Timer components installed in the housing, comprising: a timer drive mechanism received by the base details, a motor connected to the timer drive mechanism and received by the base details in an axis perpendicular to the base, and a camstack having three or more program blades carried on a shaft, driven for rotation by the timer drive mechanism, and received by details in the base in an axis perpendicular to the base.

BRIEF DESCRIPTION OF THE DRAWINGS

FIGS. 11 *a–d* show show a control shaft;

DETAILED DESCRIPTION

Figure 1A:
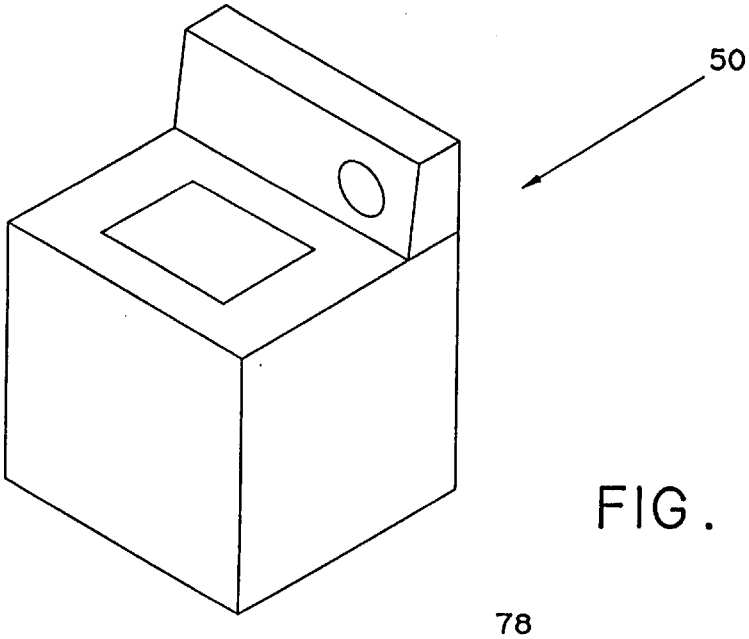
FIG. 1*a* shows an appliance.
Figure 1B:
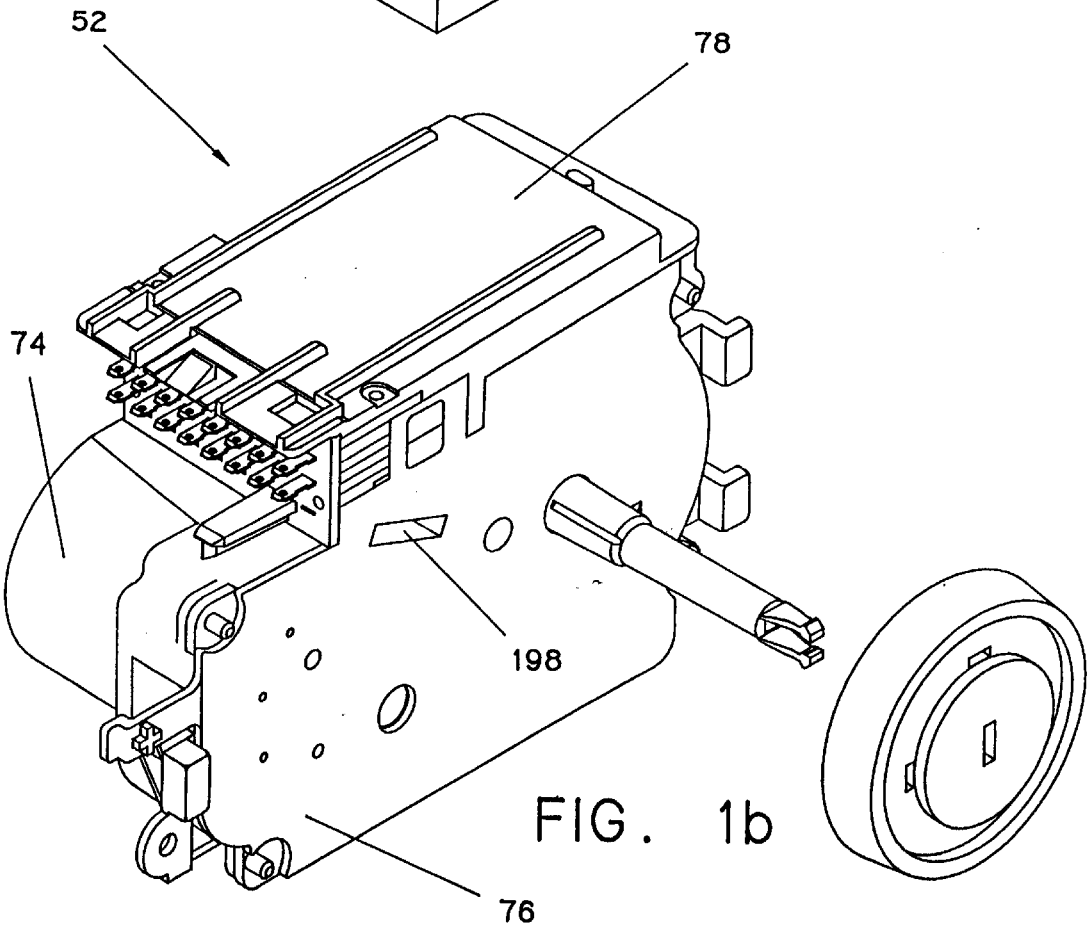
FIG. 1*b* shows an assembled cam-operated timer.
Figure 2:
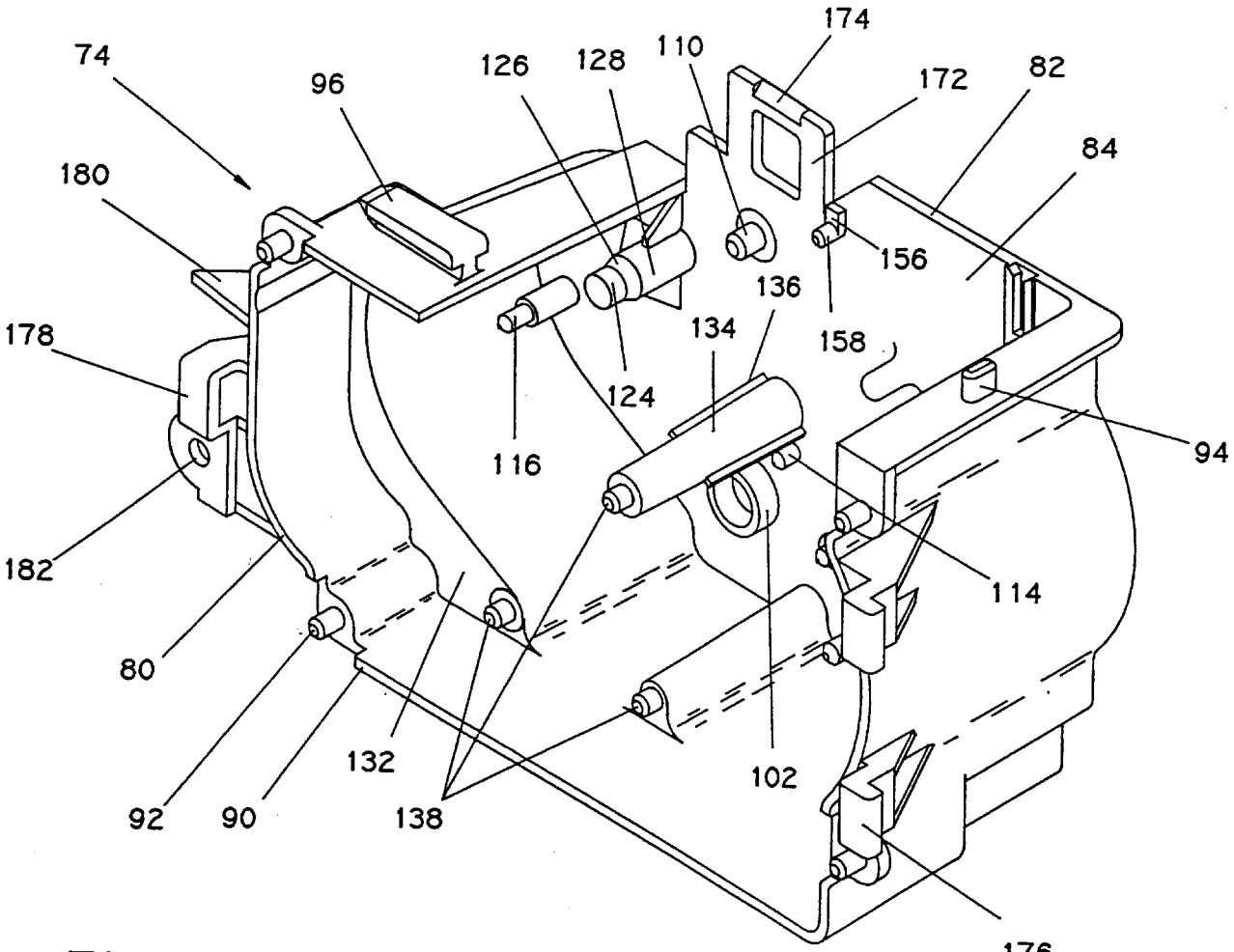
FIG. 2 shows a housing base.
Figure 3A:
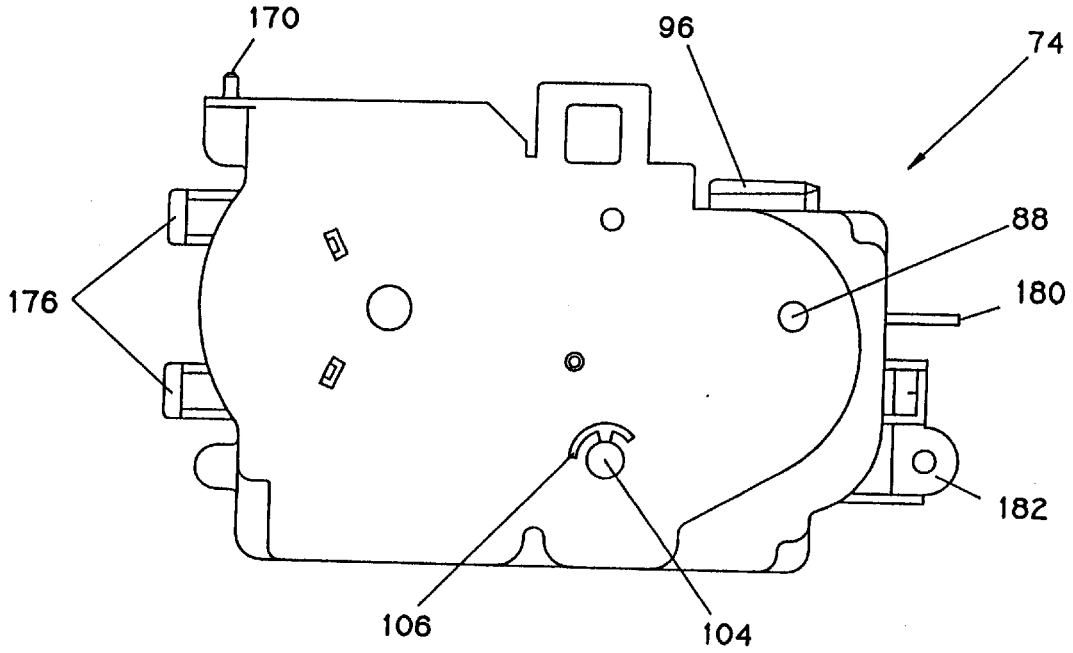
FIG. 3*a* shows an exterior view of the housing base.
Figure 3B:
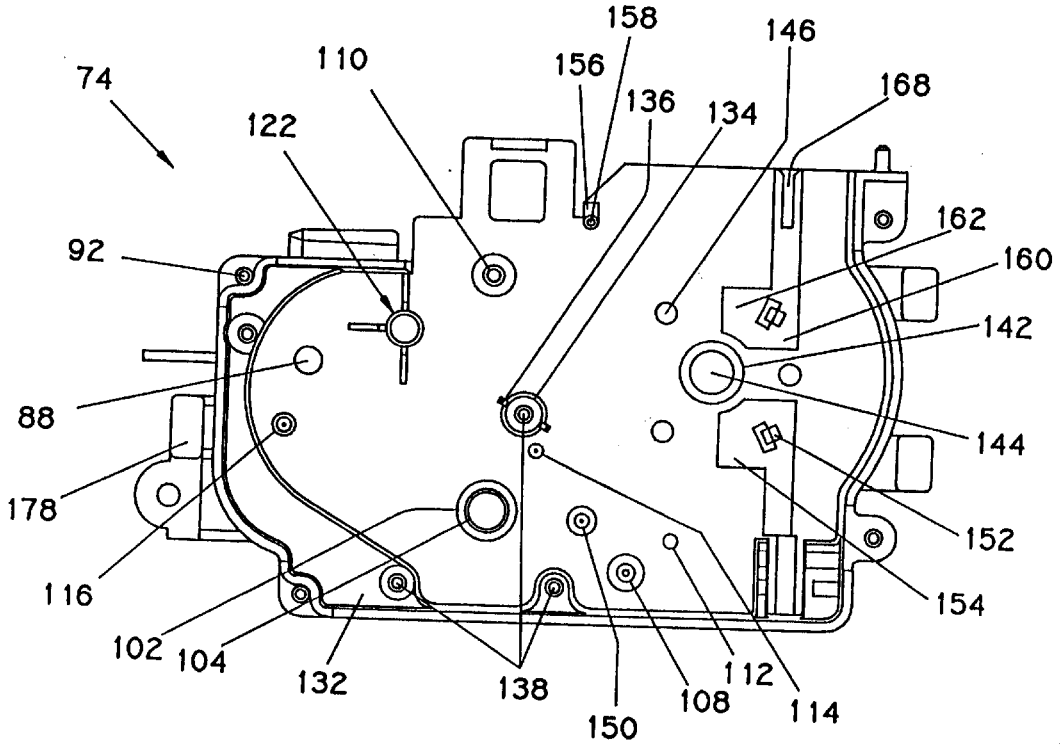
FIG. 3*b* shows an interior view of the housing base.
Figure 4A:
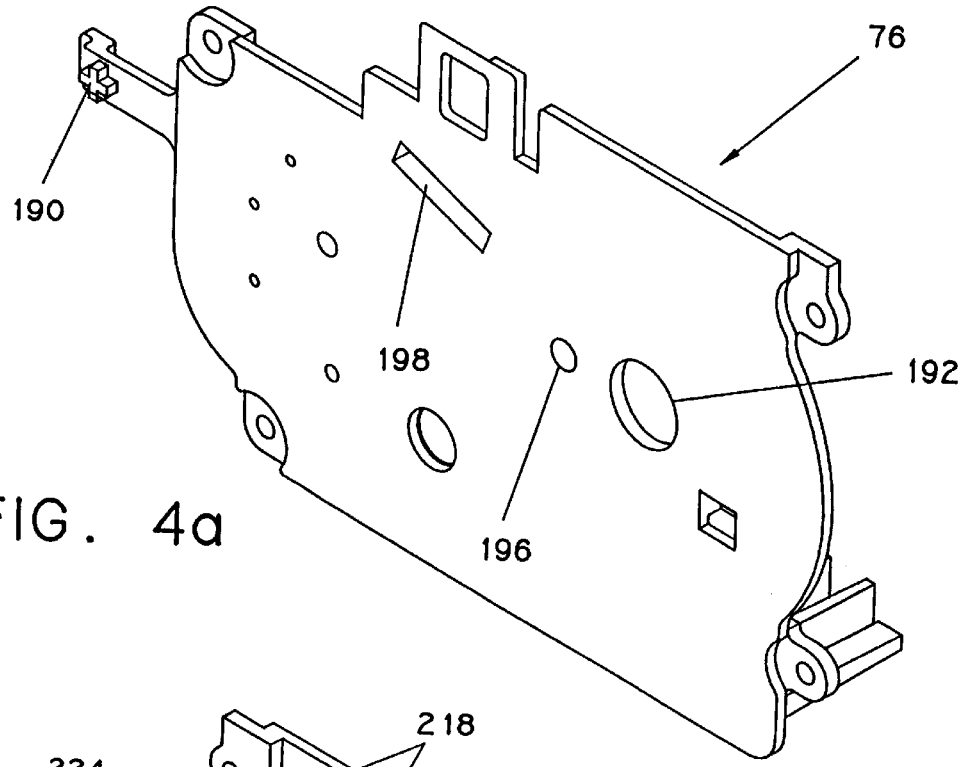
FIG. 4*a* shows an exterior view of a first side cover to the housing base.
Figure 4B:
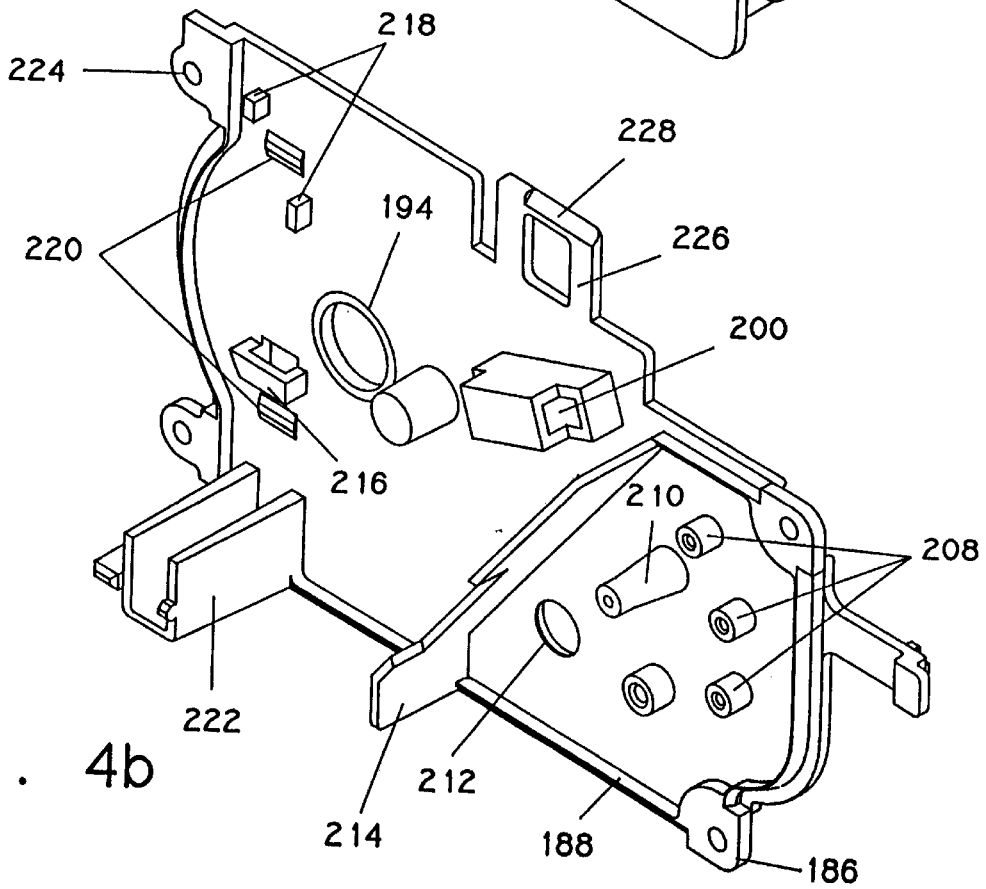
FIG. 4*b* shows an interior view of a first side cover to the housing base.
Figure 5A:
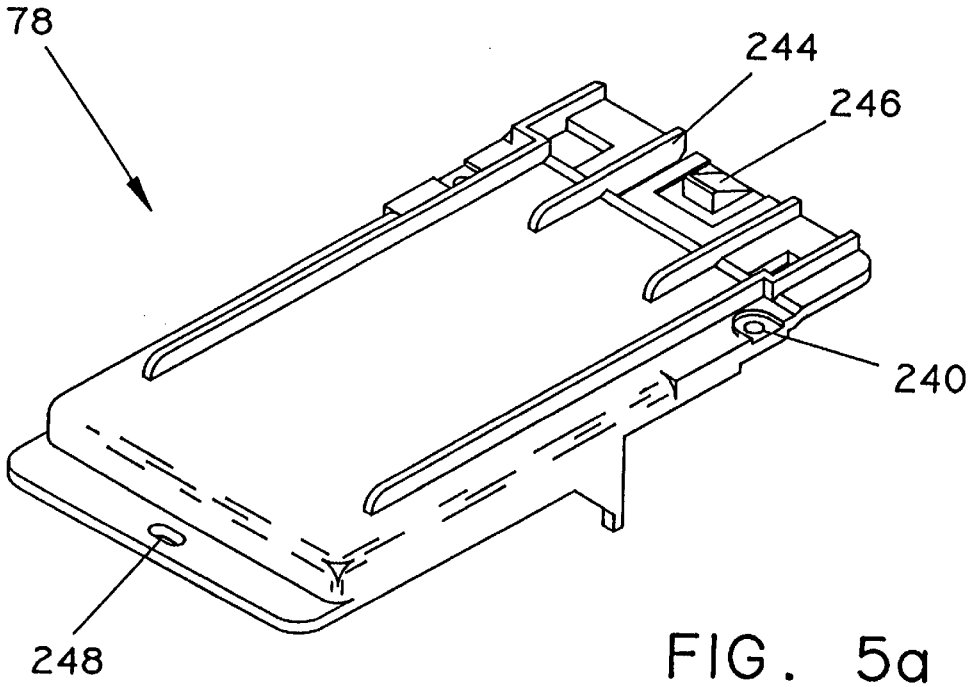
FIG. 5*a* shows an exterior view of a second side cover to the housing base.
Figure 5B:
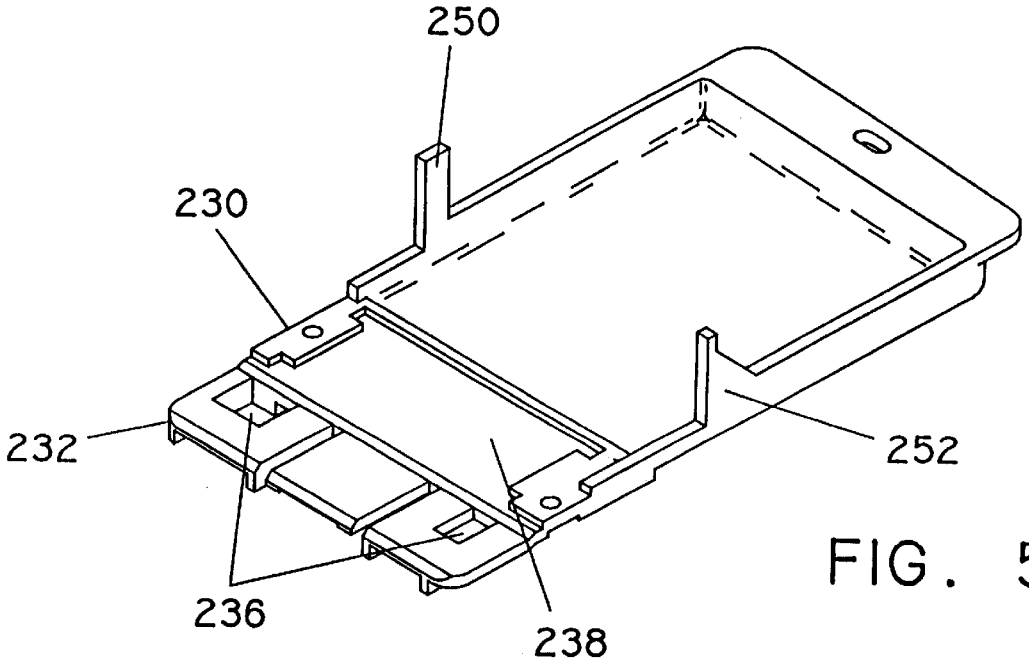
FIG. 5*b* shows an interior view of a second side cover to the housing base.

Referring to FIGS. 1*b*–23, the cam-operated timer 52 incorporates principals of Design For Manufacturing (DFM) and Design For Assembly (DFA). Under DFM and DFA designing an apparatus is the first step in its manufacturing and assembly. Design For Manufacturing involves considering how parts and components will be manufactured when they are designed in order to reduce manufacturing time, expense, waste, and improve quality. Generally parts can be manufactured better if their geometry is simple, there are as few parts as possible, and fasteners, retainers, guides, and bearings are integral to parts rather than separate components. Plastic parts can be manufactured better if they have rounded corners, roughly consistent thickness, and draft angles to permit easy extraction from molds. Use of plastic for parts can allow greater complexity for a single part than the use of metal thereby enabling parts reduction.

Design For Assembly (DFA) involves considering how parts will be assembled into a product in order to reduce the number of parts and permit easier assembly of parts. An important aspect of DFA is to design parts that can be handled and assembled more easily. Generally parts can be handled more easily if parts can be assembled on a straight axis, there are only a few assembly axes, the part is oriented either parallel or perpendicular to the assembly axis, the part can only be assembled in the correct location, the target zone where the part is to be assembled is generous, the parts are radiused where they will contact other parts during assembly to better guide the parts into the target, and the part is asymmetrical in both horizontal and vertical planes to permit automated assembly machines to better hold and orient parts. Design for assembly and design for manufacturing are described in Machine Design, Design For Assembly, Penton Education Division, 1100 Superior Avenue, Cleveland, Ohio 44114 (1984) which is hereby incorporated by reference Referring to FIGS. 1*a*–23, an appliance 50 such as a clothes washing machine, clothes dryer, and dishwasher often uses a cam-operated timer 52 to control various appliance functions in accordance with a predetermined program. The cam-operated timer 52 will typically be mounted in an appliance console on a console mounting plate 51 that has a control shaft bore and mounting slots. The cam-operated timer 52 includes a housing 54, and timer components 56. The timer components 56 include a motor 58, a gear train 60, a camstack 62, a camstack drive 64, blade switches 66, a master switch 68, a quiet cycle selector 70, and a subinterval switch 72. A more detailed description of the housing 54 and timer components 56 follow.

Housing

The housing 54 includes a base 74, a first side cover 76, and a second side cover 78. The housing base 74 has a first open side 80, a second open side 82, a base platform 84, base details 86, a base assembly detail 88, a base sealing ridge 90, base first side cover fasteners 92, base second side cover fasteners 94, base plug rail 96, and a base mount 98. The first side cover 76 is installed over the first open side 80 of the housing base 74, and the second side cover 78 is installed over the second open side 82 of the housing base 74. The base platform 84 carries the base details 86 and provides a datum plane for orienting the housing 54 and timer components 56. The housing 54 is molded from a plastic such as a mineral glass filled thermoplastic such as polyester polybutylene terephthalate (PBT). The housing base 74 is preferably molded to form a single piece of plastic with a draft angle of about 1.5° expanding toward the first open side 80.

The base details 86 include base drive details 100, base motor details 130, base camstack details 140, and base master switch details 148. The base details 86 point toward the first open side 80 to accept timer components 56, and the base details 86 are orientated substantially perpendicular to the base platform 84. The base details 86 perform one of more of the following functions: locate timer components 56 in the housing, retain timer components 56 in the housing, and provide bearing surfaces for movement of timer components 56. Housing details 86 reduce the need for separate fasteners, connectors and bearings which can complicate assembly, increase quality defects, and create tolerance stack-up problems. The base details 86 are generally either radiused or tapered on surfaces nearest the first open side 80 to provide a greater target area for the assembly of timer components 56 and to reduce the opportunity for timer components 56 to improperly seat during installation. Since the housing base 74 is preferably a single piece of plastic and the base details 86 are integral to the base, assembly variations are greatly reduced. The use of molded base details 86 reduces count of piece parts required for the cam-operated timer 52.

The base drive details 100 include a drive cam mount 102, a drive cam bore 104, a drive cam bore service mark 106, a drive spring mount 108, a subinterval pivot pin 110, a secondary drive pawl stop 112, a masking lever pivot pin 114, delay spring support post 116, delay no-back spring seat 118, a delay rocker pivot pin 120, and delay wheel mount 122. The drive cam mount 102 inner diameter provides a bearing for rotation of the camstack drive 64. The drive cam bore 104 permits visual inspection of the drive cam 606 by a service person to determine if the camstack drive 64 is rotating. The drive cam bore service mark 106 on the outside of the base 74 permits a service person to relate camstack drive operation to camstack rotation. The drive spring mount 108 positions the drive spring 612 about 0.040 of an inch (0.102 cm) above the base platform 84 for proper biasing of the camstack drive 64. The subinterval pivot pin 110 provides the subinterval switch 72 an axis on which to pivot. The secondary drive pawl stop 112 limits movement of the camstack drive 64. The masking lever pivot pin 114 provides a pivot axis for a camstack drive component. The delay spring support post 116 provides a location on the housing base 74 to connect a camstack drive component. The delay no-back spring seat 118 provides a surface to assist in biasing a camstack drive component. The delay rocker pivot pin 120 provides a pivot axis for a camstack drive component. The delay wheel mount 122 provides an axis for rotation of a camstack drive component. The delay wheel mount 122 includes a delay wheel mount first bearing 124, a delay wheel mount draft 126, and a delay wheel second bearing 128. The delay wheel mount first bearing 124, the delay wheel mount draft 126, and the delay wheel mount second bearing 128 provide dual bearing surfaces to reduce the draft angle of the delay wheel mount first bearing 124 and delay wheel mount second bearing 128 compared to the overall draft angle of the delay wheel mount 122.

The base motor details 130 include a motor shelf 132, motor pedestals 134, motor pedestal ribs 136, and base motor fasteners 138. The motor shelf 132 and motor pedestals 134 cooperate to locate the motor 58 about 1.19 inches (3.023 cm) above the base platform 84. The motor pedestal ribs 136 vertically locate a camstack drive component. The base motor fasteners 138 are chamfered to provide a larger target area to more easily align with the motor 58 during installation and then after the motor 58 is installed the base motor fasteners 138 are heat staked to attach the motor 58 to the housing base 74.

The base camstack details 140 include a control shaft mount 142, a hub opening 144, and camstack supports 146. The control shaft mount 142 outer diameter serves as a bearing for rotation of the camstack 62. The hub opening 144 permits insertion of a camstack component during assembly of the cam-operated timer 52. The camstack supports 146 carry the camstack 62 and are radiused to reduce friction between the camstack supports 146 and locate the camstack 62 about 0.360 of an inch (0.914 cm) above the base platform 84.

The base master switch details 148 include a rocker lifter pivot pin 150, a rocker lifter retainer 152, a rocker lifter bearing 154, a switch lifter offset 156, a switch lifter pivot pin 158, a switch lifter retainer 160, a switch lifter bearing 162, a rocker support 164, a rocker cradle 166, and a lift bar channel 168. The rocker lifter pivot pin 150 and switch lifter pivot pin 158 locate master switch components on the base platform 84 and provide a pivot axis for master switch components. The switch lifter offset 156 positions a master switch component about 0.055 of an inch (0.140 cm) above the base platform 84 to provide clearance for the subinterval switch 72. The rocker lifter bearing 154 and switch lifter bearing 162 are raised portions of the base platform 84 that provide bearing surfaces to reduce friction during movement of master switch components. The rocker lifter retainer 152 and switch lifter retainer 160 are hook-shaped and integral to the base platform 84 to retain proper alignment of master switch components in relation to the base platform 84. The rocker support 164 locates a master switch component about 0.865 of an inch (2.197 cm) above the base platform 84, and the rocker cradle 166 provides a pivot axis and bearing surface for a master switch component. The lift bar channel 168 locates a master switch component and provides an axis and bearing movement of the master switch component.

The base assembly detail 88 is an assembly mount that is used during assembly of the cam-operated timer 52. The base assembly detail 88 is a circular bore in the housing base 74 that mates with automated assembly equipment such as a palette-and-free assembly detail (not shown). During assembly of the cam-operated timer 52, the base assembly detail 88 helps to locate and hold the housing base 74 in an assembly palette for automated or manual assembly of the cam-operated timer 52.

The base sealing ridge 90 cooperates with the first side cover 76 to reduce the opportunity for contamination to enter the housing 54 between the base 74 and first side cover 76. The base first side cover fasteners 92 cooperate with the first side cover 76 and are heat staked to attach the first side cover 76 to the base 74. The base second side cover fasteners 94 include a base second side cover pin 170, a base female wafer fastener 172, and a base female wafer ramp 174 that cooperate with second side cover 78 to attach the second side cover 78 to the base 74. The base plug rail 96 aligns and guides an electrical connector (not shown) to mate with the blade switches 66. The base plug rail 96 improves alignment of the electrical connector with the blade switch 66 to improve electrical connections and reduce the opportunity for damage to the electrical connector and blade switches 66.

The base mount 98 includes first mounting tabs 176, a second mounting tab 178, a locking pin support 180, and a screw mount 182. The base mount 98 cooperates with the first side cover 76 to attach the cam-operated timer 52 to an appliance console mounting plate 51. The first mounting tabs 176 and second mounting tab 178 are radiused to ease insertion into appliance console mounting slots. The second mounting tab 178 includes a second mounting tab slot that receives a portion of the console mounting plate 51 to secure the portion of the base nearest the second mounting tab slot to the mounting plate. The locking pin support 180 cooperates with the first side cover 76 to lock the cam-operated timer 52 on the mounting plate. The screw mount 182 is for a screw (not shown) that can be used as an additional means to secure the cam-operated timer 52 to the appliance console.

The first side cover 76 has first side cover details 184, first side cover fasteners 186, a first side cover lip 188, and a first side cover locking pin 190. The first side cover details 184 include a camstack hub bore 192, a camstack hub bearing 194, a cover mounting recess 196, a detent follower channel 198, cover motor details 204, and cover master switch details 206. The camstack hub bore 192 allows a portion of the camstack 62 to extend through the first side cover 76. The camstack hub bearing 194 provides both a rotational bearing and a thrust bearing for the camstack 62. The camstack hub bore 192 is not chamfered to increase camstack hub bearing 194 strength. The cover mounting recess 196 permits an appliance mechanical fastener such as a screw (not shown) to have clearance without damaging the cam-operated timer 52. The detent follower channel 198 has a detent follower bore 200 and a detent spring pilot 202. The detent follower channel 198 and detent spring pilot 202 provide an axis for movement and assist in retaining timer components 56 that engage the camstack 62.

The cover motor details 204 include cover gear arbor sockets 208, a cover motor shaft socket 210, a cover spline connector bore 212, and a cover gear train partition 214. The cover gear arbor sockets 208 extend about 0.149 of an inch (0.378 cm) from the first side cover 76 and have a chamfer lead-in of about 45° to increase the target area for assembly of the first side cover 76 over the housing base 74. The cover motor shaft socket 210 extends about 0.433 of an inch (1.100 cm) from the first side cover 76 and also has a chamfer lead-in of about 45° to increase the target area for assembly of the first side cover 76 over the housing base 74. The cover gear train partition 214 serves to isolate most of the gear train 60 in the housing 54.

The cover master switch details 206 include a cover first lift bar guide 216, a cover second lift bar guide 218, cover lift bar bearings 220, and a cover rocker retainer 222. The cover first lift bar guide 216 and the cover second lift bar guide 218 cooperate to axially align a master switch component. The lift bar bearings 220 provide bearing surfaces for smooth movement of a master switch component. The cover rocker retainer 222 cooperates with the housing base rocker support 164 to secure a master switch component in the housing base 74 when the first side cover 76 is installed.

The first side cover fasteners 186 include first side cover attachment bores 224, a cover female wafer fastener 226, and a cover female wafer ramp 228. The first side cover attachment bores 224 receive complementary base first side cover fasteners 92 to align and attach the first side cover 76 to the base 74. The first side cover attachment bores 224 are chamfered to provide a greater target area when the first side cover 76 is attached to the housing base 74. The cover female wafer fastener 226 receives a complimentary fastener from the blade switches 66. The cover female wafer ramp 228 provides a greater target area and eases attachment of the complimentary fastener from the blade switches 66. Use of plastic permits the first side cover 76 to be heat staked to the base 74 to eliminate the need for separate fasteners such as screws or rivets. The first side cover lip 188 extends around a portion of the periphery of the first side cover 76 to create a seal between the first side cover 76 and the base 74. The first side cover locking pin 190 engages a complementary fastener on an appliance console mounting plate 51 to assist in securing the cam-operated timer 52 into an appliance console. The base locking pin support 180 cooperates with the first side cover locking pin 190 to protect the first side cover locking pin 190 by limiting its flexing.

The second side cover 78 includes, a wafer mount 230, a plug connector 232, second side cover fasteners 234, and second side cover assembly bores 236. The wafer mount 230 cooperates with the second side cover assembly bores 236 to attach the blade switch 66 in the second side cover 78. The wafer mount 230 includes a wafer shelf 238, wafer mounting bores 240, and wafer rivets 242. The wafer shelf 238 aligns and stabilizes the blade switches 66 in the second side cover 78. Wafer rivets 242 are then installed through the blade switches 66 and the wafer mounting bores 240 to secure the blades switches 66 into the second side cover 78. The plug connector 232 has plug guides 244 and a ramped surface 246. The plug guides 244 cooperate with the electrical plug (not shown) to properly align the electrical plug with the blade switches 66. When the electrical plug is seated on the blade switches 66, the ramped surface 246 engages the electrical plug to lock the electrical plug on the second side cover 78. The second side cover fasteners 234 include a second side cover attachment bore 248, a second side cover base pin 250, and a second side cover ramp pin 252. The second side cover fasteners 234 are used to attach the second side cover 78 to the housing base 74 and first side cover 76. The second side cover attachment bore 248 engages the base second side cover pin 170 which is then heat staked to provide an additional means of attaching the second side cover 78 to the base 74. The second side cover assembly bores 236 are used as an assembly aid when attaching the blade switches 66 and as an assembly aid when attaching the second side cover 78 to the housing base 74 and first side cover 76.

An advantage of having a plastic timer housing 54 with all timer components 56 contained inside the plastic timer housing is that the cam-operated timer 52 is electrically insulated from the appliance 50 eliminating the need for a ground strap. Another advantage of the electrically insulated plastic housing 54 is that integral plastic attachments can easily be added to the plastic housing 54 that are designed to cooperate with plastic attachments on the appliance control console to permit the cam-operated timer 52 to be snapped into the appliance 50 rather than be attached with separate fasteners.

Motor

Figure 7:
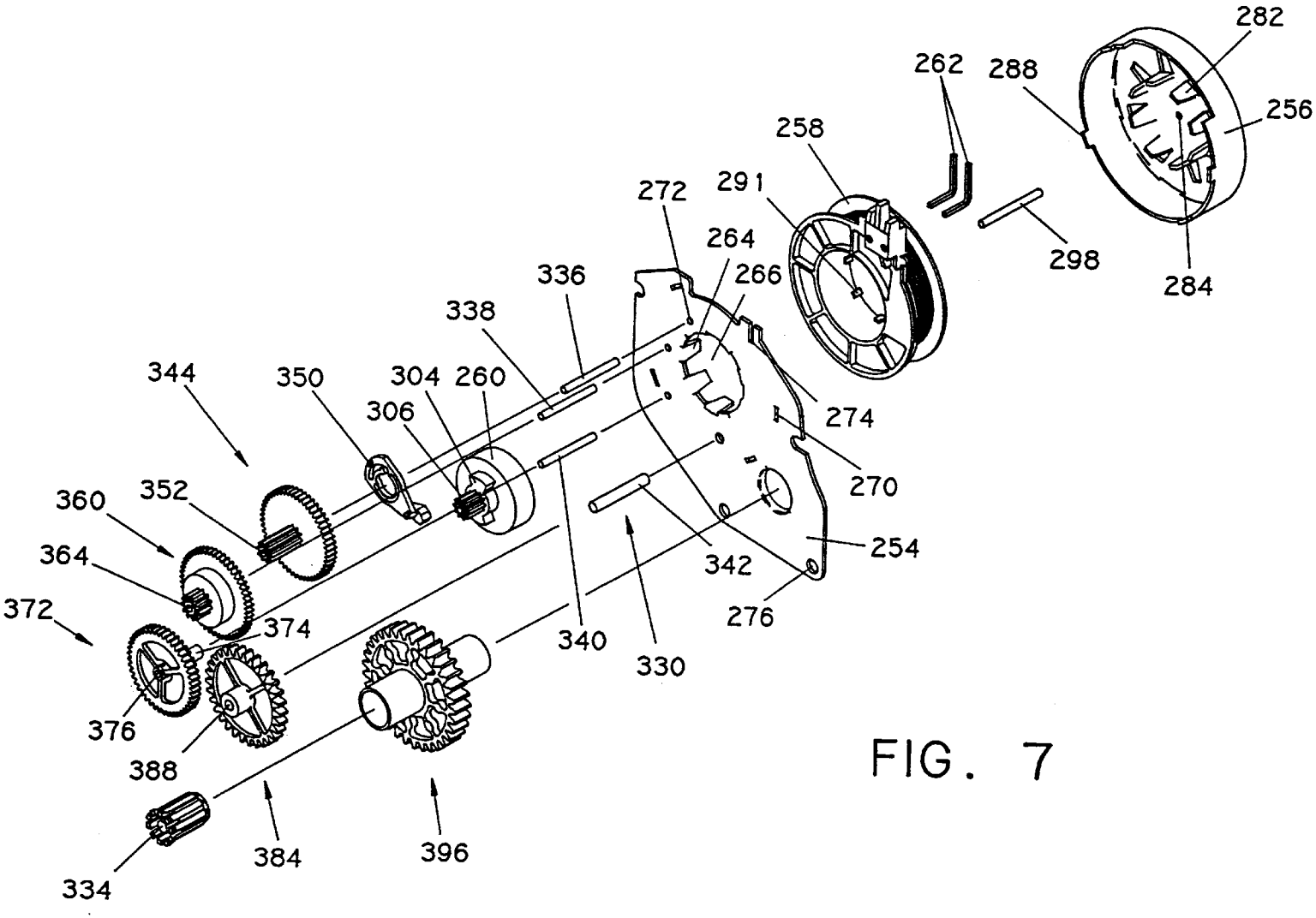
FIG. 7 shows an exploded view of a motor and gear train.
Figure 8:
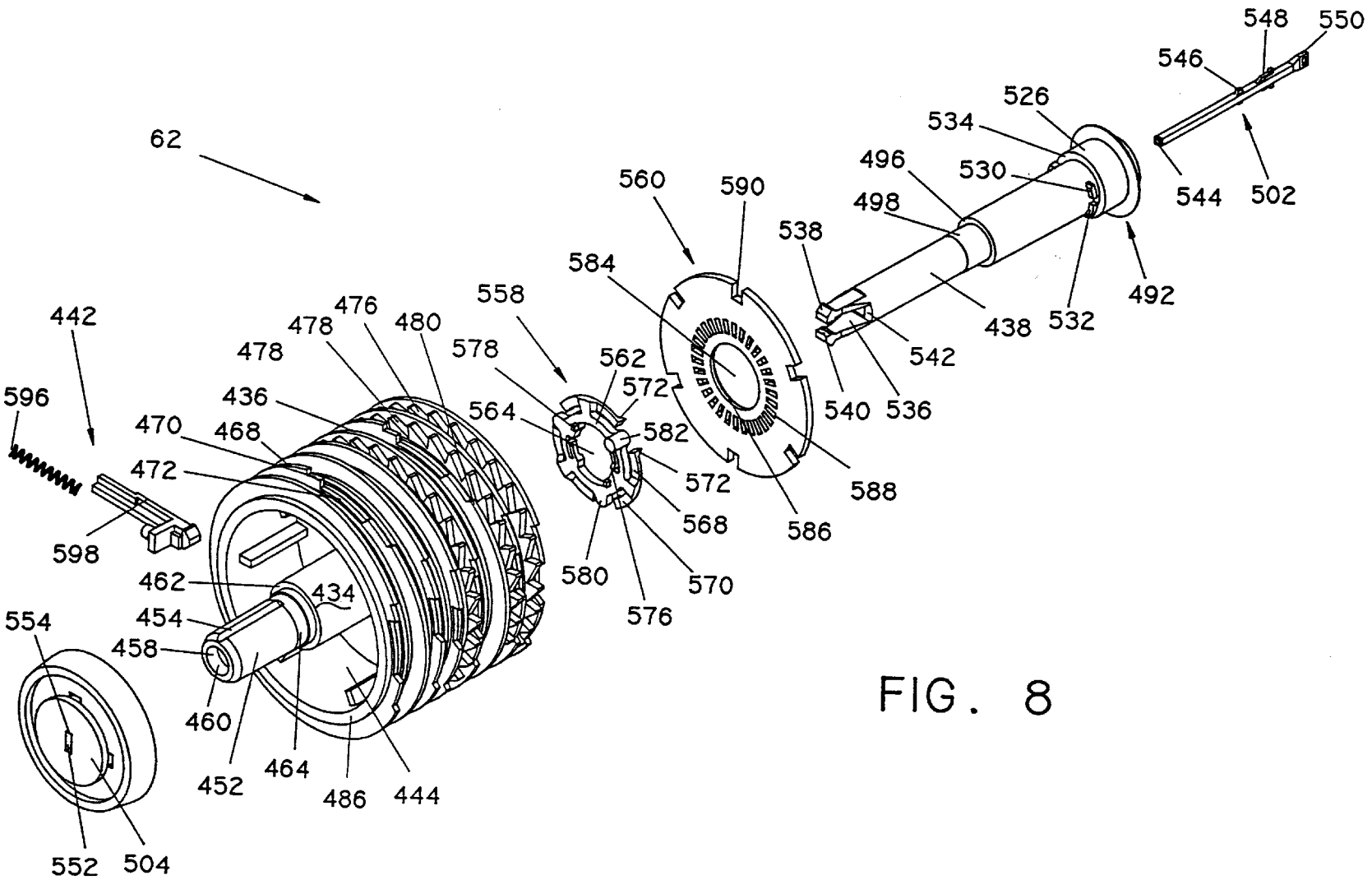
FIG. 8 shows an exploded view of a camstack.

Referring to FIG. 7, the motor 58 comprises a field plate 254, a stator cup 256, a bobbin 258, a rotor 260, and motor terminals 262. The motor 58 transmits torque through the gear train 60 to rotate the camstack drive 64. The motor 58 is an AC synchronous motor designed to operate on about 120 VAC at about 50–60 Hz to produce rotor rotation of about 600 RPM at a torque of about 100 ounce-inches (0.072 KgM) measured at 1.0 R.P.M. A separate enclosure for the motor 58 is not necessary because the motor 58 is enclosed by the housing 54 thus double insulating the motor 58. The motor 58 is placed at a mid-level in the housing 54 with the gear train 60 above the motor 58 and the camstack drive below the motor 58. The motor terminals 262 permit the motor 58 to be electrically connected to the blade switches 66 when the second side cover 78, carrying the blade switches 66, is attached to the housing 54.

The field plate 254 has stator poles 264, a rotor cavity 266, a field plate bearing 268, stator cup slots 270, gear arbor bores 272, a field plate terminal block mount 274, and field plate attachment bores 276. The field plate stator poles 264 are formed from material lanced and bent to form the rotor cavity 266. Also by bending the stator poles 264 from rotor cavity material, the stator poles 264 are curved toward the rotor cavity 266 which reduces the chance of the rotor 260 becoming caught on a stator pole during installation. The field plate bearing 268 is a sleeve bearing, integral to the field plate 254, that is extruded toward the housing base platform 84 to permit easier installation of a gear train component. The housingless motor is a factor that permits use of field plate bearing 268.

The field plate terminal block mount 274 has a first prong 278 and a second prong 280 that engage the motor terminals 262 to align and support the motor terminals. The field plate terminal block mount 274 aligns the motor terminals 262 in relation to the field plate 254. Since the field plate 254 is attached to the housing base 74, the motor terminals 262 are also aligned in relation to the housing base 74 and the second open side 82. The field plate terminal block mount 274 supports the motor terminals 262 in both a plane parallel to the housing base platform 84 and in a plane perpendicular to the housing base platform 84. There is a space of about 0.050 of an inch (0.127 cm) between the first prong 278 and the second prong 280 that the motor terminals 262 engage to strengthen the motor terminals 262 and to maintain a proper alignment angle between the motor terminals 262 and the blade switches 66 attached to the second side cover 78. The ends of the first prong 278 and second prong 280 are tapered and engage the motor terminals 262 to substantially prevent axial displacement of the motor terminals 262 when the second side cover 78, carrying the blade switches 66, is installed on the housing 54.

The field plate attachment bores 276 coincide with the base motor fasteners 138 to align the field plate 254 in the housing base 74. The base motor fasteners 138 are staked to the field plate attachment bores 276 to secure the field plate 254 to the housing base 74 to withstand about a 50.0 lb. (22.68 Kg) pull-off force without loosening. The field plate 254 serves multiple purposes: the field plate 254 provides a means for attaching the motor subassembly to the housing base 74; the field plate 254 carries the gear train 60; the field plate 254 provides a bearing for a gear train component, and the field plate 254 provides a motor terminal mount. The field plate 254 is stamped from a low carbon steel with good magnetic properties.

The stator cup 256 includes stator poles 282, a rotor shaft bore 284, a bobbin terminal port 286, and stator cup tabs 288. The stator cup poles 282 are formed from material outside the rotor cavity 266. The bobbin terminal port 286 provides an opening in the stator cup 256 for the portion of the bobbin 258 carrying the motor terminals 262 to extend through the stator cup 256. After insertion, the stator CLIP tabs 288 are staked to the field plate stator cup slots 270 to secure the stator cup 256 to the field plate 254. The stator cup 256 is stamped from a low carbon steel which is preferably the same material used for the field plate 254.

The bobbin 258 includes bobbin winding lugs 290, a bobbin reverse winding post 292, bobbin stator notches 294, and magnet wire 296. The bobbin winding lugs 290 are used to rotate the bobbin 258 when magnet wire 296 is wound onto the bobbin 258. The bobbin reverse winding post 292 is used to reverse the winding direction of the magnet wire 296, and has a radiused top to reduce the opportunity for interference with winding. The bobbin stator notches 294 align the bobbin 258 with stator cup poles 264 when the bobbin 258 is installed in the stator cup prior to the stator cup being staked to the field plate 254. The bobbin 258 is preferably manufactured from a 30% glass filled nylon 6/6.

The magnet wire 296 is typically 43–48 gauge copper, and about 10,000 turns are placed on the bobbin 258. The magnet wire 296 has ends that are skeined with seven skeins for about five inches for added strength to reduce breaks than can occur when the magnet wire 296 is attached to the bobbin 258 and the motor terminals 262. Winding of the bobbin 258 can be done in a single direction for all winding or some winding can be counter wound by using the bobbin reverse winding post 292 to reverse direction of windings. Counter winding permits the excitation level of the bobbin to be balanced with other factors such as rotor inertia and power consumption when using larger gauge, less expensive wire such as 40–50 gauge wire. The number of counter-wound turns to adjust motor excitation E as measured in ampere-turns is defined in terms of relation current I and the number of turns of magnet wire N by the following formula: $E=I\ (N_{FORWARD}-2N_{REVERSE})$.

The rotor 260 includes a rotor shaft 298, a rotor support 300, a molded magnet 302, a no-back cam 304, and a rotor gear 306. The rotor shaft 298 is inserted into the rotor shaft bore 284 and staked to the stator cup 256. The top of the rotor shaft 298 is slightly tapered to ease installation of the rotor 260 over the rotor shaft 298. The rotor support 300 has a rotor support first end 301 and a rotor support second end 303. The rotor support first end 301 is chamfered to fit more easily over the rotor shaft 298. The rotor support second end 303 extends beyond the rotor gear 306 to serve as a thrust bearing against the first side cover motor arbor socket. The molded magnet 302 is preferably an injection molded polymer bonded ferrite. A synthetic lubricant such as Nye® 723 is placed on the rotor shaft 298 to reduce friction. The motor support is preferably molded from a liquid crystal polymer. The rotor gear 306 has ten teeth for 60 Hz applications twelve teeth for 50 Hz applications to produce about the same rotational speed to the first stage gear.

The motor terminals 262 include a motor terminal block 308 and motor terminal wires 310. The motor terminal block 308 includes terminal block ribs 312, a magnet wire guide 314, a magnet wire post 316, motor terminal sockets 318, terminal wire channels 320, center motor terminal guide 322, and side motor terminal guides 324. The terminal block ribs 312 extend about 0.169 of an inch (0.429 cm) from the motor terminal block 308 and engage the field plate terminal block mount 274 to secure the motor terminal block 308 to the field plate 254 and align the motor terminal block 308 in relation to the housing base 74 and second open side 82. The bobbin 258 which is integral with the motor terminal block 308 also assists in securing the motor terminal block 308 to the field plate 254. More specifically, the terminal block ribs 312 cooperate with the field plate terminal block first prong 278 and second prong 280 to support and align the motor terminals 262 both in a plane parallel to the housing base platform 84 and in a plane perpendicular to the housing base platform 84. Proper alignment and support of the motor terminals 262 is necessary for the motor terminals 262 to mate with the target area of the blade switches during assembly of the blade switches 66 carried in the second side cover 78.

The magnet wire guide 314 is a channel about 0.030 of an inch wide (0.076 cm) and about 0.060 of an inch deep (0.152 cm) to route the magnet wire 296 from the bobbin 258 to the motor terminal wire 310. The magnet wire post 316 cooperates with the motor terminal block 308 to create a channel to guide the magnet wire 296 from the bobbin 258 to the motor terminal wire 310. The magnet wire post 316 is radiused to reduce the opportunity for magnet wire 296 to become snagged during connection of the magnet wire to the motor terminals 262.

The motor terminal sockets 318 receive the motor terminal wires 318 and are circular with a diameter of about 0.0355 inch (0.0902 cm). The terminal wire channels 320 serve as an alignment aid during installation of the motor terminal wire 310. When the motor terminal wire 310 are installed in the terminal wire channels 320, the terminal wire channels 320 increase the rigidity of the motor terminal wire 310 and maintain parallel alignment of the motor terminal wire 310. The terminal wire channels 320 are about 0.054 of an inch (0.137 cm) wide and about 0.031 of an inch (0.079 cm) deep.

The center motor terminal guide 322 and side motor terminal guides 324 function to align the motor terminals 262 with the blade switches 66 when the second side cover 78 is installed onto the housing base 74. The center male guide 322 extends about 0.225 of an inch (0.572 cm) above the motor terminal block 308 and narrows away from the motor terminal block 308 to ease insertion into the blade switches 66. When the second side cover 78 is assembled onto the housing base 74, the center motor terminal guide 322 assists in locating the motor terminals 262 in relation to the blade switches 66. The side motor terminal guides 324 extend about 0.100 of an inch (0.254 cm) and narrow away from the motor terminal block 308 to ease insertion into the blade switches 66. When the second side cover 78 is assembled onto the housing base 74, the side motor terminal guides 324 also assist in locating the motor terminals 262 in relation to the blade switches.

The motor terminal wire 310 include motor terminal wire coil ends 326 and motor terminal wire blade switch ends 328. The motor terminal wire 310 are preferably formed from a 0.031 inch (0.0787 cm) square phosphor bronze 510 alloy with a 0.003 inch (0.00762 cm) maximum radius on the corners that is pre-tined with a solder. The motor terminal wire straight length is about 0.795 of an inch (2.019 cm), and both the motor terminal wire coil end 326 and the motor terminal wire blade switch end 328 are cut with a 60° pyramid angle swage. The motor terminal wire coil end swage provides an insertion guide for inserting the motor terminals 262 into the motor terminal sockets 318. The motor terminal wire blade switch end swage provides an insertion aid to guide the motor terminal wire switch ends 328 into the blade switches 66 during installation on the second side cover 78. The terminal blade switch end 328 extends about 0.170 inches (0.432 cm) above the bobbin terminal sockets.

The motor terminal wire 310 are installed in the motor terminal sockets 318 as follows. The motor terminal wire 310 are inserted into the motor terminal sockets 318 prior to the bobbin 258 being wound with magnet wire 296. The motor terminal wire 310 are secured in the terminal sockets 318 by interference between square motor terminal wire 310 and the round terminal sockets 318. After the motor terminals 262 are inserted, the terminal blade switch ends 328 are bent at about 90°, so the motor terminal wire switch ends are received in the terminal wire channels 320. The terminal wire channels 320 align and increase the rigidity of the motor terminal wire switch ends. After the magnet wire is attached to the motor terminal wire coil ends and soldered, the motor terminal wire coil ends 326 are bent at an acute angle with a roller to reduce damage to the magnet wire and to prevent the coil ends from interfering with the first side cover detent follower channel 198.

The motor 58 is assembled before installation into the housing base 74 by assembling motor components on a straight axis that is perpendicular to the field plate 254 using automated assembly equipment. Assembly of the motor 58 begins by staking the rotor shaft 298 to the stator cup rotor shaft bore 284. Gear train components are then staked to the field plate gear arbor bores 272. After staking, the gear arbors 330 may be lubricated lightly to prevent corrosion. The motor terminal wire 310 is inserted into the motor terminal sockets 318 and bent so that the motor terminal wire switch ends 328 are carried in the terminal wire channels 320. The bobbin 258 is wound with wire 296 and the wire is attached to the motor terminal wire coil ends 326. The bobbin 258 is placed into the stator cup 256, and the stator cup is attached to the field plate 254. When the stator cup 256 is attached to the field plate 254, the terminal block ribs 312 engage the field plate terminal block mount 274, to align and secure the motor terminal block 308 to the field plate. The rotor shaft 298 is lubricated with a synthetic hydrocarbon such as Nye® 723GR, and the rotor support 300 is placed over the rotor shaft 298. Gear train components are installed on the field plate 254 and lubricated to reduce noise during operation. The assembled motor 58 is then placed on base motor details 130 and the base motor fasteners 138 are heat staked to secure the motor module in place, and the rotor 260 is then placed over the rotor shaft 298.

Gear Train

Referring to FIG. 7, the gear train 60 includes gear arbors 330, gears 332, and a spline connector 334. The gear train 60 transmits approximately 100 inch ounces (0.072 KgM) of torque at 1.0 RPM as measured at the camstack drive 64 from the motor 58 and in the process reduces the rotational speed of the motor 58 and increase its torque. The gears 332 can be selected to change the overall gear train ratio from about 250:1 to 1800:1 which represents rotational speeds from about 2.4 RPM to 0.3 RPM. Since the gear train 60 is located inside the housing 54, a separate housing for the gear train 60 is not required. The gear arbors 330 include a first stage gear arbor 336, a second stage gear arbor 338, a third stage gear arbor 340, and a fourth stage gear arbor 342. The gear arbors 330 are staked to the motor field plate gear arbor bores 272. When the motor subassembly is installed in the housing base 74 and the first side cover 76 is attached to the housing base 74, the cover gear arbor sockets 208 engage the gear arbors 330 to help retain and maintain proper gear arbor alignment. The gear arbors 330 are about 0.590 of an inch (1.499 cm) long and manufactured from hardened steel. Once installed, the gear arbors 330 are coated with a lubricant to reduce corrosion.

The gear trained is divided into first level gears, second level gears, and third level gears. The gears 332 include a first stage gear 344, a second stage gear 360, a third stage gear 372, a fourth stage gear 384, and an output gear 396, all manufactured from a material such as actal copolymer. Each of the gears 332 has a pinion gear and an outer gear. The gears 332 have an involute spline profile to provide more radiused surfaces for meshing than in some other types of profiles. The gears 332 are also configured with a predetermined amount of backlash to facilitate meshing, and the gears 332 are permitted to cant slightly when on the gear arbors 330 to facilitates meshing. The first level gears, second level gears and third level gear are constructed on three different meshing levels, a lower level, a middle level, and an upper level, so that the gears can be installed in some gear train configurations with only two gears meshing at a time during assembly. Assembly of the gear train 60 with only two gears meshing at a time is easier and less complicated than assembly of a gear train 60 requiring more than two gears to mesh at a time. In other gear train the third stage gear 372 may be required to mesh a total of three gears during assembly, i.e., the third stage gear 372 may be required to mesh with both the second stage gear 360 and the fourth stage gear 384 at the same time. The gears 332 are color coded for easy identification with colors such as white, blue, green, and orange.

The first stage gear 344 has a first stage base thrust bearing 346, a first stage no-back recess 348, a first stage no-back lever 350, a first stage bore 352, a first stage pinion 354, a first stage outer gear 356, and a first stage top thrust bearing 358. The first stage base thrust bearing 346 provides a surface for frictional contact with the field plate 254 when the first stage gear 344 is installed on the first stage gear arbor 336. The first stage no-back recess 348 is a cavity to accept the first stage no-back lever 350. The first stage no-back lever 350 is attached to the outer diameter of the first stage thrust bearing 346 and carried in the first stage no-back recess 348, so the first stage thrust bearing 346 can still provide the surface for frictional contact with the field plate 254 once the first stage no-back lever 350 is installed on the first stage gear 344. The first stage no-back lever 350 is attached to the first stage gear 344 prior to the first stage gear 344 being installed on the first stage gear arbor 336. The first stage no-back lever 350 cooperates with the rotor no-back cam 304 to ensure the motor 58 will only operate in a single direction. The first stage no-back lever 350 is preferably manufactured from an acetal copolymer. The first stage bore 352 cooperates with the first stage arbor 336 to provide a low friction axis of rotation for the first stage gear 344. The first stage bore 352 has about a 45° chamfer to provide a greater target area when the first stage bore 352 is placed over the first stage gear arbor 336. The first stage outer gear 356 is driven by the rotor gear 306, and the first stage pinion 354 drives the second stage gear 360. The first stage top thrust bearing 358 provides a frictional surface to contact the corresponding first side cover gear arbor socket when the cam-operated timer 52 is assembled. When the first stage gear 344 with attached first stage no-back lever 350 is installed over the first stage gear arbor 336, the first stage no-back lever 350 is oriented to rotor cavity side toward the motor terminals 262 for the motor 58 to operate clockwise. If the first stage gear 344 with attached first stage no-back lever 350 is oriented to the rotor cavity side away from the motor terminals 262, the motor 58 will rotate counter-clockwise.

The second stage gear 360 has a second stage base thrust bearing 362, a second stage bore 364, a second stage pinion 366, a second stage outer gear 368, and a second stage top thrust bearing 370. The second stage base thrust bearing 362 provides a surface for frictional contact with the field plate 254 when the second stage gear 360 is installed on the second stage gear arbor 338. The second stage bore 364 cooperates with the second stage arbor 338 to provide a low friction axis of rotation for the second stage gear 360. The second stage bore 364 has about a 45° chamfer to provide a greater target area when the second stage bore 364 is placed over the second stage gear arbor 338. The second stage outer gear 368 is driven by the first stage pinion 354, and the second stage pinion 366 drives the third stage outer gear 380. The second stage top thrust bearing 370 provides a frictional surface to contact the corresponding second side cover gear arbor socket when the cam-operated timer 52 is assembled.

The third stage gear 372 has a third stage base thrust bearing 374, a third stage bore 376, a third stage pinion 378, a third stage outer gear 380, and a third stage top thrust bearing 382. The third stage base thrust bearing 374 provides a surface for frictional contact with the field plate 254 when the third stage gear 372 is installed on the third stage gear arbor 340. The third stage bore 376 cooperates with the third stage arbor 340 to provide a low friction axis of rotation for the third stage gear 372. The third stage bore 376 has about a 45° chamfer to provide a greater target area when the third stage bore 376 is placed over the third stage gear arbor 340. The third stage outer gear 380 is driven by the second stage pinion 366, and the third stage pinion 378 drives the fourth stage outer gear 392. The third stage top thrust bearing 382 provides a frictional surface to contact the corresponding third side cover gear arbor socket when the cam-operated timer 52 is assembled.

The fourth stage gear 384 has a fourth stage base thrust bearing 386, a fourth stage bore 388, a fourth stage pinion 390, a fourth stage outer gear 392, and a fourth stage top thrust bearing 394. The fourth stage base thrust bearing 386 provides a surface for frictional contact with the field plate 254 when the fourth stage gear 384 is installed on the fourth stage gear arbor 342. The fourth stage bore 388 cooperates with the forth stage arbor 342 to provide a low friction axis of rotation for the fourth stage gear 384. The fourth stage bore 388 has about a 45° chamfer to provide a greater target area when the fourth stage bore 388 is placed over the fourth stage gear arbor 342. The fourth stage outer gear 392 is driven by the third stage pinion 378, and the fourth stage pinion 390 drives the output gear 396. The fourth stage top thrust bearing 394 provides a frictional surface to contact the corresponding first side cover gear arbor socket when the cam-operated timer 52 is assembled.

The output gear 396 has an output extension 398, an output base thrust bearing 400, an output base lead-in 402, an output gear disconnect bearing 404, an output gear rotational bearing 406, an output field plate thrust bearing 408, an output gear spline bore 410, output gear splines 412, output gear spline tips 414, an output spline connector groove 416, and an output cover thrust bearing 418. The output gear 396 functions to operate the drive cam 606 for rotation and retain and maintain proper alignment of some camstack drive components. The output extension 398 extends through the motor field plate 254 to retain and maintain proper alignment of some cam stack drive components. The output gear thrust bearing 400 engages the secondary drive pawl 610 on the drive cam 606 to assist in locating and securing the camstack drive 64 in the housing base 74. The output base lead-in 402 has a larger diameter than the drive cam top 630 to provide a larger target area for guiding the output gear 396 onto the drive cam 606. The output gear disconnect bearing 404 engages the drive cam disconnect bearing 631 to permit the output gear 396 to rotate independently of the drive cam 606 until a spline connector 334 is installed. The output gear rotational bearing 406 engages the field plate bearing 268 to provide a rotational axis for the output gear 396. The output field plate thrust bearing 408 engages the field plate 254 to properly space the output gear 396 in relation to the field plate 254 and provide a frictional surface for the output gear 396 to contact the field plate 254. The output spline bore 410 provides space to receive the spline connector 334 and the output gear disconnect bearing 404 provides a stop to prevent the spline connector 334 from migrating into the output extension 398. The output gear splines 412 provide a means to frictionally couple the output gear 396 to the spline connector 334. The output gear spline tips 414 have about a 45° point to assist in synchronizing the output gear 396 with the spline connector 334 during installation of the spline connector 334. The output spline connector groove 416 assists in carrying the spline connector 334. The output cover thrust bearing 418 cooperates with the first side cover 76 to provide a frictional surface for contact with output gear 396 to assist in retaining the output gear 396 in the housing 54.

The drive connector 334, also refereed to as a spline connector, includes a spline connector lead-in 420, internal connector spline tips 422, internal connector splines 424, external connector spline tips 426, external connector splines 428, spline connector locking fingers 430, and a spline connector assembly aid 432. Without the spline connector installed, the output gear 396 can rotate on its output gear disconnect bearing 404 independently of the camstack drive 64 to permit a test fixture to operate the camstack drive 64 to test operation of the blade switches 66. Once the spline connector 334 is installed, the output gear 396 is directly coupled to the camstack drive 64 for cam-operated timer operation.

The spline connector lead-in 420 extends beyond the internal connector spline tips 422 and external connector spline tip 426 to provide a larger target area that does not require meshing to align the spline connector 334 with the camstack drive 64 during installation. The internal connector spline tips 422 and external connector spline tips 426 are tapered to about a 45° point to ease installation of the spline connector 334 by providing a larger meshing target area. The internal connector splines 424 cooperate with the camstack drive 64 to provide a mechanical connection between the spline connector 334 and the camstack drive 64. The external connector splines 428 cooperate with the output gear splines 412 to provide a mechanical connection between the spline connector 334 and the output gear 396. The spline connector locking fingers 430 are cantilever springs that create a larger outer diameter than the external connector splines 428. During installation through the first side cover spline connector bore 212, the locking fingers contract to permit insertion through the first side cover spline connector bore 212 and then the locking fingers expand to capture the spline connector 334 in the housing 54. When the spline connector 334 is installed in the output glear spline bore 410, the output spline connector groove 416 provides clearance for the locking fingers to expand. The output gear disconnect bearing 404 provides a stop for the spline connector lead-in 420 to contact to prevent the spline connector 334 from migrating into the output extension 398. The spline connector assembly aid 432 cooperates with a tool during automated or manual installation to facilitate insertion of the spline connector 334 through the first side cover 76 and into the output gear 396. The fit between the spline connector 334 and the output gear spline bore 410 is preferably toleranced to permit the spline connector 334 to float to reduce the opportunity for the camstack drive 64 to bind during temperature and humidity excursions.

The gear train 60 is not fully assembled until the motor 58 is installed in the housing base 74 and secured by heat staking to prevent damage to gears by high temperature heat used in the staking procedure. Although, the first stage gear with attached no-back lever is installed on the first stage arbor prior to the motor 58 being installed into the housing base 74. A more detailed description of gear train assembly is provided in a subsequent section titled "Assembly Of The Cam-Operated Timer".

Camstack

Referring to FIGS. 8, and 10*a*–11*d*, the camstack 62 includes a camstack hub 434, camstack profiles 436, a control shaft 438, a clutch 440, and a cycle selector detent 442. The camstack 62 is drum shaped and carries information encoded on camstack profiles 436 to open and close the blade switches 66 in accordance with a predetermined appliance program. The camstack hub 434 cooperates with the control shaft 438 to provide a rotational axis for the camstack 62. The camstack 62 is driven for rotation by the camstack drive 64 which is connected through the gear train 60 to the motor 58. The camstack 62 can be manually rotated by an appliance operator using the control shaft 438 to select an appliance cycle. The camstack 62 is preferably manufactured from a mineral or glass filed polypropylene.

The camstack hub 434 includes a center web 444, a clutch cavity 446, a clutch shelf 448, clutch fasteners 450, a hub extension 452, hub extension grooves 454, a hub control dial positioner 456, a hub bore 458, a hub inner bearing 460, a hub displacement stop 462, and a hub outer bearing 464. The center web 444 connects the camstack hub 434 to the camstack profiles 436. The clutch cavity 446 provides residential space to house the clutch 440 internally to the camstack 62. The clutch shelf 448 extends around the perimeter of the clutch cavity 446 to form a stable platform to receive a clutch component. The clutch fasteners 450 are heat staked after the clutch 440 is installed in the camstack 62 to capture the clutch 440 and the control shaft 438 within the hub bore 458. The hub extension 452 extends through the first side cover camstack hub bore when the camstack 62 is assembled in the cam-operated timer 52. The hub extension 452 also typically extends through an appliance console. The hub control dial positioner 456 can carry a dial to communicate appliance cycle information to an appliance operator. The hub inner bearing 460 cooperates with the control shaft 438 to provide a bearing for rotation of the camstack 62 on the control shaft 438. The hub displacement stop 462 cooperates with the control shaft 438 to limit the travel of the control shaft 438 within the camstack 62 when the control shaft is indexed out to an extended position away from the housing base 74 by an appliance operator. The hub outer bearing 464 cooperates with the control shaft 438 to provide a second bearing for rotation of the camstack 62 on the control shaft 438.

The camstack profiles 436 include switch program blades 466, a drive surface 474, a detent blade 484, a camstack face 486, a delay profile 488, and blade valleys 490. The switch program blades 466 carry appliance program information to operate the blade switches 66 to make or break electrical contacts 744 to switch appliance functions "on" and "off". Examples of appliance functions that can be switches are hot and cold water valves, motor control circuits, water pump circuits, cam-operated timer motor control circuits, appliance motor start circuits, appliance motor run circuits, and to bypass circuits. The switch program blades 466 have an appliance program encoded on a top radius 468, a neutral radius 470, a bottom radius 472. In cam-operated timer configurations without the optional master switch 68, the camstack profiles 436 can be configured to break all electrical contacts 744 of the blade switches 66 to turn "off" an appliance 50 such as a dishwasher.

The drive blades 474 include a primary drive blade 476, a secondary drive blade 478, a delay drive blade 480, and drive teeth 482. The primary drive blade 476 and secondary drive blade 478 are engaged by the camstack drive 64 to rotate the camstack 62. The delay drive blade 480 is used on cam-operated timers that are configured with the optional feature of delay drive 604. The primary drive blade 476, secondary drive blade 478, and delay drive blade 480 are about 0.046 of an inch (0.117 cm) wide. The delay drive blade 480 is engaged by the camstack drive 64 to rotate the camstack 62 at a slower speed than when the camstack drive 64 engages the primary drive blade 476 and secondary drive blade 478. The drive teeth 482 are located on the primary drive blade 476, secondary drive blade 478, and delay drive blade 480 at predetermined intervals to provide incremental frictional surfaces for the camstack drive 64 to engage the camstack for rotation about the control shaft axis. Drive teeth 482 spacing may vary on the drive blades 474 to alter the rotational speed of the camstack 62 in the range from about 4.5° to 7.5° of camstack rotation for each camstack drive increment. Predetermined portions of the delay drive blade 480 will not have drive teeth 482 when the same predetermined portions of the primary drive blade 476 has drive teeth 482 and vice versa. The camstack drive 64 keeps synchronized by having drive teeth 482 on either the delay drive blade 480 or primary drive but not both. The delay profile 488 is located on the camstack interior diameter opposite the hub extension 452. The delay profile 488 contains predetermined information to engage and disengage a component of the camstack drive 64. In bidirectional applications, the delay profile 488 is configured to operate in either direction.

The detent blade 484 is engaged by the cycle selector detent 442 to provide the operator with either tactile or auditory feedback or both from the cycle selector detent 442 to more easily select an appliance function when the shaft control knob 504 is rotated. The detent blade 484 has a profile that can be varied to correspond with appliance cycles. With a uni-directional camstack, the detent blade 484 can be configured with build-up torque prior to selection of a cycle and with an even greater exit torque prior to moving from the selected cycle. With a bi-directional camstack, the detent blade 484 is typically configured with about the same build-up torque as exit torque from a selection, so an appliance operator is given similar feedback during each direction of camstack rotation. The camstack face 486 can also be engaged by the cycle selector detent 442 to provide the operator with either tactile or auditory feedback or both from the cycle selector detent 442 to more easily select an appliance function when the shaft control knob 504 is rotated.

The following camstack profile configuration description is only one example of how camstack profiles 436 may be arranged. For reference purposes, the camstack switch program blades 466, drive blades 474, and detent blade 484 are numbered from zero through fourteen starting from the switch program blade opposite the camstack hub extension. The switch program blades 466 are the even numbered camstack blades (0, 2, 4 . . . 14). The primary drive blade 476 is camstack blade number one, the secondary drive blade 478 is camstack blade number three, the delay drive blade 480 is number five, and the detent blade 484 is number thirteen.

The control shaft 438 includes a shaft base end 492, a shaft bore 494, a shaft displacement stop 496, a shaft hub bearing 498, a shaft control end 500, a shaft locking pin 502, and a shaft control knob 504. The control shaft 438 cooperates with the base control shaft mount 142, and camstack hub 434 to provide a rotational axis for the camstack 62. The control shaft 438 is axially displaceable to a first depressed position and a second extended position. The control shaft control knob 504 is used by an appliance operator to select an appliance cycle and operate the master switch 68 to turn the appliance 50 "on" and "off". The control shaft control knob 504 is also used by an appliance operator to actuate the optional quiet cycle selector 70. The control shaft 438, with the exception of the shaft locking pin 502 and shaft control knob 504, is preferably manufactured from a rigid plastic such as G.F. Nylon. The control shaft 438 is an option used on cam-operated timers with a master switch 68. If a control shaft 438 is not used in a cam-operated timer configuration, such as a dishwasher, the clutch 440 is also eliminated, and the camstack hub 434 is modified to cooperate with the base control shaft mount 142 to provide a bearing for rotation of the camstack 62. Also when a control shaft 438 is not used the shaft control knob 504 is coupled to the hub extension 452 by the hub extension grooves 454.

The shaft base end 492 includes a shaft base end assembly detail 506, a shaft circular ramp 508, shaft base bearings 510, and shaft twist lock ribs 512. The base end assembly detail 506 provides frictional surfaces for a manual or automated tool to rotate the control shaft 438 during assembly. The shaft circular ramp 508 includes a shaft lift ramp 514, a shaft retention latch 516, and a shaft lift bearing 518. The shaft circular ramp 508 is used to by an appliance operator to actuate the master switch 68 and quiet cycle selector 70. The shaft lift ramp 514 cooperates with the master switch 68 and quiet cycle selector 70 to convert axial displacement of the control shaft 438 to right angle displacement of master switch 68 and quiet cycle selector components operating parallel to the base platform 84. The lift ramp is formed at about a 45° angle and has a height of about 0.140 of an inch (0.356 cm). The outer diameter of the lift ramp is about 0.790 of an inch (2.007 cm).

The shaft retention latch 516 cooperates with master switch and quiet cycle selector components to temporarily lock the master switch 68 in the actuated "off" position and, if so equipped, temporarily lock the quiet cycle selector 70 in the actuated "select" position. The retention latch 516 is also ramp shaped and forms about a 150° angle which is also about a 30° reverse angle in relation to the shaft lift ramp 514. The shaft lift bearing 518 cooperates with master switch and quiet cycle selector components to provide a bearing for rotation between the control shaft 438 and the master switch 68 when in the actuated "off" position and quiet cycle selector 70 when in the actuated "select" position. The shaft lift bearing 518 is about 0.010 of an inch (0.025 cm) wide flat surface parallel to the axial length of the control shaft 438.

The shaft base bearings 510 include a shaft base end bearing 522, a shaft base internal bearing 524, a shaft base clutch bearing 526, and a shaft base clutch bearing ledge 528. The shaft base end bearing 522 cooperates with housing base 74 to provide a thrust bearing and indexing stop for the control shaft 438 when the control shaft 438 is indexed in toward the housing base 74. The shaft base internal bearing 524 cooperates with the housing base control shaft mount 142 to locate the control shaft in the housing base 74 and to provide a bearing for rotation of the control shaft 438. The shaft base clutch bearing 526 cooperates with the clutch 440 to provide a stable, low-friction bearing for rotation of the camstack 62 on the control shaft 438. The shaft base clutch bearing ledge 528 retains a clutch component during assembly of the control shaft 438 and clutch 440 to the camstack 62.

The shaft twist lock ribs 512 include shaft rib ends 530, a shaft rib interruption 532, and a shaft rib base edge 534. The twist-lock ribs 512 provide a structure to attach a clutch component to the control shaft 438. The twist-lock ribs 512 are about 0.045 of an inch (0.114 cm) wide and the rib interruption 532 is about 0.060 of an inch (0.152 cm) wide. The distance between the shaft rib base edge 534 and the shaft base clutch bearing 526 is about 0.070 of an inch (0.178 cm). The shaft rib ends 530 are chamfered at about 45° for easier installation of a clutch component. The shaft bore 494 extends through the entire length of the control shaft 438 and provide residential space for the shaft locking pin 502.

The shaft displacement stop 496 cooperates with the camstack hub displacement stop 462 to control the distance the control shaft 438 can be indexed out, moved to an extended position, by an appliance operator to place the master switch 68 in the unactuated "on" position and the quiet cycle selector 70 in the unactuated "operate" position. The displacement stop 496 provides a positive stop for the control shaft 438 at one of the strongest points in the camstack hub 434. The displacement stop prevents the control shaft base end 492 from contacting the clutch disk 560 to control displacement. The shaft hub bearing 498 cooperates with the camstack hub inner bearing 460 to provide a bearing for rotation of the camstack 62 around the control shaft 438 when the camstack 62 is driven for rotation by the camstack drive 64.

The shaft control end 500 includes shaft spring arms 535, shaft spring arm barbs 538, shaft spring arm ribs 540, and a shaft control end stop 542. The control end 500 typically extends through an appliance control console and provides structure to attach the control knob 504 onto the control shaft 438. The shaft spring arms 536 are rectangular in shape with a taper and located about 180° apart on the shaft control end 500. The spring arms 536 extend about 0.415 of an inch (1.054 cm) from the shaft control end stop 542. When a control knob is placed over the two spring arms 536 it boxes in the two spring arms to permit both clockwise and counter-clockwise rotation of the control knob by an operator. The shaft spring arm barbs 538 extend from the shaft spring arm ends to provide a structure to lock the control knob on the control shaft 438 to prevent the control knob from being pulled off the control shaft 438 when an appliance operator indexes the control shaft 438 out away from the appliance console. The control shaft end stop 542 provides a stable seat from the control knob on the control shaft 438 and the shaft end stop 542 also limits movement of the control knob toward the shaft base end 492.

The shaft locking pin 502 includes a shaft locking pin knob groove 544, a shaft locking pin stop 546, a shaft locking pin retention spring 548, and a shaft locking pin base end 550. The shaft locking pin 502 is inserted through the base hub opening 144 and into the camstack hub bore 458 to lock the control knob 504 onto the control shaft 438. The shaft locking pin knob groove 544 is designed to receive shaft spring arm ribs 540 to secure the shaft locking pin 502 in position. The shaft locking pin stop 546 extends from the shaft locking pin 502 to interfere with shaft bore 494 to limit movement of the shaft locking pin 502 toward the shaft control end 500. The shaft locking pin retention spring 548 also interferes with the housing base control shaft mount 142 to restrict movement of the shaft locking pin out of the shaft base end 492 prior to the control knob being installed on the shaft control end 500. The shaft locking pin base end 550 is a flattened surface that can be used as an assembly aid in automated or manual insertion of the shaft locking pin 502 in the shaft bore 494. The shaft locking pin base end 550 also permits gripping the shaft locking pin 502 for manual removal of the shaft locking pin 502 and control knob if the cam-operated timer 52 is removed from an appliance console.

The shaft control knob 504 includes shaft knob spring arm slot 552, shaft knob barb seats 554, and a shaft knob stop 556. The shaft knob spring arm slot 552 receives the shaft spring arms 536 to permit the control knob to rotate the control shaft 438 bi-directionally. The shaft knob barb seats 554 receive the shaft spring arm barbs 538 to prevent the control knob from being pulled off when the control shaft 438 is indexed out away from the base platform 84. The shaft knob stop 556 cooperates with the shaft control end stop 542 to prevent the knob 504 from sliding down the control shaft 438 when the control shaft 438 is indexed in toward the base platform 84. When the shaft locking pin 502 is installed the shaft spring arms 536 are prevented from flexing inward to maintain the shaft spring arm barbs 538 engaged with the shaft knob barb seats 554.

The clutch 440 includes a ratchet 558 and a clutch disk 560. The clutch couples the control shaft 438 to the camstack 62 when the control shaft 438 is indexed inwardly toward the base platform 84 to allow an appliance operator to select an appliance cycle. The clutch 440 decouples the control shaft 438 from the camstack 62 when the control shaft is indexed outwardly away from the base platform 84, so the appliance operator cannot rotate the camstack while the camstack 62 is operating the blade switches. The clutch 440 can be configured to permit bi-directional or uni-directional rotation of the camstack when control shaft 438 is indexed inwardly toward the base platform 84. When the clutch 440 is assembled on the control shaft 438 and attached to the camstack 62 inside the clutch cavity 446, the clutch 440 captures the control shaft 438 within the camstack hub 434 to make assembly of the camstack 62 in the housing base easier. The clutch 440 can be manufactured from a plastic such as acetal. The clutch 440 is an option used on cam-operated timers with a control shaft 438.

The clutch ratchet 558 includes a ratchet base 562, a ratchet bore 564, flexible fingers 566, a twist-lock latch 576, a twist lock stop 578, anti-tangle projections 580, and a ratchet assembly pin 582. The ratchet base 562 provide a stable platform to carry clutch ratchet component and defines the ratchet bore 564. The ratchet bore 564 is sized to permit the ratchet 558 to be installed over the control shaft control end 500 and locate on the shaft base clutch bearing ledge 528. The flexible fingers 566 include first direction ratchet springs 568, second direction ratchet springs 570, first direction ratchet teeth 572, and second direction ratchet teeth 574. The first direction ratchet springs 568 and second direction ratchet springs 570 are cantilever springs that extend from the ratchet base 562. The first direction ratchet springs 568 and second direction ratchet springs 570 can flex to ease engagement of the ratchet 558 with the clutch disk 560 and can flex to permit the ratchet 558 to disengage from the clutch disk 560. The first direction ratchet teeth 572 are carried on the first direction ratchet spring 568 and the second direction ratchet teeth 574 are carried on the second direction ratchet spring 570. Both the first direction ratchet teeth 572 and second direction ratchet teeth 574 are ramped shaped to facilitate engagement and disengagement from the clutch disk 560.

The twist-lock latch 576 and twist-lock stop 578 cooperate with the control shaft twist lock ribs 512 to secure the ratchet 558 onto the control shaft 438. More specifically the twist-lock latch 576 engages the shaft rib interruption 532 and the twist-lock stop 578 engages the shaft rib edge 534 to secure the ratchet base 562 on the shaft base clutch bearing ledge 528. The twist-lock latch 576 is a cantilever spring that compresses when rotated to engage the control shaft twist lock ribs 512 and expands when the twist-lock latch 576 engages a shaft rib interruption 532. The twist-lock latch 576 has a ramped surface at about 45° that extends from the ratchet base 562 about 0.025 of an inch (0.064 cm).

The anti-tangle projections 580 extend from the ratchet base 562 near the first direction ratchet teeth 572 and second direction ratchet teeth 574 to reduce the opportunity for more than one ratchet 558, for instance in a vibratory feeder bowl (not shown), to become tangled together and interfere with assembly. The ratchet assembly pin 582 is asymmetric to the ratchet 558 and extends from the ratchet base 562 to facilitate use of automated assembly equipment such as vibratory feeder bowls and pick-and-place machines (not shown).

The ratchet springs 568, 570 can be either unidirectional ratchet springs or bi-directional ratchet springs. The unidirectional ratchet springs include first direction ratchet teeth 572. The bi-directional ratchet springs include both first direction ratchet teeth 572 and second direction ratchet teeth 574. When the control shaft 438 is rotated in a direction to cause the clutch 440 to slip, the ratchet teeth disengage from the clutch 440 and then the ratchet teeth are biased to re-engage with the clutch 440. The first direction ratchet teeth 572 and the second direction ratchet teeth 574 are spaced so that all first direction ratchet teeth 572 and all second direction ratchet teeth 574 engage the clutch disk 560 simultaneously. Both the unidirectional ratchet teeth and the bi-directional ratchet teeth have ratchet ramps of about a 45° ramp that extends from the surface of the clutch ratchet 558 about 0.048 of an inch (0.122 cm). With unidirectional ratchet teeth, rotation toward the ratchet ramps causes slippage.

The clutch disk 560 has a clutch control shaft bore 584, a clutch control shaft bearing 586, clutch slots 588, clutch mounting notches 590, and clutch assembly pins 592. The clutch disk 560 cooperates with the clutch ratchet 558 to engage or disengage the control shaft 438 from the camstack. The clutch disk 560 also provides a bearing for the camstack hub 434 to rotate on the control shaft 438. The clutch control shaft bore 584 is about 0.574 of an inch in diameter (1.458 cm) and has a 45° chamfer for a depth of about 0.030 of an inch (0.076 cm) and is sized to slide the control shaft 438 through the clutch shaft bore 584 and stop on the circular ramp ledge 520. The clutch control shaft bearing 586 cooperates with the control shaft base external bearing to provide for rotation of the camstack hub 434 on the control shaft 438.

The clutch slots 588 are spaced so that when an operator indexes the control shaft 438 to select an appliance function the clutch ratchet teeth engage the engagement bores to permit rotation of the camstack 62. The clutch slots 588 are sized larger than the clutch ratchet teeth for less interference when the clutch ratchet teeth engage the clutch slots 588. The clutch slots 588 have an outer diameter of about 1.000 inch (2.540 cm) and an inner diameter of about 0.750 of an inch (1.905 cm). Clutch slots 588 are positioned at about 12° intervals around the clutch disk 560. The clutch disk assembly pins 592 are an assembly aid that permits a clutch disk 560 to be aligned in a vibratory feeder bowl and track assembly. The mounting notches 590 engage the clutch cavity clutch fasteners 450 to prevent the clutch disk 560 from rotating independently of the camstack 62. The clutch disk 560 rests on the camstack clutch shelf 448 and two or more of the clutch fasteners 450 are heat staked to secure the clutch disk 560 to the camstack hub 434.

The camstack 62 is assembled as follows. First, the clutch disk 560 is fitted over the control shaft 438 and is retained by the control shaft. Second the clutch ratchet 558 is also fitted over the control shaft 438 and is attached to the control shaft with a twist-lock fitting. The control shaft base end details 506 can be used by automated equipment to rotate the control shaft 438 to install the clutch ratchet 558. Once the ratchet 558 is attached to the control shaft 438, the clutch disk 560 is captured on the control shaft. Third, the control shaft with retained clutch disk 560 and attached ratchet 558 are installed in the camstack 62. During installation of the clutch disk 560 into the camstack 62, the clutch disk mounting notches 590 align with camstack tabs 450 to seat the clutch disk 560 into the camstack 62. Two or more of the camstack tabs 450 are heat staked to secure the clutch disk 560 in the camstack. When the camstack 62 is seated on the control shaft mount 142, the base camstack supports 146 contact the clutch disk 560 to position the camstack 62 about 0.100 of an inch (0.254 cm) above the base platform 84 to prevent the camstack 62 from interfering with timer components 56. The camstack 62 is assembled before installation into the housing base 74 by assembling camstack components on a straight axis that is parallel to the camstack hub 434 using automated assembly equipment which is discussed in a later section entitled "Assembly Of The Cam-Operated Timer".

The cycle selector detent 442 is an option for the cam-operated timer 52 that provides a tactile feel to the appliance operated during cycle selection. The cycle selector detent 442 includes a detent follower 598 and detent spring 596. The detent follower 598 engages the detent blade 484 to transmit tactile feel to the appliance operator during cycle selection. The detent spring 596 biases the detent follower 598 toward the camstack detent blade 484. The cycle selector detent 442 is carried in the first side cover detent follower channel 198 with the first side cover detent spring pilot 202 engaging the detent spring 596, and the detent follower 598 extending through the detent follower bore 200 to engage the camstack detent blade 484. The cycle selector detent 442 is installed on a vertical axis into the first side cover detent follower channel 198 as one of the last timer components 56 installed typically after the blade switches 66 have been installed. The cycle selector detent 442 engages the camstack detent blade 484 that has a profile that can be varied to correspond with appliance cycle. The detent follower 598 can be configured for unidirectional operation or bi-directional operation. When an operator rotates the control shaft 438 to select an appliance function, the operator receives either tactile or auditory feedback or both from the cam-operated timer 52, so the operator can more easily select an appliance function.

The camstack 62 can be configured without a control shaft 438 and clutch 440. The hub extension 452 would have the hub control dial positioner 456 configured to carry a control knob 504. In this configuration the clutch cavity 446 would be eliminated and the a hub base bearing formed to engage the base control shaft mount 142 to provide an axis for rotation of the camstack 62. In cam-operated timer configurations without the optional master switch 68, the camstack profiles 436 can be configured to break all electrical contacts 744 of the blade switches 66 to turn "off" an appliance 50 such as a dishwasher.

Camstack Drive

Referring to FIGS. 6, 12*a*–13*d*, 22, and 23 the camstack drive 64 includes a main drive 602 and a delay drive 604. The main drive 602 includes a drive cam 606, a primary drive pawl 608, a secondary drive pawl 610, and a drive spring 612. The motor 58 transmits torque through the output gear 396 to the drive cam 606 which in turn operates the primary drive pawl 608 and secondary drive pawl 610 to rotate the camstack 62. The drive cam 606, primary drive pawl 608, and secondary drive pawl 610 are preferably manufactured from a rigid plastic with good wear characteristics such as glass-filled nylon. Assembly of the camstack drive 64 is described in a subsequent section titled "Assembly Of The Cam-Operated Timer".

The drive cam 606 includes a drive cam base 614, a subinterval cam 616, a separation shelf 618, a drive engagement cam 620, a drive lug 622, a delay drive lug 624, a delay drive bearing 626, a secondary drive cam 628, and a drive cam top 630. The drive cam 606 is carried for rotation on the base drive cam mount 102 and driven for rotation by the output gear 396 connected to the drive cam top 630. The drive cam 606 operates the camstack main drive 602 as the primary means to drive the camstack for rotation, and the delay drive 604 as a secondary means to drive the camstack for rotation when slower rotation of the camstack is desired. The drive cam 606 through the subinterval cam 616 also operates the subinterval switch 72 to operate at least one blade switch 66 independent of the camstack 62.

The drive cam base 614 includes a drive base bearing 632, a drive interior key 634, a drive thrust bearing 636. The drive base bearing 632 fits into the base drive cam mount 102 to provide for rotation of the drive cam 606. The drive base bearing 632 has an interior key 634 to permit alignment of the drive cam 606 during installation. An additional feature of the key 634 is to permit a service person to determine if the drive cam 606 is rotating since an operating timer may be so quiet that it could be difficult to determine if the motor 58 is operating the drive cam 606. The drive thrust bearing 636 engages the side of the drive cam mount 102 nearest the first open side 80 to axially align the drive cam 606.

The subinterval cam 616 is engaged by the subinterval switch 72 to operate at least one blade switch 66 independently of the camstack 62. The separation shelf 618 assists in capturing the subinterval switch 72 in the housing base 74. The subinterval cam 616 is sequenced with the drive stroke to engage and disengage a switch from the camstack 62 unless masked.

The primary drive engagement cam 620 functions to control engagement of the drive lug 622 with the drive lug track 640. The drive lug 622 cooperates with the drive lug track 640 to translate the drive cam's rotary motion to substantially linear motion. The primary drive engagement cam 620 engages the engagement track 638 and functions to disengage the drive lug 622 from the drive lug track 640 during predetermined periods. The drive lug 622 is hook shaped and engages the drive lug track 640 to convert the rotary movement of the drive lug 622 to a lift and linear pulling motion of the primary drive pawl 608. The delay drive lug 624, also know as a delay drive cam, cooperates with the delay drive 604 to convert the drive cam's rotary motion to a substantially linear motion to operate the delay drive 604.

The secondary drive cam 628 engages the secondary drive track 654 to convert the rotary movement of the secondary drive cam 628 into a substantially linear motion. The secondary drive pawl 610 engages the camstack secondary drive blade 478 to prevent the primary drive pawl 608 from reversing camstack rotation during the primary drive pawl's return stroke. The secondary drive pawl 610 is imparted with about a 0.006 inch (0.015 cm) linear tangential pulling motion that advances the camstack slightly during the primary drive pawl's return stroke to improve the primary drive pawl's engagement of the primary drive blade 476 at the end of the primary drive pawl's return stroke.

The drive cam top 630 includes a disconnect drive bearing 631, drive splines 633, and drive spline tips 635. The drive disconnect bearing 631 is a sleeve bearing that cooperates with the output gear disconnect bearing 404 to disconnect the drive cam 606 from the output gear 396 during cam-operated timer testing before the spline connector 334 is installed. The drive splines 633 are engaged by the spline connector 334 to couple the drive cam 606 to the output gear 396. The drive spline tips 635 are tapered at about a 45° on each side of the splines to a point to permit easier installation of the spline connector 334. By having both the drive cam splines tips 635 tapered and the spline connector internal connector spline tips 422 tapered, flat surfaces are eliminated that could butt against one another to complicate installation. Once the spline connector 334 is installed, the drive splines 633 are locked with the output gear splines 412 to connect the output gear 396 to the drive cam 606 for operation of the cam-operated timer 52.

The primary drive pawl 608 has an engagement track 638, a drive lug track 640, a first drive tip retainer 642, a second drive tip retainer 644, a primary drive tip 646 a drive foot 648, and a torsion spring shelf 650. The engagement track 638 cooperates with the drive engagement cam 620 to control engagement of the drive lug 622 with the drive lug track 640. The drive lug track 640 cooperates with the drive lug 622 to translate the drive cam's rotary motion into linear movement of the primary drive pawl 608. The primary drive tip 646 engages the camstack primary drive blade 476 at predetermined intervals with a tangential pulling movement to rotate the camstack 62. Using a pulling motion reduces flexing of the primary drive pawl 608 which reduces the opportunity for the primary drive pawl 608 to cam-out by losing engagement with the primary drive blade 476. Camstack advance can be varied from about 4.5° to 7.5° of camstack rotation depending upon drive blade teeth 482 spacing. The first drive tip retainer 642 and second drive tip retainer 644 extend below the primary drive tip 646 and selectively engage the primary drive blade 476 to assist in keeping the primary drive pawl 608 in proper alignment with the camstack 62 during operation and during functioning of the quiet cycle selector 70. The primary drive foot 648 is used to properly position the primary drive pawl 608 during assembly and to provide means for retracting the primary drive pawl 608 for quiet cycle selection.

The secondary drive pawl 610 has spacing legs 652, a secondary drive track 654, a third drive tip retainer 656, a fourth drive tip retainer 658, a secondary drive tip 660, a secondary drive foot 662, and a drive spring contacter 664. The spacing legs 652 ride on the primary drive pawl 608 to properly position the secondary drive pawl 610. The secondary drive track 654 has about a 0.003 of an inch (0.008 cm) offset eccentric. The secondary drive tip 660 engages the secondary drive blade 478 with a tangential pulling movement to prevent the primary drive pawl 608 from reverse rotating the camstack during the primary drive pawl's return stroke and to slightly rotate the camstack 62 during the primary drive pawl's return stroke. Using a pulling motion reduces flexing of the secondary drive pawl 610 which reduces the opportunity for the secondary drive pawl 610 to cam-out by losing engagement with the secondary drive blade 478. The third drive tip retainer 656 and the fourth drive tip retainer 658 function to keep the secondary drive pawl 610 properly aligned on the secondary drive blade 478. The secondary drive foot 662 assists in aligning the secondary drive pawl 610 during installation and also permits retraction of the secondary drive pawl 610 by the quiet cycle selector 70. The drive spring contacter 664 off-sets the drive spring 612 to reduce interference between the drive spring 612 and the primary drive pawl 608.

The drive spring 612 is a torsion spring and has a coil 666, a first spring end 668, and a second spring end 670. The drive spring 612 is installed after the camstack 62 has been installed on the drive spring mount base detail 108 with the first spring end 668 contacting the primary drive pawl spring ledge 650 and the second spring end 670 contacting the secondary drive pawl foot 662. The drive spring 612 provides about a 0.200 pound (0.090 Kg) biasing force to the primary drive pawl 608 and the secondary drive pawl 610. The drive spring 612 is a coil spring rather than a leaf spring because a coil spring has advantages including providing a more constant force and each end of the coil spring can perform a biasing function.

The delay drive 604 includes a delay drive wheel 672, a delay camstack pawl 674, a delay ratchet pawl 676, a delay no-back pawl 678, and a masking lever 680. The delay drive 604 is a second optional pawl drive system that is programmed to operate at predetermined intervals in lieu of the camstack drive 64 to greatly reduce regular camstack rotational speed, in the range of 1,500 to 2,200 percent, for functions such as in-cycle delay and delay-to-start. By reducing camstack rotational speed during delay functions, switch program blade space can be conserved. The delay drive 604 is activated and inactivated by the masking lever 680 according to a predetermined program carried on the camstack delay profile 488. The delay drive 604 is synchronized with the camstack drive 64 so when the delay drive 604 is activated the angular location of the delay ratchet pawl 676 is known to permit more precise control of the delay drive 604 in relation to the camstack drive 64. The delay drive could also be accomplished with reduction gears.

The delay drive wheel 672 has a delay wheel bore 682, a delay ratchet 684, a delay pawl tip retainer 686, a delay cam bearing 687, and a delay drive lug 688. The delay drive wheel bore 682 has a delay wheel first bearing 683, and a delay wheel second bearing 685. When the delay drive wheel bore 682 is installed on the housing base delay wheel mount 122, the delay wheel first bearing 683 and the delay wheel second bearing 685 cooperate with the housing base delay wheel mount 122 to provide for more stabilized rotation than can typically be provided with a single bearing surface. The delay ratchet 684 is engaged by the delay ratchet pawl 676 and delay no-back pawl 678 to incrementally rotate the delay drive wheel 672. The delay pawl tip retainer 686 is a shelf to prevent the delay ratchet pawl 676 and delay no-back pawl 678 from moving out of alignment with the ratchet 684 toward the first side cover 76. The delay cam bearing 687 engages the delay camstack pawl 674 to properly align the delay camstack pawl 674 in relation to the delay drive lug 688. The delay drive lug 688 engages the delay camstack pawl 674 to reciprocate the delay camstack pawl 674 in predetermined fashion to engage the camstack delay drive blade 480.

The delay camstack pawl 674 has a delay camstack pawl alignment track 690, a delay camstack pawl lug track 692, a delay camstack pawl tip 694, a delay camstack pawl tip retainer 696, a delay camstack pawl spring post 698, a delay camstack pawl foot 700, delay camstack pawl supports 702, and a delay camstack pawl spring 704. The delay camstack pawl 674 is operated by the delay wheel 672 to engage the camstack delay blade 480 to drive the camstack from rotation during predetermined periods of delay. During quiet cycle selection, the delay camstack pawl 674 is engaged by quiet cycle selector components to disengage the delay camstack pawl 674 from the camstack delay blade 480 to reduce noise generated by the delay camstack pawl 674 when the camstack 62 is manually rotated.

The delay camstack pawl alignment track 690 engages the delay cam bearing 687 to properly align the delay camstack pawl lug track 692 in relation to the delay drive lug 688. The delay camstack pawl lug track 692 is engaged by the delay drive lug 688 to convert the delay drive wheel rotary motion to a substantially linear motion of the delay camstack drive pawl 674. The delay drive lug 688 cooperates with the delay camstack pawl lug track 692 to drive the camstack 62 during about 90° of delay wheel rotation and retract the delay camstack pawl 674 during about 90° of rotation. Preceding both the advance and retraction there is a 90° dwell. When the camstack delay operates to drive the camstack 62 for rotation, the secondary drive pawl 610 continues to operate to prevent the camstack 62 from reverse rotation during the time period when the camstack delay drive 604 is operating.

The delay camstack pawl tip 694 engages the camstack delay blade 480 to drive the camstack 62 for rotation at predetermined intervals. The delay camstack pawl tip retainers 696 assist in maintaining proper delay camstack pawl tip 694 alignment in relation to the camstack delay blade 480. The delay camstack pawl spring post 698 provides a means for attaching the delay camstack pawl spring 704 between the delay camstack pawl 674 and the motor pedestal 134 to bias the delay camstack drive pawl 674 toward the camstack 62 for contact with the delay drive blade 480. The delay camstack pawl spring 704 is an extension spring with delay camstack pawl spring loops 706 that are installed with the delay camstack pawl spring loops 706 oriented toward the housing base platform 84. One of the delay camstack pawl spring loops 706 is connected to the motor pedestal 134 and located by motor pedestal ribs 136 and the other delay camstack pawl spring loop 706 is connected to the delay camstack pawl spring post 698 to bias the delay camstack pawl 674 toward the camstack delay drive blade 480.

The delay camstack pawl foot 700 is used as a contact point with quiet cycle selector components to lift the delay camstack pawl 674 away from the camstack delay drive blade 480. The delay camstack pawl supports 702 contact the motor stator cup 256 to serve as a thrust bearing to maintain the delay camstack pawl 674 in proper alignment with the delay wheel 672 and to capture both the delay camstack pawl 674 and delay wheel 672 in the housing base 74 once the motor 58 is installed.

The delay ratchet pawl 676 has a delay ratchet pawl track 708, delay ratchet pawl track extensions 710, a delay ratchet pawl tip 712, a delay ratchet pawl tip retainer 714, a delay ratchet pawl foot 716, and a delay ratchet pawl spring post 718. The delay ratchet pawl 676 is driven by the drive cam 606 to engage the delay wheel ratchet 684 to rotate the delay wheel 672. The delay ratchet pawl track 708 engages the drive cam delay drive lug 624 to convert the drive cam rotary motion to reciprocate the delay ratchet pawl 676 for engagement with the delay wheel ratchet 684. The delay ratchet pawl tip 712 engages the delay ratchet 684 to incrementally rotate the delay drive wheel 672. The delay ratchet pawl tip retainer 714 cooperates between the delay wheel bearing 687 and the delay drive wheel 672 to prevent the delay ratchet pawl 676 from moving toward the first open side 80 and out of alignment with delay ratchet 684. The delay ratchet pawl foot 716 cooperates with the housing base platform 84 to prevent the delay ratchet pawl 676 from moving toward the housing base platform 84 and out of alignment with the delay ratchet 684. The delay ratchet pawl foot 716 also is contacted by the masking lever 680 to move the delay ratchet pawl 676 away from the delay ratchet 684 during predetermined periods when the delay drive 604 is to be inactivated. The delay ratchet pawl spring 720 is an extension spring that has one end connected to the delay ratchet pawl spring post 718 and its other end connected to the base delay spring support post 116 to bias the delay ratchet pawl tip 712 toward the delay ratchet 684.

The delay no-back pawl 678 has a delay no-back pivot 724, a delay no-back tip 726, a delay no-back spring post 728, and a delay no-back spring 730. The delay no-back pawl 678 functions to prevent the delay drive wheel 672 from reversing rotation when driven by the delay ratchet pawl 676, and the delay no-back pawl 678 functions to keep the delay drive wheel 672 stationary when the delay ratchet pawl 676 is lifted away from the delay ratchet 684 when the delay is inactivated. The delay no-back pawl 724 is carried on the drive cam delay drive bearing 626. The delay no-back tip 726 engages the delay ratchet 684. The delay no-back spring 730 is a compression spring with one end carried on delay no-back spring post 728 and the other end carried on the base delay no-back spring seat 118 to bias the delay no-back pawl 678 toward the ratchet wheel 684.

The delay masking lever 680 has a masking pivot bore 732, masking bearings 734, a masking follower 736, and a masking lifter 738. The delay masking lever 680 operates in accordance with a predetermined program encoded on the camstack delay profile 488 to activate and inactivate the delay drive 604. The masking lever 680 is mounted in the housing base 74 by placing the masking pivot bore 732 over the base masking lever pivot pin 114, and the masking bearing 734 contacting the housing base platform 84 to reduce friction when the masking lever 680 is operated. The masking follower 736 follows the camstack delay profile 488 to move the masking lever 680 according to a predetermined program. The masking lifter 738 contacts the delay ratchet pawl foot 716 in response the camstack delay profile 488 to move the delay ratchet pawl tip 712 away from the delay ratchet 684 to inactivate the delay drive 604. By using the masking lever 680 to activate and inactivate the delay drive 604, a portion of a delay increment can be selected that is typically in the range from 95%–25% for a full delay increment.

Blade Switches

Figure 9:
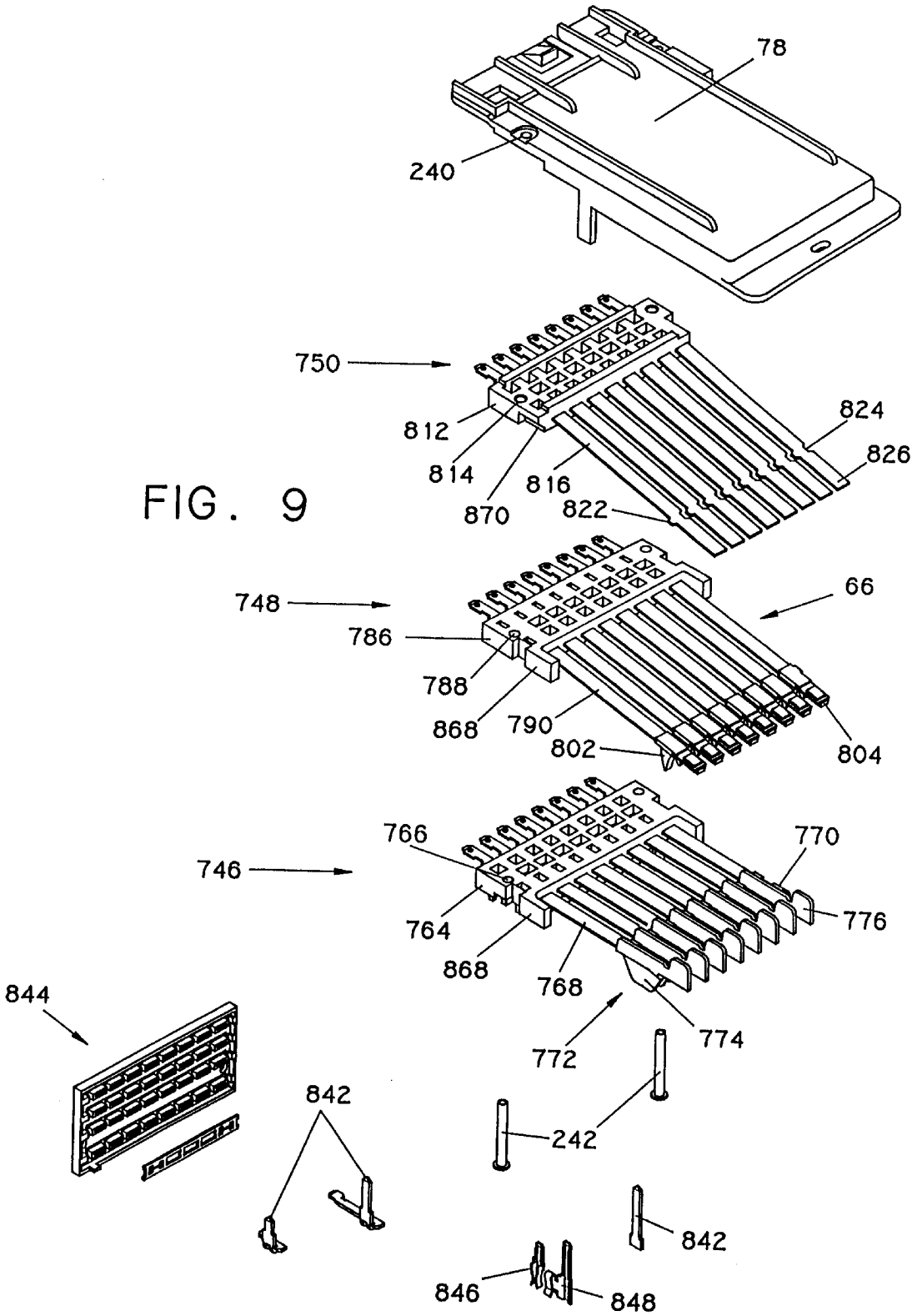
FIG. 9 shows an exploded view of blade switch and the second side cover.
Figure 10A:
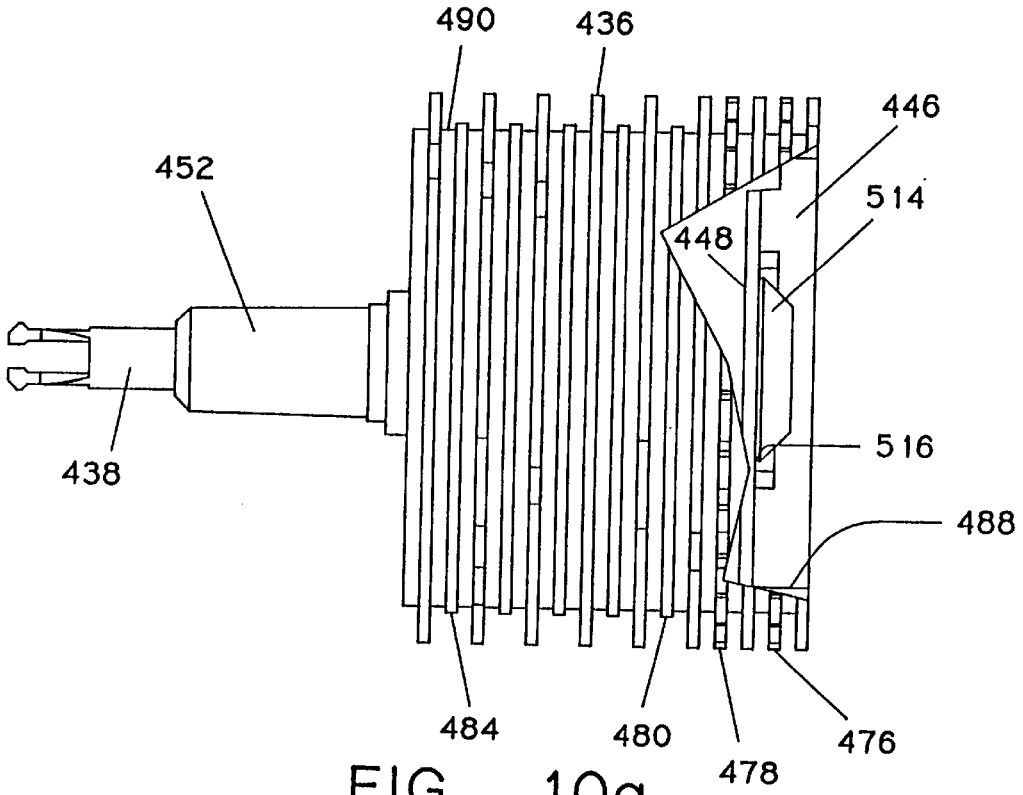
FIG. 10*a* shows a side view of the camstack.
Figure 10B:
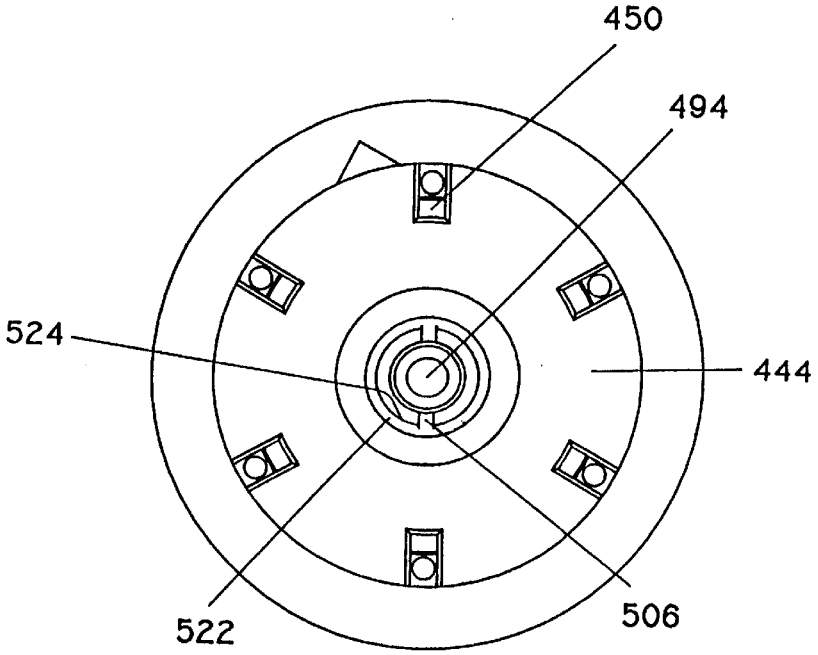
FIG. 10*b* shows a bottom view of the camstack.
Figure 12A:
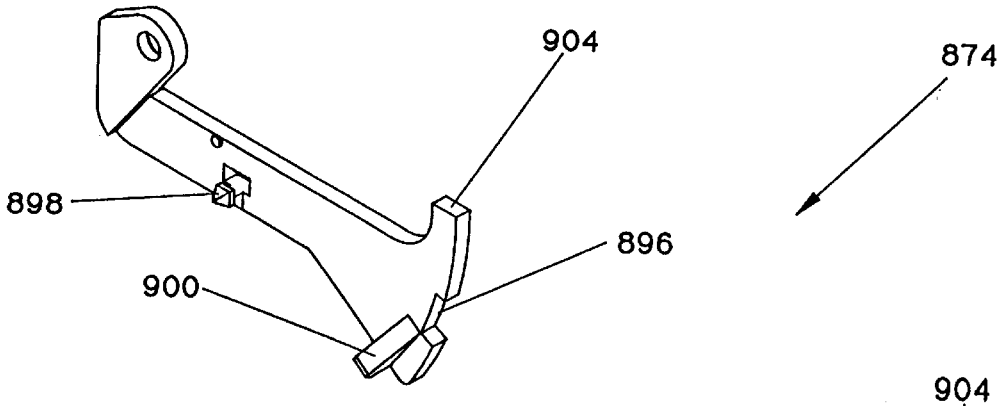
FIGS. 12*a–d* show a switch lifter.
Figure 12B:
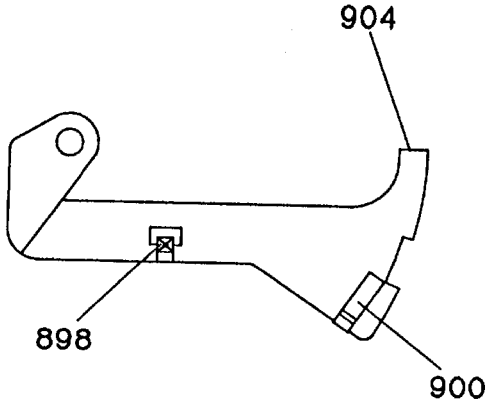
Figure 12C:
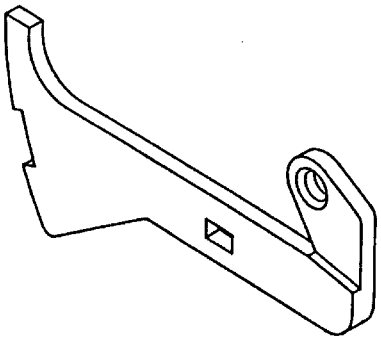
Figure 12D:
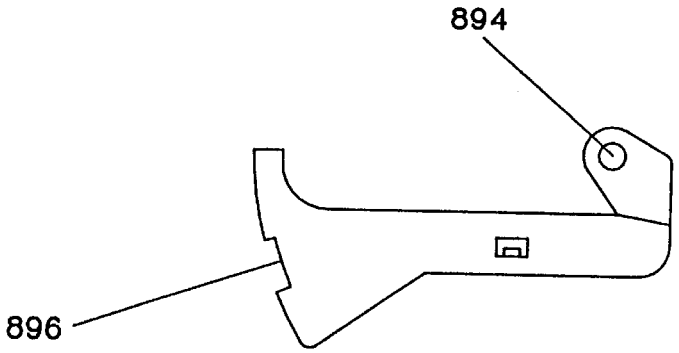
Figure 13A:
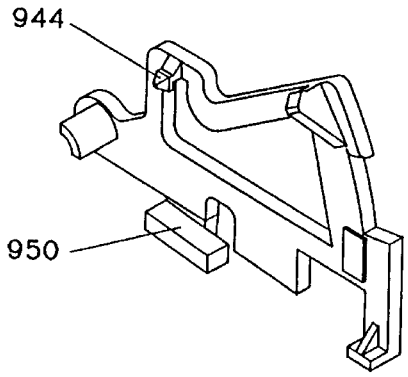
FIGS. 13*a–d* show a pawl lifter.
Figure 13B:
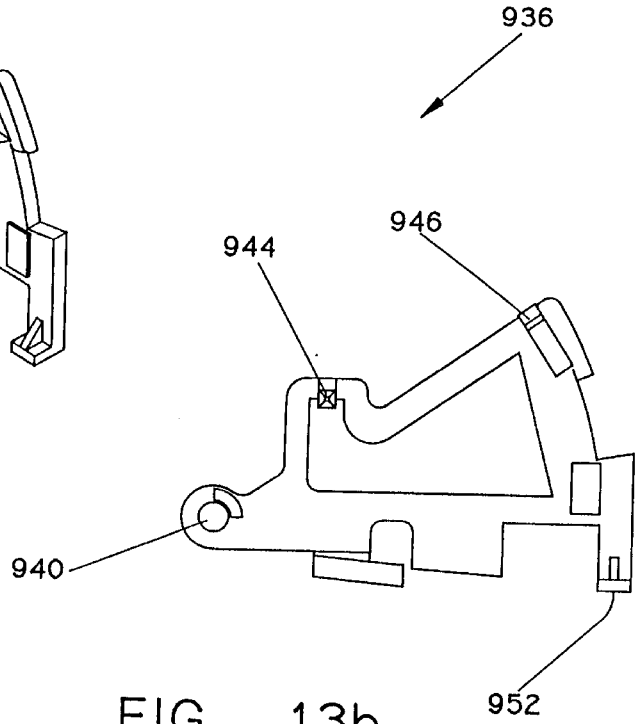
Figure 13C:
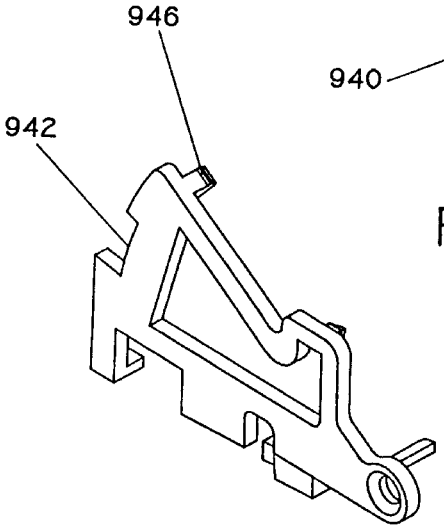
Figure 13D:
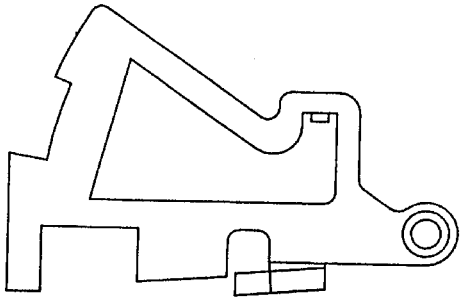
Figure 14A:
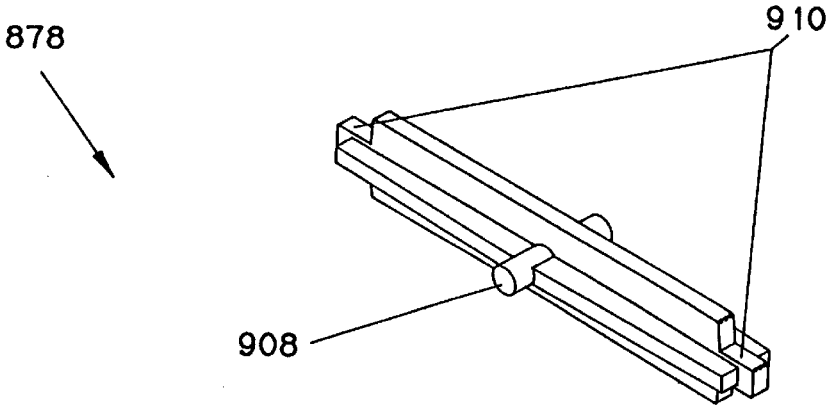
FIGS. 14*a–c* show a rocker.
Figure 14B:
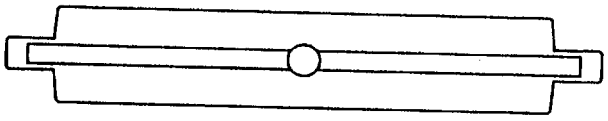
Figure 14C:
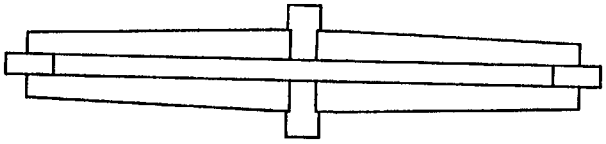
Figure 15A:
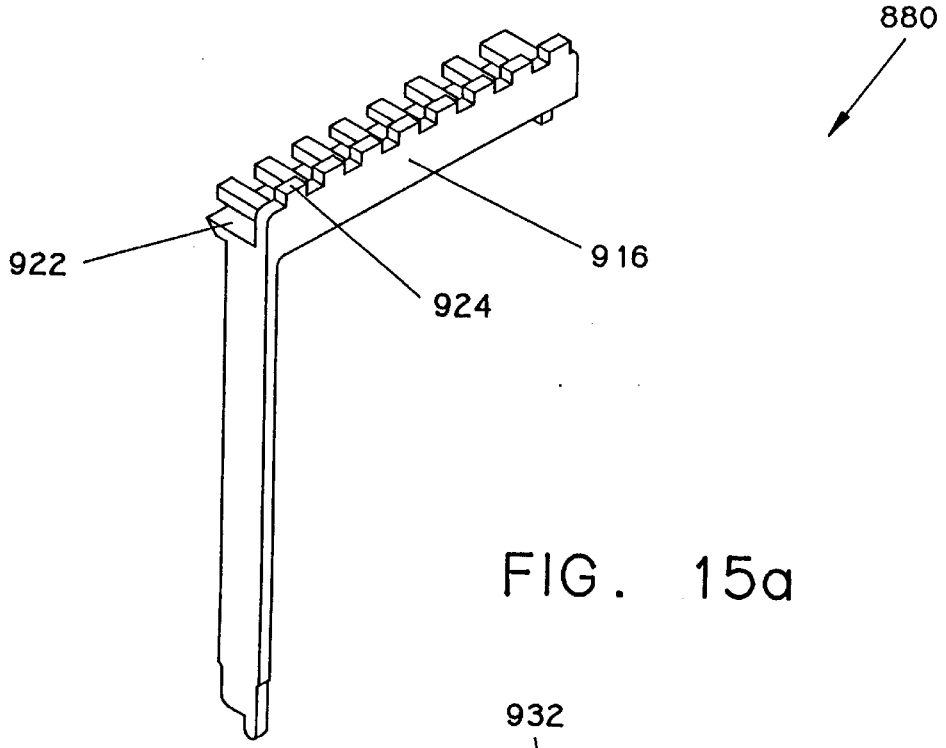
FIGS. 15*a–b* show a lift bar.
Figure 15B:
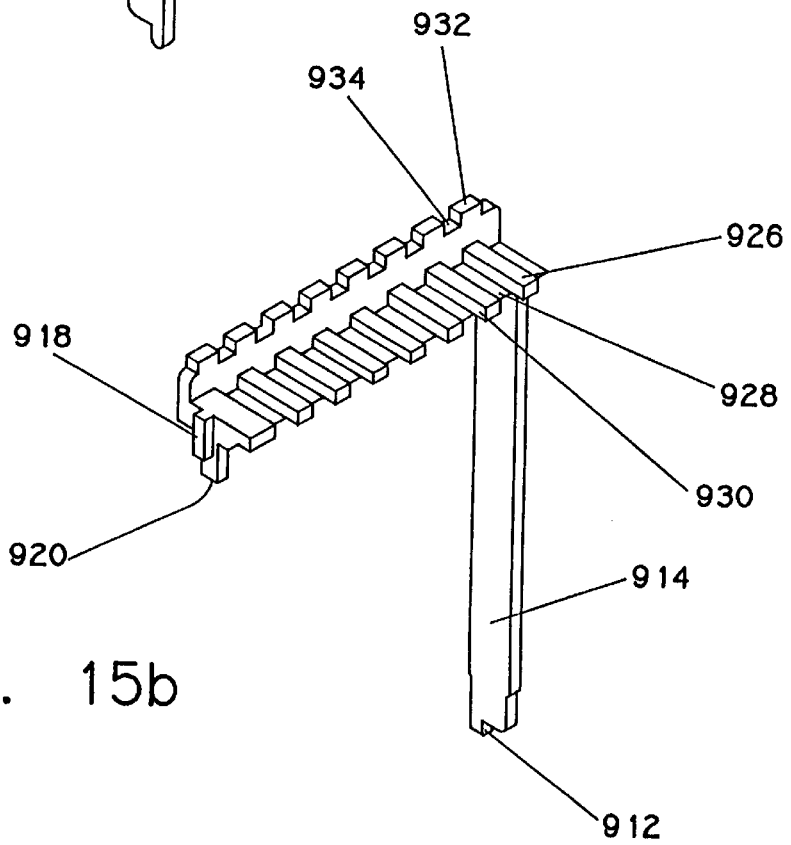
Figure 16:
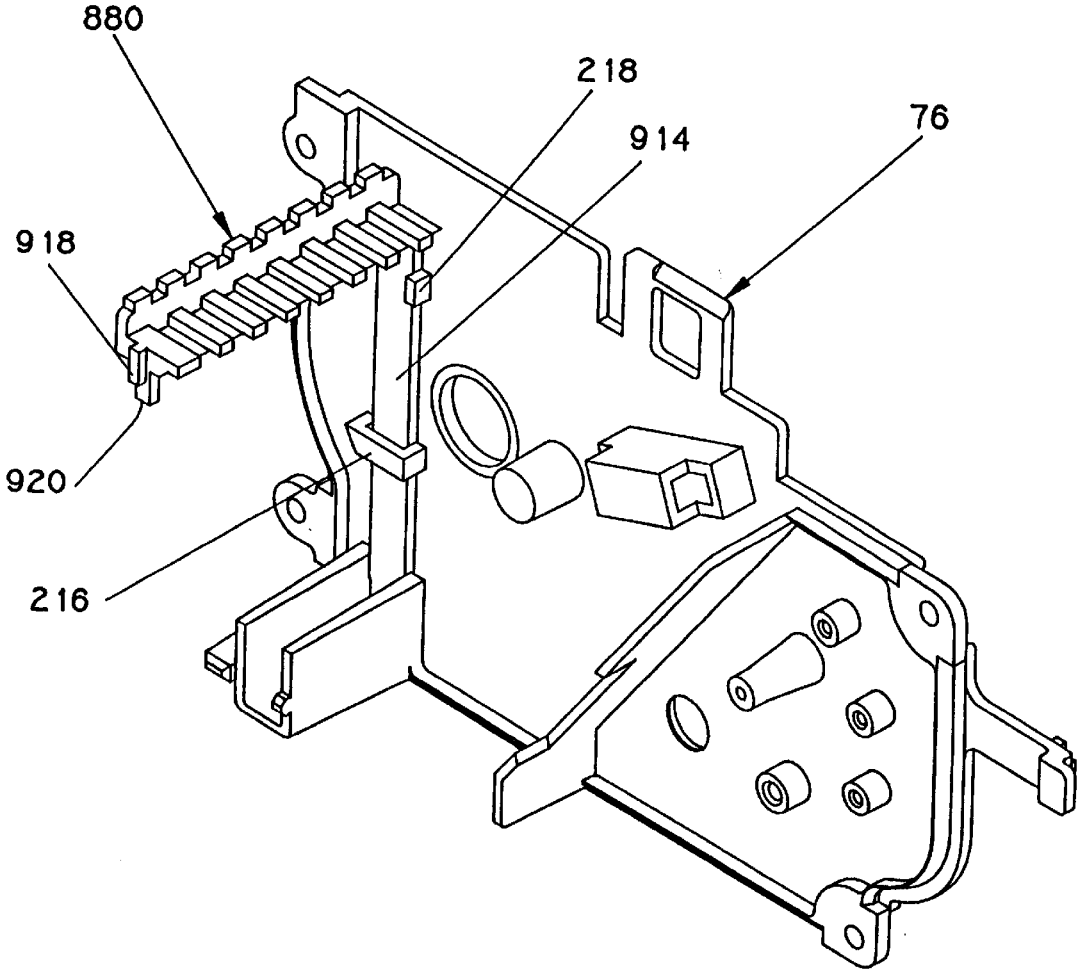
FIG. 16 shows the lift bar installed in the first side cover.
Figure 21A:
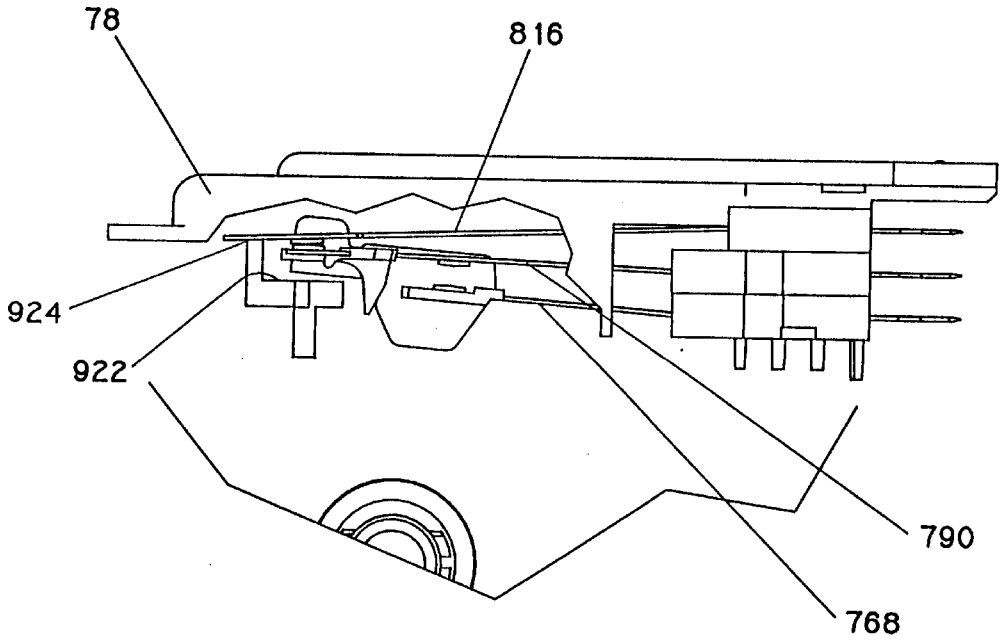
FIGS. 21*a–b* show the lift bar operating the blade switches.
Figure 21B:
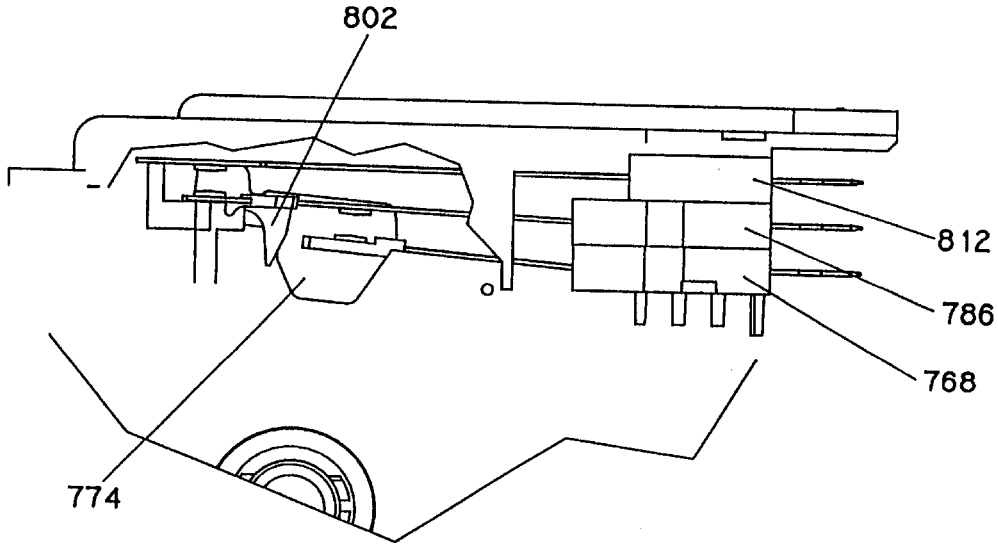
Figure 22:
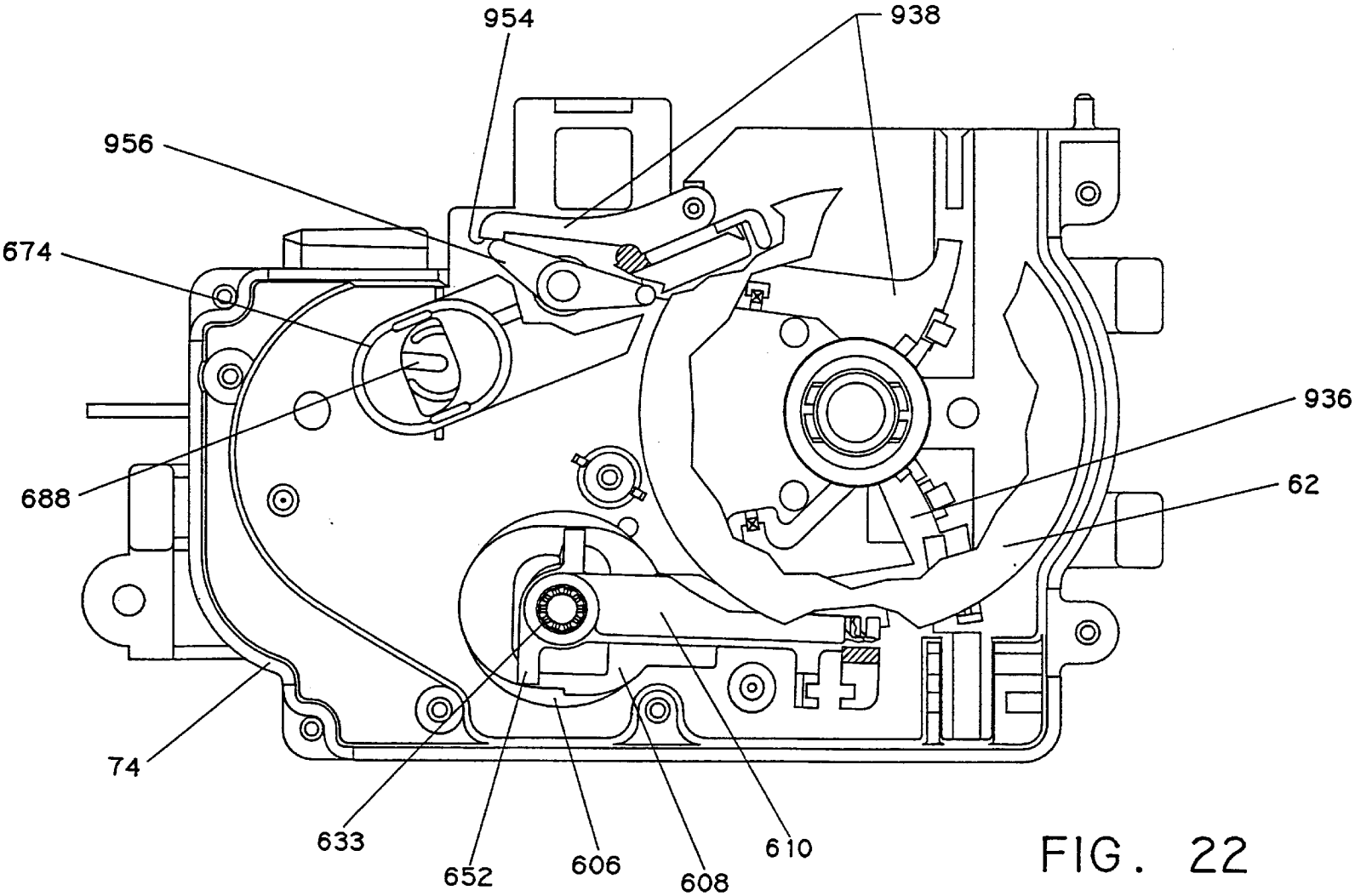
FIG. 22 shows the pawl lifter and a delay lifter with the camstack drive engaging the camstack; and, FIG. 23 shows the pawl lifter and delay lifter with the quiet cycle selector actuated to disengage the camstack drive from the camstack.
Figure 23:
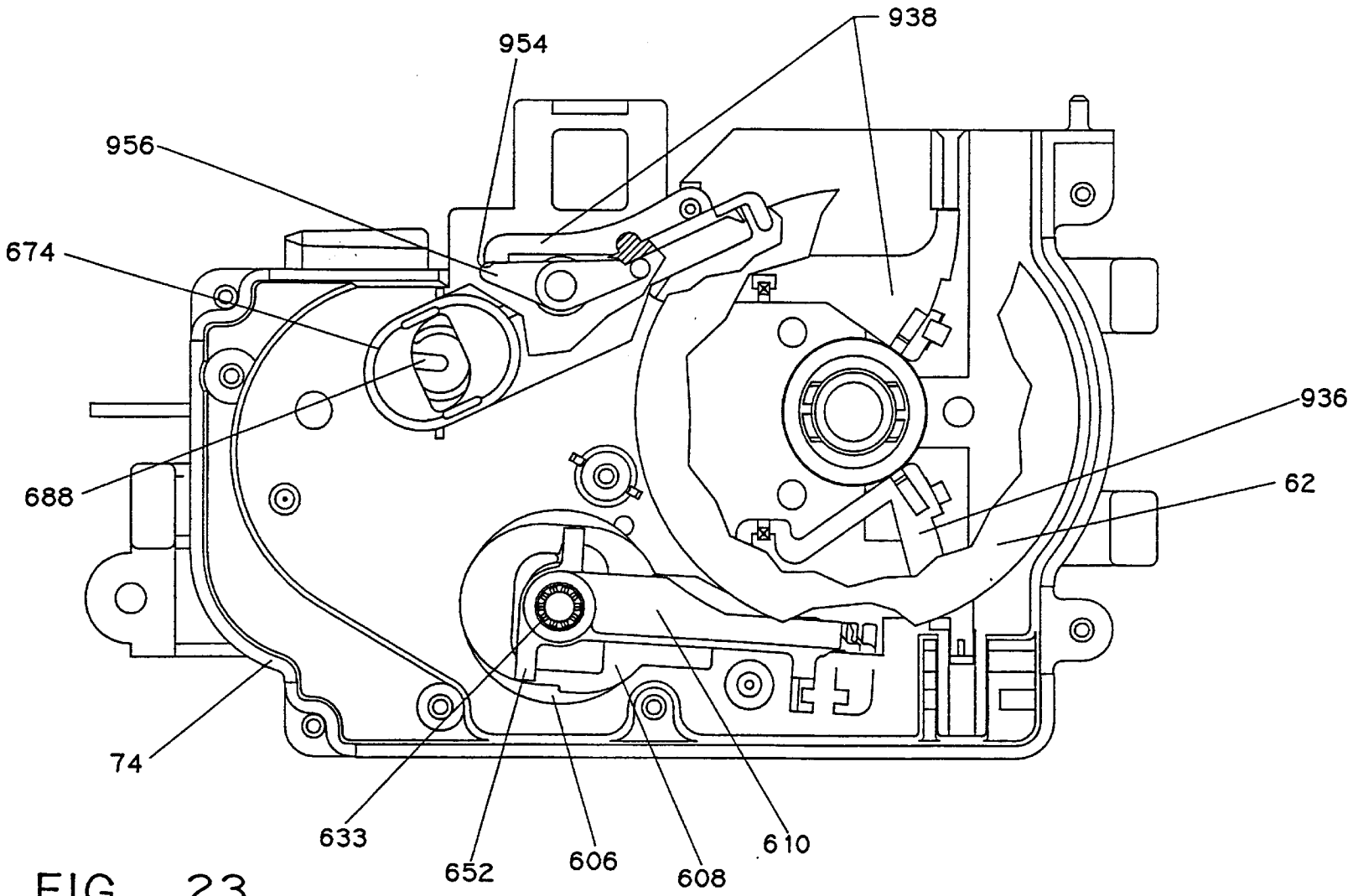

Referring to FIGS. 9, and 21*a–b*, the blade switches 66 include a terminal end 740, a contact end 742, electrical contacts 744, lower contact wafer assembly 746, cam follower wafer assembly 748, upper contact wafer assembly 750, blade switch terminals 752, motor terminal connectors 754, blade switch fasteners 756, blade switch bussing 758, an appliance motor start switch 760, and an appliance motor run switch 762. The blade switches 66 are carried by the second side cover 78 and are placed in working relationship to the camstack program blades 466 to control appliance electrical circuits when the second side cover 78 is attached to the housing 54. The plastic molded components in the blade switches 66 are molded from a plastic such as a P.B.T. polyester 15% G.F./20% M.F. unless otherwise noted. The terminal end 740 is fixed and carried by the housing 54. The contact end 742 is moveable and carries the electrical contacts 744.

The lower contact wafer assembly 746 includes a lower contact wafer 764, lower contact wafer bores 766, lower switch blades 768, lower blade electrical contacts 770, and blade spring supports 772. The lower contact wafer 764 provides a housing for the lower switch blades 768 and is a plastic such as a P.B.T. polyester 15% G.F./20% M.F. The lower contact wafer bores 766 are chamfered to increase the target zone for rivets during assembly. The lower switch blades 768 are insert molded into the lower contact wafer 764 at about a 0° deflection angle. The lower switch blades 768 are manufactured from a metal that has good conductive and spring characteristics such as 260 cartridge brass.

The lower electrical contacts 770 are manufactured from a metal tape with good conductive and wear characteristic such as from a silver-cad oxide alloy, a silver-cad oxide alloy cap on a copper alloy base, or a copper alloy. The lower electrical contacts 770 are attached to the lower switch blades 768 with a microresistance weld and then a light coining operation takes place to make the top surface of the lower electrical contact 770 slightly convex to compensate for tolerance variations in the angle of attack closure angle of the mating lower blade electrical contacts 770 and cam-follower lower electrical contacts 798. Lower electrical contacts manufactured from metal tape require a much lighter coining operation than prior art cold headed or riveted contacts. Thus, lower electrical contacts 770 manufactured from metal tape result in less deformation of the lower switch blades 768 for better alignment and quality of the blade switches. The lower electrical contacts 770 can be configured as a light duty contact that can switch loads up to about 1.0 Ampere, a medium duty contact that can switch loads up to about 13.0 Amperes, or a heavy duty contact that can switch loads up to about 15.0 Amperes.

The blade spring supports 772 include double cam-valley riders 774, a single cam-valley rider 776, lower blade notches 778, a lower blade subinterval tab 780, lower blade supports 782, and lower blade arc barrier 784. The blade spring supports 772 are insert molded onto each lower switch blade 768 and functions to maintain proper alignment of the lower switch blades 768 in relation to the camstack 62. During inserting molding of the blade spring supports 772, the lower blade switch terminals are used to locate and attached the blade spring supports 772 and the lower switch blades 768 have details that assist in fixing the blade spring supports 772 to the lower switch blades 768. The lower blade support 782 in turn functions to maintain proper alignment of the lower switch blades 768 in relation to the upper contact wafer assembly 750.

The double cam-valley riders 774 straddle program blades 466 contacting camstack valleys 490 on both sides of a program blade 466. The single cam valley rider 776 contacts on one camstack valley on one side of a program blade 466. A single cam valley rider 776 is used on one of the endmost blade switches 66 to reduce the overall width of the blade switches. A purpose of both the double and single cam valley riders 774, 776 is to maintain a constant distance between the lower contact blade 768 and the camstack 62. By maintaining a constant distance between the lower switch blades 768 and the camstack the blade spring supports 772 compensate for tolerance variations in the camstack and camstack wobble. Both the double cam-valley riders 774 and single cam-valley riders 776 are about 0.032 of an inch (0.081 cm) wide. The program blade space within the double cam-valley riders 774 is about 0.086 of an inch (0.217 cm). The lower blade notch 778 provide clearance for the cam-follower wafer assembly 748 to operate.

The lower blade subinterval tab 780 can be used with the optional subinterval switch 72 configured for single blade switch actuation. The lower blade subinterval tab 780 cooperates with the subinterval switch 72 to maintain the proper alignment between the lower switch blade 768 and the subinterval switch 72. The lower blade support 782 cooperates with the upper wafer assembly 750 to maintain the correct separation between the upper wafer assembly 750 and the cam-follower wafer assembly 748 and the lower wafer assembly 746. The lower blade support 782 is about 0.035 of an inch (0.089 cm) wide. The lower blade arc barrier 784 reduces arcing that can occur between the blade switches. The lower blade arc barrier 784 permits the blade switches 66 to be placed more closely together than could be accomplished without a lower blade arc barrier 784.

The cam-follower wafer assembly 748 includes a cam-follower wafer 786, cam-follower wafer bores 788, cam-follower switch blades 790, cam-follower blade top surface 792, cam-follower blade bottom surface 794, cam-follower blade angel forms 796, cam-follower lower electrical contacts 798, cam-follower upper electrical contacts 800, cam-follower riders 802, cam-follower lift tabs 804, cam-follower extended lift tabs 806, cam-follower molding runners 808, and cam-follower blade subinterval tab 810. The cam-follower wafer 786, cam-follower wafer bores 788, cam-follower switch blades 790, cam-follower lower electrical contacts 798, and cam-follower upper electrical contacts 800 are manufactured from materials and to standards similar to their corresponding components in the lower wafer assembly 746 described above with the following exceptions.

The cam-follower switch blades 790 are insert molded in the cam-follower wafer 786 with a cam-follower blade angle form 796 of about 8.5°. The cam-follower blade angle form 796 is positioned about 0.022 of an inch (0.056 cm) inside the cam-follower wafer 786 as measured from the cam-follower wafer edge nearest the cam-follower riders 802. The cam-follower blade angle form 796 could be positioned any distance inside the cam-follower wafer 786 and still achieve the advantage of encapsulating the cam-follower angle form. One advantage of having the cam-follower angle form 796 located between the blade switch terminals 752 and the cam-follower wafer edge nearest the cam-follower riders 802 is that force at the cam-follower lower electrical contacts 798 and cam-follower upper electrical contacts 800 is more predictable because the moveable portion of the cam-follower switch blade 790 does not contain an angle form. Another advantage of having the cam-follower angle form encapsulated in the cam-follower wafer 786 is that cam-follower switch blade spring flex is more consistent. An angle form is created in the cam-follower switch blade 790 by exceeding the elastic limits of the cam-follower switch blade 790 to create a permanent angle or angle form in the cam-follower switch blade 790. If the cam-follower blade angle form 796 is placed on the moveable portion of the cam-follower blade, material and manufacturing variances reduce the consistency of cam-follower switch blade spring flex. Blade switch deflection is determined where y is deflection, W is load on beam, x is a point on the beam where deflection is being calculated, E is modulas of elasticity of material, I moment of inertia of the cross-section of the beam and l is beam length as expressed by the formula:

$$y = \frac{Wx^2}{6EI}\ (3l - x).$$

The cam-follower lower electrical contacts 798 and cam-follower upper electrical contacts 800 are attached to the cam-follower blade 790 in a similar fashion and have similar advantages as the lower blade electrical contacts 770 described above with the following differences and advantages. The cam-follower contacts 798, 800 are attached to the cam follower blade 790 in a staggered relation to the cam-follower blade top surface 792 and the cam-follower blade bottom surface 794. More specifically the cam-follower upper contact 800 is attached to the cam-follower blade top surface 792 between the cam-follower rider 802 and the moveable contact end 742, and the cam-follower lower contact 798 is attached to the cam-follower blade bottom surface 794 located between the cam-follower rider 802 and the stationary terminal end 740. An advantage of positioning the cam-follower upper contact 800 between the cam-follower rider 802 and the moveable contact end 742 is that a greater mechanical advantage is provided to create faster more accurate switching and more contact movement than when the cam-follower upper contact 800 is placed between the cam-follower rider 802 and the stationary terminal end 740. An additional advantage of using staggering the cam-follower lower electrical contact 798 and cam-follower upper electrical contacts 800 manufactured of metal tape with a light coining operation to manufacture the cam-follower lower electrical contacts 798 and cam-follower upper electrical contacts 800 is that the cam-follower lower electrical contact 798 and cam-follower upper electrical contact 800 can be different types rather than specifying both contacts to be the highest current rating of either the cam-follower lower electrical contact 798 or the cam-follower upper electrical contact 800. For instance the cam-follower lower electrical contact 798 could be a low current contact and the cam-follower upper electrical contact 800 could be a high current contact rather than using both high current contacts to reduce cost. Also by staggering the upper cam-follower contact 800 and the lower cam-follower contact 798 on the cam-follower blade 790, electrical erosion of the cam-follower blade between the upper cam-follower contact and lower cam-follower contact is reduced because electrical arcing on the upper cam-follower contact 800 occurs at a different location on the cam-follower blade 790 than arcing on the lower cam-follower contact 798.

The cam-follower riders 802 are insert molded onto the cam-follower switch blades 790 in a fashion similar to how the blade spring supports 772 are insert molded onto the lower switch blades 768 described above with the following exception. The cam-follower molding runner 808 provides a path for plastic during insert two plate molding of the cam-follower riders 802, cam-follower lift tabs 804, and cam-follower extended lift tabs 806. The cam-follower riders 802 engage the switch program blades 466 to move the cam-follower switch blades 790 in accordance with a predetermined program. The cam-follower lift surface is engaged by the master switch 68 to lift the cam-follower blades 790 away from the lower switch blades 768 to break electrical contact. The cam-follower extended lift tabs 806 extend about 0.040 of an inch (0.102 cm) from the cam-follower lift surface and are engaged by the master switch 68 in quiet cycle selector configuration to lift the cam-follower riders 802 high enough to clear the switch program blades top radius 468 to prevent noise from being generated by the cam-follower riders 802 during quiet cycle selector operation in addition to breaking electrical contact with the lower switch blades 768. The cam-follower blade subinterval tab 810 extends about 0.040 of an inch (0.102 cm) from the edge the cam-follower switch blade 790 and is engaged by the subinterval switch 72 to operate a blade switch.

The upper contact wafer assembly 750 includes an upper contact wafer 812, upper contact wafer bores 814, upper switch blades 816, upper blade angle forms 818, upper electrical contacts 820, upper blade support tabs 822, upper blade support notches 824, and upper switch blade extensions 826. The upper switch blades 816, upper electrical contacts 820, and upper contact wafer 812 are manufactured from materials and to standards similar to their corresponding components in lower wafer assembly 746 described above. The upper switch blades 816 are molded into the upper contact wafer 812 at an upper blade angle form 818 of about 12° in a similar fashion to the cam-follower blade angel forms 796 described above.

The upper blade support tabs 822 contact the lower contact spring supports 772 so the upper electrical contacts 820 will maintain a constant distance air gap from the lower electrical contacts 770. The upper wafer assembly component contact the upper spring blade support about 0.180 of an inch (0.457 cm) above the lower spring blade. The upper blade support tabs 822 are located between the upper blade contact and the upper blade stationary end. A support notch 824 is formed in the upper blade 816 to permit clearance of an adjacent blade switch with an upper blade support tab 822. The upper switch blade extensions 826 are engaged by the master switch 68 or quiet cycle selector 70 to lift the upper switch blades 816 to break electrical contact with the cam-follower upper electrical contacts 800.

The blade switch terminals 752 include blade switch alignment details 828 and blade switch terminal notches 830. The blade switch alignment details 828 can be blade switch bores that are used as an alignment detail during insert molding of the lower contact wafer assembly 746, the cam-follower wafer assembly 748, and the upper contact wafer assembly 750. The blade switch bores 828 are engaged by a wafer mold pin to increase molding accuracy of the blade switches 66 in the corresponding lower contact wafer 764, cam-follower wafer 786, or upper contact wafer 812. The blade switch terminal notches 830 are an assembly aid. An assembly fixture engages the blade switch terminal notches 830 during assembly of the blade switches 66 to properly align the lower contact wafer assembly 746, the cam-follower wafer assembly 748, and the upper contact wafer assembly 750 in relation to the blade switch terminals 752. By aligning the lower contact wafer assembly 746, the cam-follower wafer assembly 748, and the upper contact wafer assembly 750 in reference to the blade switch terminals 752, more accurate blade switch alignment is achieved than alignment off a material such as a plastic molding. The terminals are integral to the switch blades and are shaped to meet National Electrical Manufacturers Association (NEMA) standards and to accepted by a plug-type electrical connector.

The blade switch bussing 758 includes a horizontal bussing port 832, a first vertical bussing port 834, a second vertical bussing port 836, bussing ridges 838, bussing ridge motor connector slot 840, a bussing pins 842, and a bussing cap 844. Blade switch bussing 758 permits making permanent hard wire connections between selected blade switch terminals 752 and provides a location for the motor terminal connectors 754 to bridge an electrical connection between the blade switches 66 and the motor terminals 262. The horizontal bussing port 832 allows selected adjacent blade switch terminals 752 on the lower contact wafer assembly 746 or cam-follower wafer assembly 748, or upper contact wafer assembly 750 to be electrically connected. On selected adjacent blade switch terminals 752 where an electrical connection is not desired, the material connecting the adjacent blade switch terminals 752 is lanced to break the electrical connection. The horizontal bussing port 832 provides adequate space so the material connecting the adjacent blade switch terminals 752 that is lanced remains connected to the blade switches 66 to reduce manufacturing complications that can result from small loose pieces of blade switch material. The first vertical bussing port 834 provides an opening to insert bussing pins 842 to form electrical connections between lower switch blades 768 and upper switch blades 816. The second vertical bussing port 836 provides an opening to insert bussing pins 842 to form electrical connections between cam-follower switch blades 790 and upper switch blades 816. The bussing ridges 838 form slots to carry bussing pins 842. The bussing ridge motor connector slot 840 receives a motor terminal connector component to align and secure the motor terminal connector component in the lower contact wafer 764. The bussing pins 842 are used in the first vertical bussing port 834, the second vertical bussing port 836, and on the blade switch terminals 752 to electrically connect selected blade switch terminals 752. The bussing cap 844 electrically insulates the bussing pins 842 used on blade switch terminals 752 from an electrical connector (not shown) used on the blade switch terminals 752.

The motor terminal connectors 754 include a first motor connector 846, a second motor connector 848, male motor connector guides 850, and a female motor connector guide 852. The motor terminal connectors 754 cooperate with the motor terminals 262 to electrically connect the blade switches 66 to the motor 58 in a fashion that permits automated assembly of the blade switches 66 onto the housing 54 along a single axis. The first motor connector 846 includes a first motor connector shaft tip 854, a first motor connector shaft 856, and a first motor connector clip 858. The first motor connector shaft tip 854 is chamfered at about 45° and offset about 0.010 of an inch (0.0254 cm) toward the center of the first motor connector shaft 856 to guide both the first motor connector shaft tip 854 and first motor connector shaft 856 into the appropriate first vertical bussing port 834 during assembly. The first motor connector shaft edges are bent to avoid having opposing sharp edges that could cause jamming during assembly and to strengthen the first motor connector shaft 856. The first motor connector shaft leading edges are chamfered at about a 30° angle to further ease insertion. The first motor connector clip 858 is clothes pin shaped to create spring pressure for a good electrical connection with the motor terminal wire switch end 328. The second motor connector 848 includes a second motor connector shaft tip 860, a second motor connector shaft 862, a second motor connector clip 864, and a second motor connector shaft extension 866. The second motor connector shaft tip 860, second motor connector shaft 862 and second motor connector clip 864 are similar to those previously described for the corresponding components of the first motor connector 846. The second motor connector shaft extension 866 engages the bussing ridge motor connector slot 840 to assist in locating and securing the second motor connector clip 864.

The male motor connector guides 850 and female motor connector guide 852 are integral to the lower contact wafer 764 and engage the motor's center motor terminal guide 322 and side motor terminal guides 324 to align the motor terminal wire switch end with the first motor connector clip 858 and the second motor connector clip 864 when the blade switches 66 are installed on the housing 54.

The blade switch fasteners 756 include wafer rivets 242, male wafer fasteners 868, and male wafer fastener ramps 870. The wafer rivets 242 are installed through the lower contact wafer bores 766, the cam-follower wafer bores 788, the upper contact wafer bore 814, and the second side cover wafer mounting bore 242 to secure the blade switches 66 to the second side cover 78. The male wafer fasteners 868 are formed by material from the lower contact wafer 764 and the cam-follower contact wafer 786 and are engaged by the base female wafer fastener 172 and cover female wafer fastener 226 to assist in securing the blade switches 66 with attached second side cover 78 to the housing base 74 and first side cover 76. The male wafer fastener ramps 870 are chamfered surfaces that cooperate with the base female wafer ramp 174 and cover female wafer ramp 228 to increase the assembly target area and serve as a guide during installation of the blade switches 66 with attached second side cover 78 onto the housing base 74 and first side cover.

The blade switches 66 are assembled before installation into the housing base 74 by assembling blade switch components on a straight axis that is perpendicular to the blade switch terminals 752 using automated assembly equipment which is discusses in a later section entitled "Assembly Of The Cam-Operated Timer". The upper wafer assembly 750 is stacked on top of the cam-follower wafer assembly 748 and the lower wafer assembly 746 is stacked under the cam-follower wafer assembly 748. An assembly fixture assists in properly aligning the wafer assemblies. Additionally, the second side cover notches help to properly place the upper contact wafer assembly 750 in relation to the second side cover 78. Wafer rivets 242 are installed through the stacked upper wafer assembly 750, cam-follower wafer assembly 748, lower wafer assembly 746, and through the second side cover 78. The rivets securely attach the blade switches 66 to the second side cover 78.

The blade switch terminal notches 830 are used to align the lower contact wafer assembly 746, the cam-follower wafer assembly 748, and the upper contact wafer assembly 750 during installation in the second side cover 78. The mating surfaces of the lower contact wafer assembly 746, cam-follower wafer assembly 748 and upper contact wafer assembly 750 are substantially smooth to permit the mating surface to align according to the blade switch terminal notches 830 to more accurately align lower switch blades 768 with the cam-follower switch blade 790 with the upper switch blades 816.

Master Switch

Referring to FIG. 6, 12*a*–20, 22, and 23, the master switch 68 includes rocker lifter 872, a switch lifter 874, a lifter spring 876, a rocker 878, and a lift bar 880. The master circuit switch 68 functions to lift cam-followers switch blades 790 and upper switch blades 816 high enough to break electrical connections between the cam-follower switch blades 790, the lower switch blades 768, and the upper contact switch blades 816. When all electrical connections are opened the appliance 50 is turned "off". The master switch 68 is an option used on cam-operated timers configured with a control shaft 438. In some configurations, the switch lifter 874 could directly lift one or more cam-follower switch blades 790 to eliminate the need for a rocker lifter 872, rocker 878 and lift bar 880.

The rocker lifter 872 includes a rocker lifter pivot bore 882, a rocker lifter notch 884, a rocker lifter spring connector 886, a rocker lifter ramp 888, a rocker lifter latch 890, and a rocker lifter contacter 892. The rocker lifter pivot bore 882 engages the housing base rocker lifter pivot pin 150. The rocker lifter notch 884 provides clearance for the housing base rocker lifter retainer 152 during installation of the rocker lifter 872. The rocker lifter spring connector 886 provides a point of attachment for the lifter spring 876 to bias the rocker lifter ramp 888 toward the control shaft mount 142. The rocker lifter ramp 888 is angled at 45° to complement the control shaft lift ramp 514 that is also 45°. The rocker lifter latch 890 is a reverse ramp of 60° from the rocker lifter ramp 888 that extends about 0.006 of an inch (0.0152 cm) from the rocker lifter 872 creating an overhang. The rocker lifter contacter 892 cooperates with the rocker 878 to impart motion to the rocker 878. The rocker lifter 872 is assembled into the housing base 74 by aligning the rocker lifter pivot bore 882 with the rocker lifter pin 150 and the rocker lifter notch 884 with the rocker lifter retainer 152. Once the alignment is complete the rocker lifter 872 will simply drop into the housing base 74 on a axis perpendicular to the base. The rocker lifter 872 operates when the control shaft 438 is moved to a depressed position. When the switch lifter 874 is actuated by the control shaft lift ramp 514, the switch lifter 874 displaces about 0.135 of an inch (0.342 cm).

The switch lifter 874 includes a switch lifter pivot bore 894, a switch lifter notch 896, a switch lifter spring connector 898, a switch lifter ramp 900, a switch lifter latch 902, and a switch lifter bar contacter 904. The switch lifter pivot bore 894 cooperates with the housing base switch lifter pivot pin 158 to permit the switch lifter 874 to pivot. The switch lifter notch 896 permits installation in the housing base 74 over retention hook 160 on a straight axis. The switch lifter spring connector 898 provides an attachment point for the lifter spring 876 to bias the switch lifter 874 toward the control shaft mount 142. The switch lifter ramp 900 is a angled at 45° to complement the control shaft lift ramp 514 that is also 45°. The switch lifter latch 902 is a reverse ramp of 600 from the rocker lifter ramp 888 that extends about 0.006 of an inch (0.0152 cm) from the switch lifter 874 creating an overhang. When the switch lifter 874 is actuated by the control shaft lift ramp 514, the switch lifter 874 displaces about 0.135 of an inch (0.342 cm). The switch lifter 874 functions to lift cam-followers blades 790 and upper switch blades 816 a distance sufficient to break all electrical contacts 744 within the blade switches 66 thereby turning "off" the appliance 50 without the use of a dedicated line switch.

The lifter spring 876 has lifter spring loops 906 and is optional to the master switch 68. The purpose of the lifter spring 876 is to provide an additional biasing force of about 0.625 lbs (0.284 Kg) for biasing the rocker lifter 872 and switch lifter 874 toward the control shaft lift bearing 518. The additional biasing force supplied by the spring creates a more positive feel for the operator when the operator extends the control shaft 438 to place the cam-operated timer 52 in operation.

The rocker 878 includes a rocker pivot 908 and rocker tabs 910. The rocker cradle 166 is located in the rocker mount 164. The rocker cradle 166 acts as a bearing surface for the rocker 878 as the rocker 878 pivots during operation of the master circuit switch. The rocker 878 is symmetrical, so the rocker 878 can be placed with either end into the rocker support 164. The rocker ends are also tapered to facilitate insertion into the rocker mount 164. The rocker arm notch prevents the switch lifter pivot base detail 158 from interfering with the movement of the rocker arm. During operation, the rocker tabs 910 move about 0.135 of an inch (0.343 cm).

The lift bar 880 includes a lift bar notch 912, a lift beam 914, a lift platform 916, a switch lifter tab 918 and a switch lifter guide 920. The lift bar notch 912 is engaged by the rocker tab 910 to displace the lift bar 880. The lift beam 914 provides a mechanical connection between the lift bar notch 912 and the lift platform 916. The lift platform 916 has a lower lift platform 922 and an upper lift platform 924. The lower lift platform 922 has lower lift peaks 926, lower lift valleys 928, and lower lift platform extensions 930. The lower lift peaks 926 contact the cam-follower blades 790 to lift the cam-follower blades away from the program blades 466. The lower platform lift valleys 928 provide clearance for the lower blade arc barrier 784. The lower lift platform extensions 930 are used with the quiet cycle selector 70 to increase lift of the cam-follower blades 790. The upper lift platform 924 has upper lift peaks 932 and upper lift valleys 934. The upper lift peaks 932 contact the upper switch blade extensions 826 to maintain an air gap between the upper switch blades 816 and the cam-follower switch blades 790 when the master switch 68 is actuated. The upper lift valleys 934 reduce arc tracking between blade switches 66. The switch lifter tab 918 is contacted by the switch lifter bar contacter 904 to move the lift bar 880 during master switch actuation. The switch lifter guide 920 engages the housing base lift bar channel 168 to align and guide the lift bar 880 during actuation. The lift bar 880 is installed after the first side cover 76 has been attached to the housing base 74. The lift bar guides function to receive, properly locate and permit a component of the quiet manual selector to slideably operate. The lift bar 880 is manufactured from a rigid plastic such as a glass and mineral filled polyester. The switch lifter tab 918 is engaged by the switch lifter bar contacter 904 to assist in displacing the lift bar 880.

Operation of the master switch 68 is now discussed. It takes about 5.5 lbs (2.48 Kg) of force to inwardly index the control shaft 438. It takes about 3.5 lbs (1.59 Kg) of force to outwardly index the control shaft 438. The lower lift platform 922 engages the cam-follower blades 790 to lift them about 0.020 of an inch (0.051 cm) above the program blades neutral radius 470 to lift the cam-follower lower electrical contacts 798 away from the lower blade electrical contacts 770. When the master switch 68 is in the lift position, the cam-follower riders 802 do not clear the program blade upper radius 468. Therefore when the camstack 62 is rotated noise is created by the cam-follower riders 802 contacting the program blade upper radius 468 and the primary drive pawl 608 and secondary drive pawl 610 contacting the drive blade drive teeth 482. The upper lift platform 924 engages the upper switch blades 816 to lift the upper electrical contacts 820 away from the cam-follower upper electrical contacts 800 to break electrical contact. Also the camstack 62 can only be rotated in a single direction that is the same direction the camstack is driven. To ensure the camstack 62 is only rotated in a single direction, the clutch 440 is configured to engage in a single direction.

Quiet Cycle Selector

Referring to FIG. 6, 8, 10*a*–20, and 22–23 the quiet cycle selector 70 includes the same components as the master switch 68 with the following substitution and additions. The master switch rocker lifter 872 is substituted for a drive lifter 936 and the master switch lifter 874 may be substituted for a delay lifter 938 in applications having a delay drive 604. The previously discussed master switch components will not be discussed except for modifications that may be made for the quiet cycle selector. The quiet cycle selector 70 functions to disengage the camstack drive 64 and lift cam-followers so that when the camstack is rotated by the control shaft ratcheting noises generated by the camstack drive 64 and cam-follower slapping against the camstack 62 are reduced or eliminated. The quiet cycle selector 70 also performs the function of the master circuit switch to open all electrical circuits thereby turning "off" the appliance 50 without the use of a dedicated line switch.

The drive lifter 936 may also be referred to as a pawl lifter and includes a pawl lifter pivot bore 940, a pawl lifter notch 942, a pawl lifter spring connector 944, a pawl lifter ramp 946, a pawl lifter latch 948, a pawl lifter drive contacter 950, a pawl lifter rocker contacter 952. The pawl lifter 936 functions to disengage the primary drive pawl 608 and the secondary drive pawl 610 from the camstack primary drive blade 476 and secondary drive blade 478 during actuation of the quiet cycle selector 70. The pawl lifter 936 is made from a rigid plastic with a low coefficient of friction such as acetal or nylon. The major difference between the rocker lifter 872 and the pawl lifter 936 is the pawl lifter drive contacter 950. The pawl lifter drive contacter 950 is wider than the primary drive pawl foot 648 because the primary drive pawl surface has a linear movement of about 0.18 of an inch (0.46 cm) and at any time during this linear movement the pawl lifter 936 must be able to contact the primary drive pawl 608 and move the primary drive pawl 608 away from the camstack ratchet. The secondary drive pawl surface is about the same size as the secondary drive foot 662 because the secondary drive pawl 610 only moves about 0.006 inches (0.015 cm) during operation. Therefore, the secondary drive pawl surface is always in position to move the secondary drive pawl 610 when the pawl lifter 936 is displaced. The pawl lifter notch 942 permits installation in the housing base over retention hook 152 on a straight axis.

The delay lifter 938 includes a delay lifter rocker contact 954, and a delay rocker 956. The remaining portions of the delay lifter 938 that correspond with matching portions on the switch lifter 874 are configured similarly and perform similar functions. In addition to performing the same functions as the switch lifter 874, the delay lifter 938 also disengages the delay camstack pawl 674 from the camstack delay drive blade 480 during actuation of the quiet cycle selector 70. The delay rocker contact 962 imparts movement to the delay rocker 956 when the quiet cycle selector 70 is actuated. The delay rocker 956 includes a delay rocker pivot bore 958, a delay rocker foot 960, a delay rocker contact 962, and a delay rocker pawl lifter 964.

The lift bar 880 used for the quiet cycle selector is similar to the lift bar 880 discussed above under the description of the master circuit switch with the addition of lift extensions 930. The lift extensions 930 project about 0.070 inch (0.178 cm) from the lower lift platform 922. The lift extensions 930 engage the cam-follower blade extended lift tabs 806 to lift the cam-follower blades 790 0.010 inch (0.254 cm) above the program blades top radius 468.

An objective of the quiet cycle selector 70 is to cause the lift bar 880 to remove the blade switches 66 from their contact with the camstack 62 so that the camstack 62 may be rotated in any direction without the clicking noises that would be present if the blade switches 66 were engaged with the camstack 62. This objective is accomplished by application of force to opposite ends of the lift bar 880 in a direction toward the second side cover 78. Adequate force applied to the lift bar 880 in this manner causes the lift bar 880 to engage the blade switches 66 and clear them from any interaction with the camstack 62.

Operation of the quiet cycle selector 70 is now discussed. When the control shaft 438 is extended, i.e., pulled-out, the quiet cycle selector 70 is not in operation and the camstack 62 is free to rotate on the control shaft 438 as the primary drive pawl 608 and secondary drive pawl 610 move the camstack. With the control shaft 438 in the extended position, the pawl lifter actuation ramp 946 and the switch lifter actuation ramp 900 rest on the circular ramp 514 of the control shaft 438 see FIGS. 17*a*–18. As the control shaft 438 is depressed, i.e., pushed-in toward the housing 54, the pawl lifter actuation ramp 946 and the switch lifter actuation ramp 900 slide along the circular ramp of the control shaft 438. This sliding action forces the pawl lifter 936 and the switch lifter 874 to radially move away from the control shaft 438 as they rotate about their respective pivots. The pawl lifter 936 pivots in a direction away from the second side cover 78, and the switch lifter 874 pivots toward the second side cover 78 see FIG. 20. Upon substantial depression of the control shaft 438, when the base end of the control shaft is about to contact the housing base 74, the circular ramp slides past the pawl lifter actuation ramp 946 and the switch lifter actuation ramp 900, causing the control shaft to lock in place in the depressed position. When the control shaft 438 contacts the housing base 74, the control shaft cannot be depressed any farther see FIG. 19.

Figure 17A:
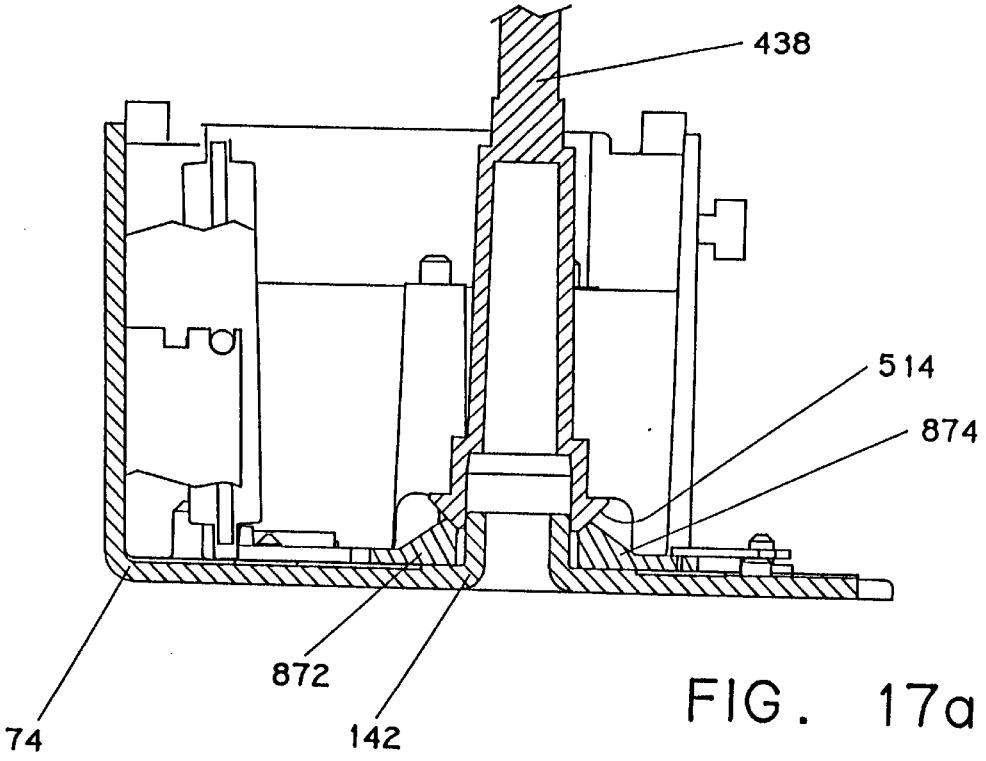
FIGS. 17*a–b* show the control shaft in an extended position.
Figure 17B:
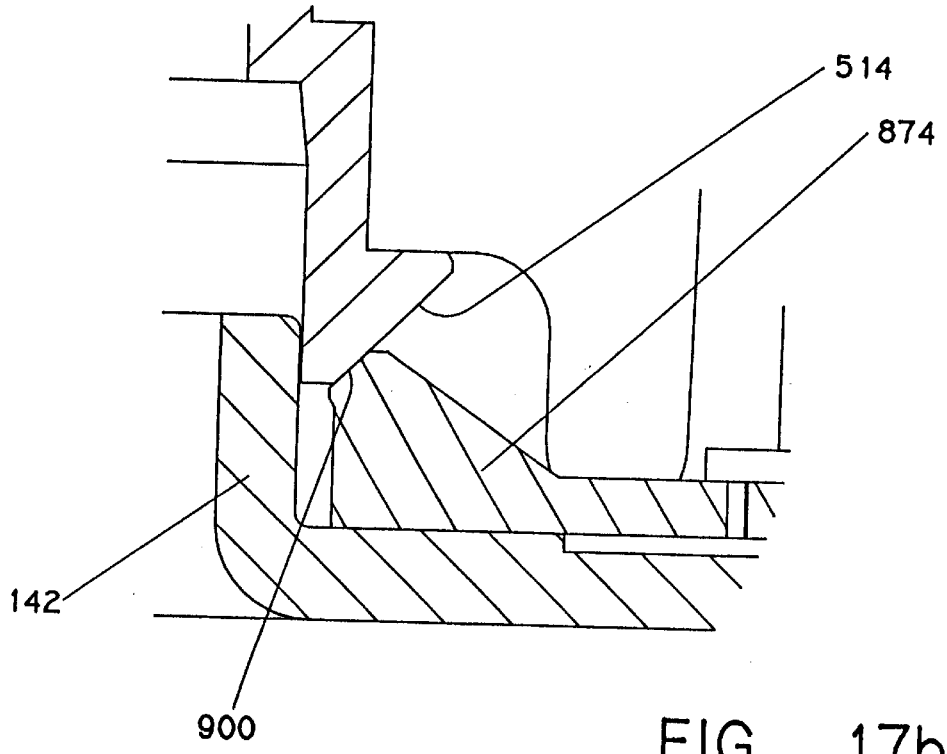
Figure 18:
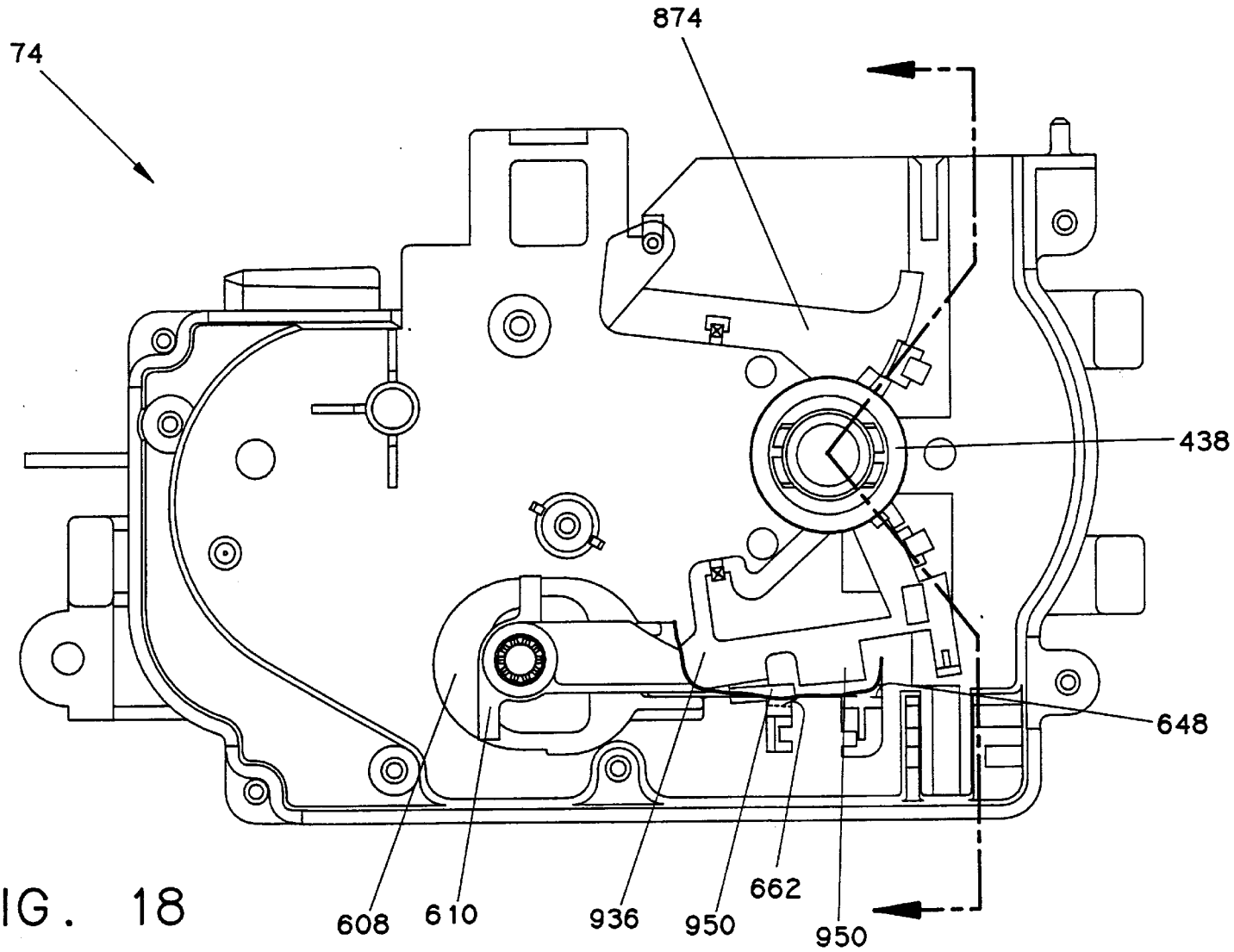
FIG. 18 shows the switch lifter and pawl lifter when the control shaft is in the extended position.
Figure 19A:
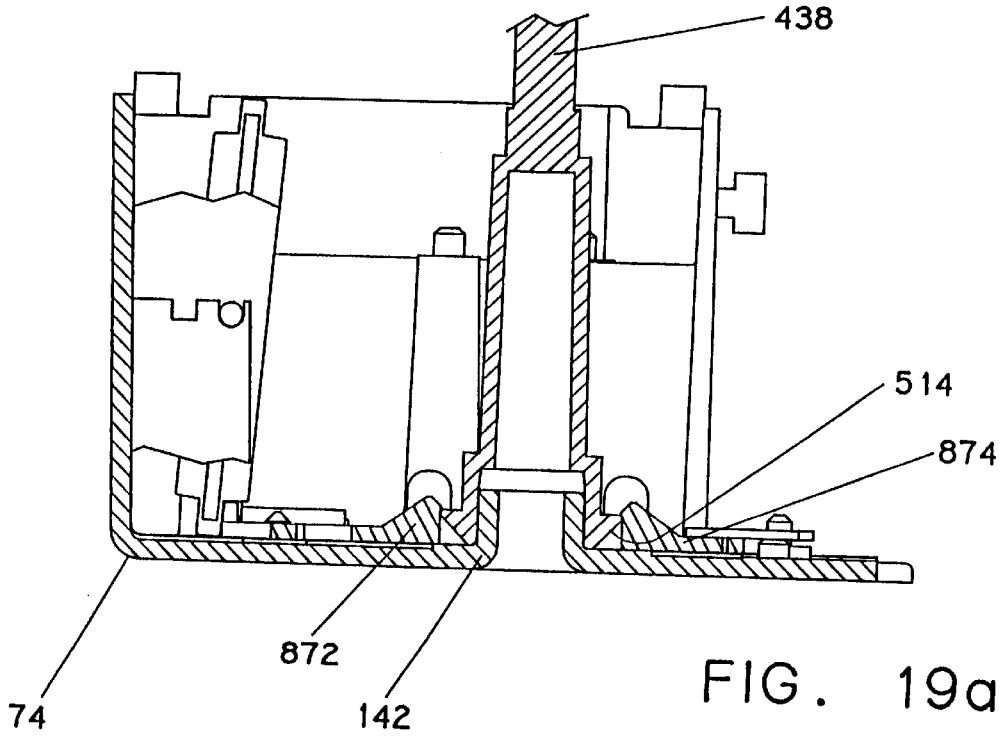
FIGS. 19*a–b* show the control shaft in a depressed position.
Figure 19B:
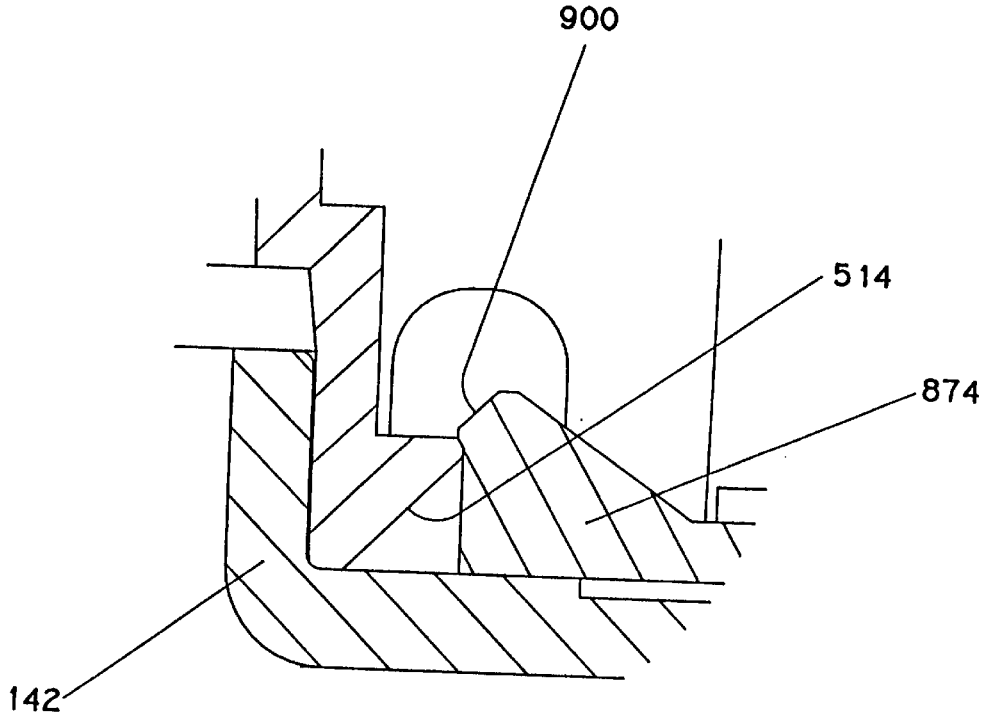
Figure 20:
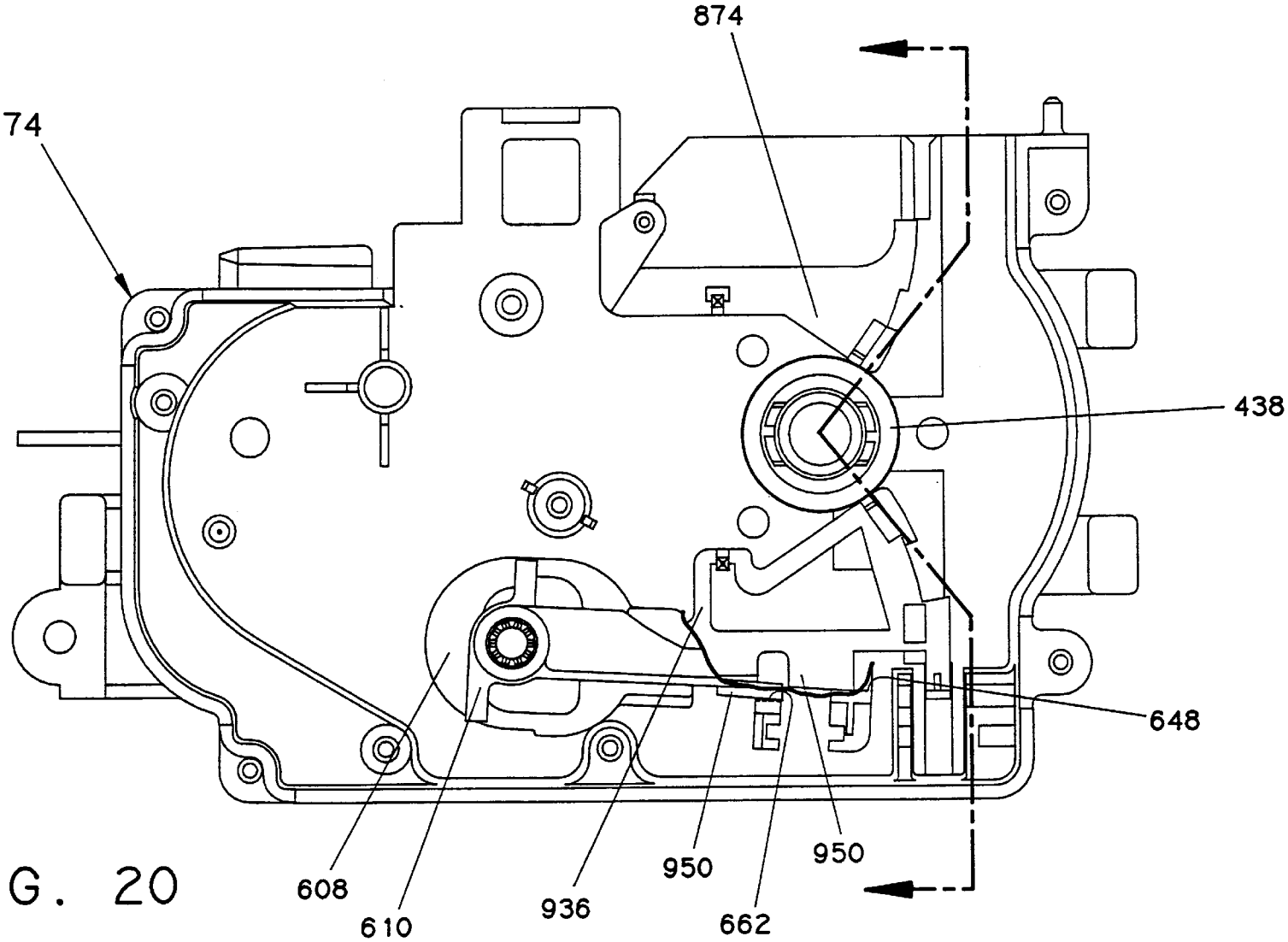
FIG. 20 shows the switch lifter and pawl lifter when the control shaft is in the depressed position.

When the pawl lifter 936 pivots, the pawl lifter rocker contact surface 952 presses against the rocker 878. Force applied to the rocker 878 causes the rocker 878 to rotate about its fulcrum. FIGS. 17*a* and 19*a* show the movement of the lifter and the associated rotation of the rocker 878 about its fulcrum. The result of rocker 878 rotation is a force applied by the rocker 878 opposite the force that was applied at the other end of the rocker 878 by the pawl lifter rocker contact surface 952. The rocker notch of the lift bar 880 is the recipient of the force from the rocker action. Thus, the movement of the pawl lifter 936 causes a force to be applied to one end of the lift bar 880 in a direction toward the second side cover 78. Also when the pawl lifter 936 pivots, the pawl lifter drive contacter 950 applies pressure to the primary drive foot 648 to pivot both the primary drive pawl 608 and secondary drive pawl 610 out of engagement with the camstack primary drive blade 476 and secondary drive blade 478 respectively. FIGS. 18 and 20 show the pivoting motion of the pawl lifter and the switch lifter 874 as the control shaft 438 is moved from its extended position to its depressed position. It can be seen in these figures the application of force by the pawl lifter contacter 950 on the primary drive foot 648 and the secondary drive foot 662 to move the primary drive pawl 608 and the secondary drive pawl 610 radially outward to disengage the primary and secondary camstack drive blades 476 and 478.

When the switch lifter 874 pivots, the switch lifter bar contact surface 904 applies a force to the lift bar 880. At this point, a force is also being applied at an opposite end of the lift bar 880 by movement of the rocker 878. This action causes the lift bar 880 to move toward the second side cover 78. The lift bar 880 then contacts the blade switches 66 as it nears the second side cover 78, and pulls the blade switches 66 from contact with the camstack 62. Release of the blade switches 66 from contact with the camstack 62 allows the camstack 62 to be rotated in either direction without any noise from interaction with the blade switches. Also in delay drive applications where the switch lifter 874 is substituted for a delay lifter 938, the delay lifter rocker contact 954 applies force to the delay rocker contact 962 that in turn applies force to the delay camstack pawl foot 700 to pivot the delay camstack pawl 674 out of engagement with the camstack delay drive blade 480.

It is a feature of the quiet cycle selector 70 that cycle selection is quieter than with a master switch. For instance the following data shows noise measurements in decibels made with a cam-operated timer configured with a master switch 68 and a similar cam-operated timer configured with a quiet cycle selector 70 (QCS) measured at both 1 KHz and 4 KHz in decibels while rotating the control shaft at five R.P.M.

| Configuration | Noise (dB) 1KHz | Noise (dB) 4 KHz |
|---|---|---|
| Master Switch | 54.0 | 59.1 |
| QCS | 37.3 | 24.0 |

Subinterval Switch

Figure 6:
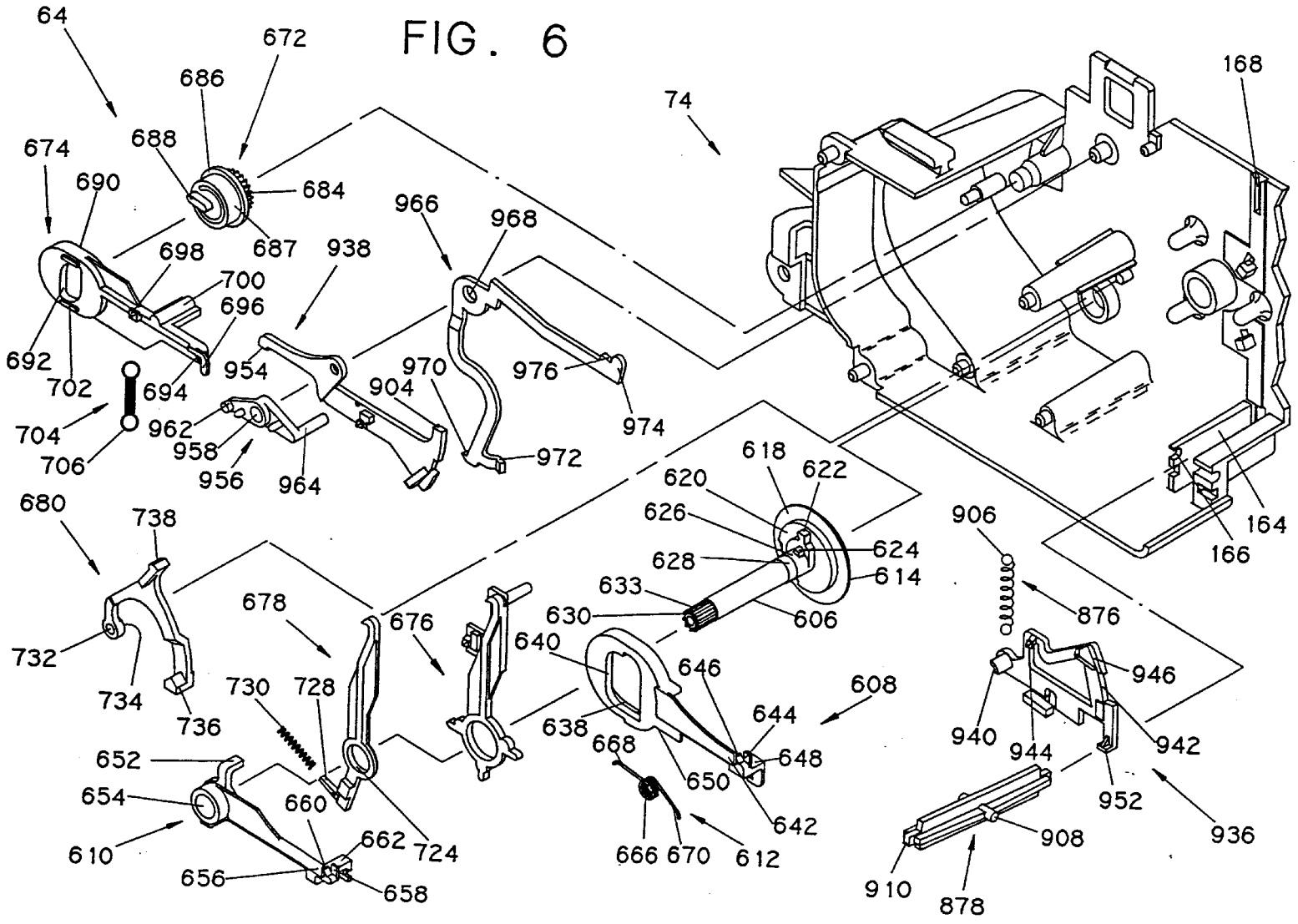
FIG. 6 shows an exploded view of selected timer components and the housing base.

Referring to FIG. 6, the subinterval switch 72 includes a subinterval lever 966, a subinterval pivot bore 968, a subinterval follower 970, a subinterval foot 972, a subinterval actuator 974, and a subinterval step 976. The subinterval switch 72 is an optional component of the cam-operated timer 52 that functions to operate the blade switches 66 in response to a predetermined program carried on the drive cam subinterval cam 616 which is independent of camstack movement. The subinterval switch 72 is operated by the subinterval cam 616 to actuate the cam-follower blade subinterval tab 810 to operate one of the blade switches. The subinterval switch 72 along with the subinterval cam 616 can be configured to operate one of the blade switches in the range of from about 1–180 seconds. The subinterval switch 72 is typically configured to operate one of the blade switches for 15–20 second intervals for machine functions such a clothes washing machine spray rinse. The subinterval lever 966 is stamped from a steel zinc precoated stock with the burr side of the stamping away from the housing platform 84 to facilitate installation and shaped to avoid interference with the housing 54 and timer components 56. The subinterval switch 72 can be configured for a single throw to make and break the lower blade electrical contacts 770 by actuating the cam-follower blade subinterval tab 810 or a double throw to make and break both the lower electrical contacts and the upper electrical contacts 820 by actuating the cam-follower blade subinterval tab 810.

The subinterval pivot bore 968 cooperates with the housing base subinterval pivot pin 110 to provide a fulcrum for operation of the subinterval lever 966. The subinterval follower 970 cooperates with the subinterval cam 616 to convert rotary drive cam motion to a linear motion. The subinterval foot 972 contacts the housing base platform 84 to position the subinterval follower 970 at the level of the subinterval cam 616 and provide a bearing when the subinterval lever 966 pivots in response to the subinterval cam 616. The subinterval lever 966 jogs about 0.035 of an inch (0.0889 cm) near the subinterval pivot bore 968 to assist along with the subinterval foot 972 in positioning the subinterval follower 970 at the level of the subinterval cam 616. The subinterval actuator 974 contacts the cam-follower blade subinterval tab 810 to actuate a cam-follower switch blade 790. The subinterval actuator 974 is radiused to provide a bearing surface during actuation. The subinterval step 976 is an option that contacts the lower blade subinterval tab 780 which in turn through the lower blade support 782 maintains the proper air gap between the upper blade electrical contacts 820 and the cam-follower lower electrical contacts 798 during subinterval switch operation.

Operation of the subinterval switch 72 is now discussed. The subinterval follower 970 contacts the subinterval cam 616 to provide linear motion to the subinterval lever 966. The linear motion of the subinterval follower 970 is transferred to the subinterval actuator 974. The subinterval actuator 974 contacts the cam-follower blade subinterval tab 810 and causes the subinterval actuator 974 to press against the cam-follower blade subinterval tab 810 to operate a blade switch. Operation of the subinterval switch 72 can be masked when the camstack 62 is operating the blade switches 66 that the subinterval switch 72 is attempting to operate.

Assembly Of The Cam-Operated Timer

The cam-operated timer 52 can be assembled by either automated equipment, manual assembly line workers, or a combination of automated equipment and manual assembly line workers. The cam-operated timer 52 is designed so timer components 56 can be installed on either a vertical axis perpendicular to the housing base platform 84 or a horizontal axis parallel to the housing base platform 84. It is a feature of the cam-operated timer 52 that fluid simultaneous movement along multiple axes such as typically done by robotic equipment is not required to simplify assembly and reduce the cost of assembly equipment. Additionally as previously described, Design For Assembly (DFA) techniques were used to generally design the cam-operated timer 52 so timer components 56 were designed to be assembled on a straight axis, oriented either parallel or perpendicular to the assembly axis, the timer components 56 can only be assembled in the correct location, the target zone where the timer component is assembled is generous, timer components 56 are radiused where they will contact other timer components 56 during assembly to better guide onto a target, and timer components 56 are asymmetrical in both horizontal and vertical planes to permit automated assembly machines to better hold and orient parts. These features facilitate ease of both automated and manual assembly.

Automated assembly of the cam-operated timer 52 is accomplished by loading timer components 56 into the housing base 74 on one or more straight axes in a predetermined sequence by the use of a palette-and-free system of assembly stations. The palette-and-free system uses a palette control to transfer a palette containing the housing base 74 along a path to create a fully assembly the cam-operated timer 52. The palette control can be a conveyor, walking beam, or rotary table that transfers the palette from assembly station to assembly, and at each assembly station the palette is held stationary with a control while timer components 56 are assembled. The housing base 74 is placed in a palette and located within the palette by base details 86 such as the base assembly detail 88. The palettes can be held stationary at an assembly station by physically interfering with the palette so the conveyor slips under the palette while the palette is operated on at an assembly station. The palettes can also be held stationary by lifting the palette clear of the conveyor with a walking beam to break the frictional contact between the conveyor and the palette. Using a walking beam to transport the palette from assembly station to assembly station also reduces vibration to the palette that can cause timer components 56 to become misoriented. The palettes can be electronically written to and read by the automated assembly equipment to determine what assembly stations the palette should be stopped at, what assembly stations the palette has been to, and whether an assembly station presence check was successful. Each automated assembly station for timer components 56 typically includes one or more palette controls such as a conveyor belt, walking beam, or rotary table, a parts source, a pick-and-place machine, and a presence check.

Part sources for a pick-and-place machine to receive timer components 56 include a vibratory feeder bowl, dead nest, live nest, or tray. A vibratory feeder bowl shakes each part into a proper orientation for assembly and then sends the part down a conveyor belt or in-line feeder to the pick-and-place machine. A dead nest is a fixture used to prepare a timer component for pick-up by a pick-and-place machine. A dead nest may passively orient a timer component for the pick-and place machine. A live nest is similar to a dead next, but a live nest moves to actively orient or load a timer component for the pick-and-place machine. A tray is a matrix often made of plastic that typically holds complex parts or subassemblies such as the camstack 62, motor 58, and blade switches 66 for pick-up by a pick-and-place machine. A tray is used rather than a vibratory feeder bowl and dead nest or live nest because the camstack 62, motor 58, and blade switch 66 are so large and complex that a vibratory feeder bowl would be expensive and could damage these timer components 56.

Each assembly station is typically configured with a pick-and-place automated assembly machine. The pick-and-place machine moves timer components 56 from a source to a destination on another timer component or the housing 54. A pick-and-place assembly machine generally operates on axes with linear movement. For instance the pick-and-place machine will move along a horizontal axis until it is above the source timer component that may be positioned in a dead nest, live nest, or tray. The pick-and-place machine will then move on a vertical axis to acquire the timer component typically with a suction cup and vacuum. The pick-and-place machine will next move in the opposite direction on the same vertical axis to remove the timer component from the dead nest, live nest, or tray. The pick-and-place machine will then move on a horizontal axis until the timer component is directly over the target on the housing 54. The pick-and-place machine will next move on a vertical axis to place the timer component on the target. The pick-and-place machine will then reverse these movements to acquire another timer component. A pick-and-place machine can have multiple sources and destinations which are also known as teach points.

Typically after each timer component is installed in the cam-operated timer 52, some type of presence check is performed to verify that the timer component has been installed and that the part is in the proper location. A variety of means can be used to perform a presence check such as electromechanical, electronic, and optical. If the timer components 56 are not installed or improperly located in the cam-operated timer 52, that particular cam-operated timer 52 is locked out from further assembly by writing lock out instructions to the palette. Additionally during installation of timer components 56, the housing 54 may be swept with a burst of ionized air and then vacuumed removes contamination that may have found its way into the housing 54.

Many variations in the sequence of assembly are possible, so the description below should be interpreted broadly. Additionally, some of the timer components 56 are optional depending upon the desired configuration of the cam-operated timer 52. Assembly of the cam-operated timer 52 begins with assembly of the motor 58, the camstack 62, and the blade switches 66 as previously described. After construction of these subassemblies the cam-operated timer 52 is ready for complete assembly. The cam-operated timer 52 is constructed by loading a first set of timer components into the housing 54 along a vertical axis that is perpendicular to the housing base 74, and then loading a second set of timer components into the housing 54 along a horizontal axis that is parallel to the housing base 74. The first set of timer components include base parts, a motor 58, a camstack 62, and a first side cover 76. The second set of timer components includes the blade switches 66 with attached second side cover 78.

The base parts are made up of the timer components that are installed in the housing base 74 before the motor 58 is installed. The base parts include the subinterval lever 966, the masking lever 680, the pawl lifter 936, switch lifter 874, the lifter spring 876, the delay rocker 956, the drive cam 606, the primary drive pawl 608, the delay ratchet pawl 676, delay no-back pawl 678, the delay no-back spring 730, secondary drive pawl 610, delay drive wheel 672, delay ratchet pawl spring 720, delay camstack pawl spring 704, and delay camstack pawl 674. The control shaft 438, delay drive 604, master switch 68, quiet cycle selector 70, and subinterval switch 72 components listed above are optional depending upon whether the cam-operated timer 52 will be configured with these options. If one or more optional features are not to be provided on a cam-operated timer 52, the assembly sequence is simply modified to delete the assembly steps for the optional components. Installation of each of these parts into the housing 54 is described below. A step-by-step assembly of the cam-operated timer 52 is now described. Assembly of the cam-operated timer begins with placement of a housing base 74 on a conveyor belt. A pick-and-place machine then loads the housing base 74 onto a palette which stabilizes the housing base 74 on the conveyor belt. The housing base 74 is secured on the palette by the palette interacting with the control shaft mount 142 and the assembly mount 98.

The base parts are installed in the following sequence that may be varied except where indicated that a particular base part must precede or follow another base part. The first base part installed is the subinterval lever 966. The subinterval lever 966 is installed on a vertical axis with the subinterval pivot bore 968 engaging the subinterval pivot pin 110. The subinterval lever 966 is positioned, so the subinterval follower 970 is pivoted away from the drive cam mount 102 to later permit installation of the drive cam 606. The second set of base parts installed are selected from the group of the masking lever 680, the rocker lifter 872, the switch lifter 874, and the lifter spring 876. The masking lifter 738 and switch lifter 874 must be installed after the subinterval, but the rocker lifter 872 could be installed before the subinterval lever 966. Also in a configuration with the quiet cycle selector option, the rocker lifter 872 would be substituted with a pawl lifter 936. The masking lever 680 is installed on a vertical axis with the masking pivot bore 732 engaging the masking lever pivot pin 114. The rocker lifter 872 is installed on a vertical axis with the rocker lifter pivot bore 882 engaging the rocker lifter pivot pin 150. The rocker lifter 872 is aligned so the rocker lifter notch 884 coincides with the rocker lifter retainer 152. The switch lifter 874 is installed on a vertical axis with the switch lifter pivot bore 894 engaging the switch lifter pivot pin 158. The switch lifter 874 is aligned so the switch lifter notch 896 coincides with the switch lifter retainer 160. The optional lifter spring 876 is installed after the rocker lifter 872 and switch lifter 874 have been installed with the lifter spring loops 906 oriented closest to the base platform 84. One lifter spring loop 906 is connected to the rocker lifter spring connector 886 and the other lifter spring loop 906 is connected to the switch lifter spring connector 886 to bias the rocker lifter 872 and switch lifter 874 toward the control shaft mount 142.

The third set of base parts installed is selected from the group of the drive cam 606, the delay drive wheel 672, and the delay rocker 956. The drive cam 606 is installed on a vertical axis with the drive base bearing 632 engaging the drive cam mount 102, and the drive cam 606 is rotated to a predetermined position to synchronize the camstack drive 64. An assembly aid pin (not shown) is placed though the drive cam mount 102 into the drive cam base 614 to maintain proper orientation of the drive cam 606 and its alignment along a vertical axis to the base platform 84. The drive cam separation shelf 618 helps retain the previously installed subinterval lever 966. The delay drive wheel 672 is installed on a vertical axis with the delay wheel bore 682 engaging the delay wheel mount 122, and the delay drive wheel 672 is rotated to a predetermined position to synchronize the delay drive 604 with the main drive 602. The delay rocker 956 is installed on a vertical axis with the delay rocker pivot bore 958 engaging the subinterval pivot pin 110. The delay rocker 956 is rotationally oriented during installation, so the delay rocker contact 962 is immediately adjacent to the delay lifter rocker contact 954.

The forth set of base parts installed are selected from the group of the primary drive pawl 608, delay ratchet pawl 676, delay no-back pawl 678, secondary drive pawl 610, delay camstack pawl 674, and delay ratchet pawl spring 720. The forth set of base parts are installed in sequence with the exception of the secondary drive pawl 610 and delay camstack pawl 674 which can be interchanged in installation sequence. The primary drive pawl 608 is installed on a vertical axis over the drive cam top 630 with the drive engagement cam 620 engaging the engagement track 630 and the drive lug 622 engaging the drive track 640. When the primary drive pawl 608 is seated on the drive cam 606 the primary drive pawl 608 will be parallel to the base platform 84 and the primary drive foot 648 will contact the base platform 84. The delay ratchet pawl 676 is then installed on a vertical axis over the drive cam top 630 oriented between the motor pedestal 134 and the delay wheel mount 122 with the delay drive lug engaging the delay ratchet pawl track 708. When the delay ratchet pawl 676 is seated on the drive cam 606 the delay ratchet pawl foot 716 will be adjacent to the masking lifter 738. Installation of the delay no-back pawl 678 begins by capturing the delay no-back spring 730 on the delay no-back spring post 728. The delay no-back pawl 678 is then installed on a vertical axis over the drive cam top 630 oriented between the motor pedestal 134 and the delay wheel mount 122 with the delay no-back pawl pivot bore 724 engaging the delay drive bearing 626. When the delay no-back pawl 678 is installed, it will locate immediately above the delay ratchet pawl 676, and the delay no-back spring 730 will contact the delay no-back spring seat 118 to bias the delay no-back pawl 678 toward the delay wheel 672. The secondary drive pawl 610 is installed on a vertical axis over the drive cam top 630 oriented parallel to the primary drive pawl 608 with the secondary drive track 654 engaging the secondary drive cam 628. When the secondary drive pawl 610 is installed, it will locate parallel to the primary drive pawl 608 with secondary drive foot 662 contacting the housing platform. Finally, the delay camstack pawl 674 is installed on a vertical axis oriented with the delay camstack pawl foot 700 between the delay rocker pawl lifter base second open side with the delay camstack pawl lug track 692 engaging the delay drive lug 624, and the delay camstack pawl alignment track 690 engaging the delay drive positioning cam. The delay ratchet pawl spring 720 is installed on a vertical axis with the delay ratchet pawl spring loops 722 oriented toward the base platform 84. One delay ratchet pawl spring loop 722 is placed over the base delay spring support post 116 and the other end of the delay ratchet pawl spring loop 722 is placed over the delay ratchet pawl spring post 718 to bias the delay ratchet pawl 676 toward the delay wheel 672. The delay camstack pawl spring 704 is installed on a vertical axis with the delay camstack pawl spring loops 706 oriented down toward the base platform 84. One of the delay camstack pawl spring loops 706 is installed over the motor pedestal 134 and seated on the motor pedestal ribs 136. The other delay camstack pawl spring loop will be connected after the motor 58 is installed.

The motor 58 is installed after the base parts. The motor 58 is described above in the section labeled "Motor Description", and when installed will include the first stage gear and attached no-back lever. The motor 58 is installed on a vertical axis oriented with the field plate attachment bores 276 aligning with the base motor fasteners 138 and portions of the field plate resting on the motor shelf 132. The drive cam top 630 extends through the field plate output gear bearing 268. If an optional delay drive is installed the delay camstack pawl support 702 will be located immediately adjacent to the stator cup 256 to capture the delay camstack pawl 674 and delay wheel 672 in the housing base 74 when the motor 58 is installed. Once the motor 58 is seated on the motor shelf 132 and motor pedestal 134, the base motor fasteners 138 are heat staked to secure the motor 58 in the housing base 74. Once the motor 58 is installed the unconnected delay camstack pawl spring loop can be connected to the delay camstack pawl spring post 698 to bias the delay camstack pawl 674 toward base camstack details 140.

The gear train 60, with the exception of the first stage gear and attached no-back lever, is installed after the motor 58 to prevent damage to gear train 60 when the base motor fasteners 138 are heat staked. Additionally, if the gear train 60 is configured with an optional spline connector 334, the spline connector will not be installed until after cam-operator timer testing has been completed. The gear train 60 is constructed with three different meshing levels, a lower level, a middle level, and an upper level, so that no more than two gears are required to mesh during assembly. By reducing the number of gears required to mesh during installation, gear train assembly is simplified. Gear meshing is also facilitated by the gears have an involute spine profile to provide more radiused surfaces for meshing than in some other types of profiles. The gears 332 are also configured with a predetermined amount of backlash to facilitate meshing, and the gears 332 are permitted to cant slightly when on the gear arbors 330 because of fit that additionally facilitates meshing.

The first gears installed are those that operate on the lower level: the output gear 396 and the fourth stage gear 384. The first stage gear 344 also operates on the lower level but was previously installed during motor assembly. The output gear 396 is preferably installed first because installation of the output gear 396 helps to capture camstack drive components in the housing base 74. The output gear 396 is installed on a vertical axis over the drive cam top 630 with the output base lead-in 402 assisting with guiding the output gear 396 onto the drive cam top 630. The output base lead-in 402 has a chamfer edge and a larger internal diameter than the output gear disconnect bearing 404 to provide a larger target area to guide the output gear disconnect bearing 404 to engage the drive cam top disconnect bearing 631. The output gear rotational bearing 406 engages the field plate bearing 268 and the output gear thrust bearing 408 engages the field plate 254. The output extension thrust bearing 400 engages the secondary drive pawl 610 to locate the secondary drive pawl 610 on the drive cam 606 and assist in securing the camstack drive 64 in the housing base 74. The output gear disconnect bearing 404 cooperates with the drive cam top disconnect bearing 631 to maintain proper vertical alignment of the drive cam 606 in the housing base 74 The installed output gear 396 can rotate freely without operating the drive cam 606 until a spline connector 334 is installed to aid in gear meshing. After the output gear 396 has been installed, the fourth stage gear 384 is installed. The fourth stage gear 384 is installed on a vertical axis over the fourth stage gear arbor 342 with the fourth stage bore chamfer guiding the fourth stage bore 388 onto the fourth stage gear arbor 342. The fourth stage pinion 390 meshes with the output outer gear during installation. Once the fourth stage gear 384 is seated the fourth stage base thrust bearing 386 contacts the field plate 254 and the fourth stage bore 388 cooperates with the fourth stage gear arbor 342 to provide an axis for rotation.

Second, the gear that operates on the middle level, the second stage gear 360 is installed. The second stage gear 360 is installed on a vertical axis over the second stage gear arbor 338 with the second stage bore chamfer guiding the second stage bore 364 onto the second stage gear arbor 338. The second stage outer gear 368 meshes with the first stage pinion 354 during installation. Once the second stage gear 360 is seated the second stage base thrust bearing 362 contacts the field plate 254 and the second stage bore 364 cooperates with the second stage gear arbor 338 to provide an axis for rotation. Finally, the gear that operates on the upper level, the third stage gear 372 is installed. The third stage gear 372 is installed on a vertical axis over the third stage gear arbor 340 with the third stage bore chamfer guiding the third stage bore 376 onto the third stage gear arbor 340. During installation, the third stage pinion 378 first meshes with the fourth stage outer gear 392, and, after this mesh has been completed, the third stage outer gear 380 meshes with the second stage pinion 366. In some gear train configurations, the third stage gear 372 may be required to mesh with two other gears at the same time. The third stage gear 372 may be required to mesh both its third stage pinion 378 and third stage outer gear 380 simultaneously during installation. The circumstance of having three gears to mesh simultaneously may be required if the third stage pinion 378 cannot be configured to mesh with the fourth stage outer gear 392 before the third stage outer gear 380 is required to mesh with the second stage pinion 366. Once the third stage gear 372 is seated the third stage base thrust bearing 374 contacts the field plate 254 and the third stage bore 376 cooperates with the third stage gear arbor 340 to provide an axis for rotation. Sometime after the gear train 60 has been installed and before the first side cover 76 is installed, the gear train 60 is lubricated to reduce gear train noise during operation.

The camstack 62 is installed after the motor 58. A detailed description of the camstack assembly is provided above in the section labeled "Camstack Description". Prior to installation of the camstack 62, an assembly probe (not shown) orients certain camstack drive components to prevent interference with installation of the camstack 62. The primary drive pawl 608 and secondary drive pawl 610 are pivoted away from the control shaft mount 142 toward the drive spring mount 108, and the delay camstack pawl 674 is pivoted away from the control shaft mount 142 toward the second open side 82. The camstack 62 is installed on a vertical axis with the control shaft base internal bearing 524 engaging the base control shaft mount 142. The control shaft mount 142 is radiused to provide a greater target area for the control shaft base internal bearing 524 to engage the control shaft mount 142. When the camstack 62 is seated on the control shaft mount 142, the base camstack supports 146 contact the clutch disk 560 to position the camstack 62 about 0.100 of an inch (0.254 cm) above the base platform 84 to prevent the camstack from interfering with timer components.

The drive spring 612 is installed and the delay camstack pawl spring 704 is connected after the camstack has been installed. The drive spring 612 is placed in a dead nest (not shown) to spring load and orient the drive spring 612 for installation by a pick-and-place machine. The drive spring 612 is next installed over the pawl spring mount. The drive spring 612 must be spread apart by distancing the first spring end 668 and the second spring end 670 as the coil is placed over the pawl spring mount. After the drive spring coil 666 is placed over the pawl spring mount, the drive spring 612 is released such that the first spring end 668 contacts the primary drive pawl spring shelf 650 and the second spring end 670 contacts the secondary drive pawl foot 662. The delay camstack pawl spring 704 had one delay camstack pawl spring loop placed over the housing base motor pedestal 134 and positioned to rest on the motor pedestal ribs 136. The other delay camstack pawl spring loop is now connected to the delay camstack pawl spring post 698 to bias the delay camstack pawl 674 toward the camstack 62.

The first side cover 76 is installed after the drive spring 612 has been installed and the delay camstack pawl spring 704 has been connected. The first side cover 76 is loaded by a vibratory feeder bowl into a conveyor and received by a dead nest (not shown). Since the first side cover is large and would require an expensive vibratory feeder bowl, an assembly line operator may be used to load the first side cover 76 onto a conveyor belt. The dead nest orients the first side cover 76 for placement on the housing base 74 by a pick-and-place machine. The pick-and-place machine places the first side cover 76 onto the housing base 74 using a vertical axis. As the first side cover 76 mates with the housing base 74, the first side cover details 184 mate with the base details 86, the base sealing ridge 90 mates with the first side cover lip 188, and the first side cover attachment bores 224 mate with the base first side cover fasteners 92. Most of the mating between the base and the first side cover occurs near simultaneously, but the first side cover camstack bore mates with the control shaft control end 500 and then with the camstack hub extension 452 before other mating begins. The cover rocker retainer 222 mates with the base rocker support 164. The cover gear arbor sockets 208 mate with their corresponding gear arbors 330, and the cover motor shaft socket 210 mates with the rotor shaft 298. The cover gear arbor sockets 208 and cover motor shaft socket 210 have chamfered lead-ins to increase the target area for assembly. The first side cover lip 188 mates with the base sealing ridge 90, and the first side cover attachment bores 224 mate with the base first side cover fasteners 92. The first side cover attachment bores 224 are chamfered to increase the target area for assembly. Installation of the first side cover 76 is completed by heat staking the first side cover 76 to the base. Heat staking is accomplished by applying heat and pressure to the base first side cover fasteners 92.

The lift bar 880 is installed along a horizontal axis by a pick-and-place machine that received the lift bar 880 from a vibratory feeder bowl. The lift bar 880 is oriented to slide between the first lift bar guide 216 over the cover lift bar bearings 220. The first lift bar guide 216 provide a larger target area than the second lift bar guide 218 to assist in orienting the lift bar 880 for the more restrictive second lift bar guide 218. After the lift bar 880 engages first lift bar guide 216, the lift bar 880 engages the second lift bar guide 218. Now that the first lift bar guide 216 and second lift bar guide 218 have further aligned the lift bar 880, the lift bar notch 912 seats on the rocker tab 910, and the switch lifter guide 920 engages the lift bar channel 168 and the switch lifter tab 918 engages the switch lifter bar contacter 904.

Referring to FIG. 9, blade switch installation is now discussed. The blade switch are assembled as discussed in the earlier section entitled "Blade Switches". The assembled blade switches are placed into a tray (not shown) that holds several assembled blade switches. A pick-and-place machine takes the blade switches 66 from the tray and places the blade switches 66 into a dead nest to properly orient the blade switches 66 for installation. The second side cover assembly bores 236 are used by the pick-and-place machines and the dead nest to assist in orienting and handling the blade switches 66. Another pick-and-place machine, takes the blade switches 66 from the dead nest and installs the blade switches 66 on the housing 54 using a straight horizontal axis that is parallel to the housing base platform 84. When the blade switches 66 are installed on the housing base 74 and first side cover 76, the control shaft 438 is indexed out away from the base platform 84 to reduce interference by the lift bar 880 with blade switches 66 installation. As the blade switches 66, attached to the second side cover 78, are installed on the housing base 74 the first contact between the blade switches 66 and the housing 54 occurs during the near simultaneous contact between the blade switches male wafer fastener ramps 870 and the base female wafer ramp 174 and the cover female wafer ramp 228. After this first contact occurs, contact between the motor terminals 262 and blade switches motor terminal connectors 754 begins.

The motor terminals center motor terminal guide 322 engages the blade switches female motor terminal guide 852 to assist in guiding the motor terminal wire switch ends 328 toward the first motor connector clip 858 and the second motor connector clip 864. At about the same time the center motor terminal guide 322 engages the female motor terminal guide 852, the motor terminals side motor terminal guides 324 engage the blade switches male motor terminal guides 850 to further assist in guiding the motor terminal wire switch ends 328 toward the first motor connector clip 858 and the second motor connector clip 864. As the blade switches, with attached second side cover 78, are move on the straight horizontal axis toward the motor terminal wire ends, the first motor connector clip 858 and second motor connector clip 864 create a predetermined electrical connection between the motor 58 and the blade switches 66.

While the motor terminal wire switch ends 328 are engaging the first motor connector clip 858 and the second motor connector clip 864, the male wafer fasteners 868 are engaging the base female wafer fastener 172 and the first side cover female wafer fastener 226 and seat to lock the blade switches 66 with attached second side cover 78 onto the housing base 74 with attached first side cover 76. At the same time, the base second side cover pin 170 is engaging the second side cover attachment bore 248.

Following this, the second side cover 78 is heat staked to the base 74 and the first side cover 76 by applying heat and pressure to the connector pin detail 94 of the housing base 74.

The optional cycle selector detent 442 is installed after the blade switches 66. The detent follower 598 and detent spring 600 are received from vibratory feeder bowls. A pick-and-place machine places the detent spring 600 on the detent follower 598 and places the detent spring 600 and detent follower 598 in a dead nest to compress the detent spring 600. Another pick-and-place machine takes the compressed detent spring 600 and detent follower 598 and places them on a vertical axis in the detent follower channel 198. As the pick-and-place machine releases the detent spring 600 and detent follower 598 in the first side cover detent follower channel 198, the detent spring 600 engages the detent spring pilot 202 to assist in retaining the detent spring 600 in the detent follower channel 198. Also as the detent spring is release, the detent follower 598 extends through the detent follower bore 200 and engages the camstack detent blade 484.

The spline connector 334 is the final timer component installed to couple the output gear 396 to the drive cam 606. The spline connector 334 is not installed until after a blade switch test has been completed as described below in the section "Testing Of The Cam-Operated Timer". The spline connector 334 travels from a vibratory feeder bowl to a conveyor where a pick-and-place machine uses the spline connector assembly aid 432 to grasp the spline connector 334 for assembly on a vertical axis through the first side cover spline connector bore 212 and into the output gear spline bore 410. The spline connector lead-in 420 has the smallest outer diameter on the spline connector to provide a larger target area when the spline connector 334 is inserted through the first side cover spline bore 212. The spline connector lead-in 420 also provides a larger target area that does not require meshing to align the spline connector 334 with the output gear spline bore 410 during insertion. Both the internal connector spline lips 422 and the drive cam drive spline tip 635 are tapered to a point to ease installation of the spline connector 334 on the drive splines 633 by providing a larger meshing target. Also both the external connector tips 426 and output gear spline tips 414 are tapered to a point to ease installation of the spline connector 334 by providing a larger meshing target area. The spline connector locking fingers 430 are cantilever springs that create a larger outer diameter than the external connector splines 428. During installation through the first side cover spline connector bore 212, the locking fingers 430 contract to permit insertion through the first side cover spline connector bore 212 and then the locking fingers 430 expand to capture the spline connector 334 in the housing 54. When the spline connector 334 is installed in the output gear spline bore 410, the output spline connector grooves 416 provide clearance for the locking finger to expand. The output gear disconnect bearing 404 provides a stop for the spline connector lead-in 420 to contact to prevent the spline connector 334 from migrating into the output extension 398.

Testing Of The Cam-Operated Timer

Cam-operated timer testing takes place after assembly has been completed except for installation of the spline connector 334. The purpose of the cam-operated timer test is to test operation of cam-operated timer components including the motor 58, gear train 60, camstack 62, control shaft 438, camstack drive 64, blade switches 66, subinterval switch 72, and quiet cycle selector 70. Test of cam-operated timer 52 can be divided into three separate tests: the master switch test, the blade switches test, and the camstack drive test.

The master switch test verifies operation of the control shaft 438, clutch 440 and quiet cycle selector 70. The cam-operated timer is placed in a test fixture and a continuity tester is connected to the blade switches to determine if the blade switches are open or closed. The control shaft 438 is depressed and rotated both directions by applying force to the control shaft control end 500. When the control shaft 438 is pushed in, the control shaft base end lift ramp 514 operates the pawl lifter 936 and switch lifter 874 to operate the quiet cycle selector 70. Movement of the control shaft stops when the control shaft base end 492 contacts the housing base 74. When the control shaft 438 is fully depressed, the blade switches 66 should be "open" to disconnect all electrical circuits. The blade switches 66 are opened by the quiet cycle selector 70 in the manner discussed previously under the section labeled "quiet cycle selector". When the control shaft 438 is rotated while the control shaft is depressed, the lift bearing is tested. Then the control shaft is extended and rotated both directions by applying force to the control shaft control end 500. At the conclusion of the master switch test, the camstack 62 is rotated to a predetermined location to prepare the cam-operated timer 52 for the blade switches test.

The blade switches test verifies operation of the blade switches 66 by the camstack 62. The cam-operated timer 52 is placed in a test fixture that has a rotator and a data recorder. The rotator is connected to the control shaft 438 through a housing detail to rotate the camstack 62 independently of the motor 58. The data recorder is connected to the blade switches for recording operation of the blade switches 66. Operation of the blade switches 66 is determined by applying 12–20 VDC to selected upper contact terminals, cam-follower contact terminals or lower contact terminals. Although the applied DC voltage may be applied to the motor 58 through the connection between the motor terminals 262 and the blade switches, the DC voltage is kept low enough to prevent damage to the motor 58. The data recorder then measures whether a particular switch is open or closed by measuring whether a voltage is present on a blade switch.

The camstack 62 is rotated by the rotator causing the blade switches 66 to operating in accordance with the camstack's predetermined program carried on the program blades. The drive cam base 614 is rotated through the drive cam bore 104 at a rate to rotate the camstack 360° in about 7.5 minutes. some cam-operated timer configurations may require more time to rotate the camstack 62 and some may require less time to rotate the camstack. The data recorder collects data from the blade switches 66 during operation according to the camstack 62. The collected data from the data recorder is then compared against predetermined criteria to determine whether the blade switches 66 are functioning properly. After the blade switches test is completed, the spline connector 334 is inserted through the first side cover 76 to couple the output gear 396 to the drive cam 606 in an otherwise fully assembled cam-operated timer.

The camstack drive test verifies operation of the motor 58, gear train 60, and camstack drive 64. The cam-operated timer 52 is placed in a test fixture that applies an AC voltage through the blade switches 66 to the motor 58 to operate the motor 58. The test fixture also verifies whether the camstack 62 has moved a predetermined distance after the motor 58 has driven the camstack drive 64 to rotate the camstack 62.

The above described cam-operated timer test procedure has many advantages including testing the cam-operated timer 52 in less time because the motor 58 is disconnected from the camstack drive 64.

Installation of the Cam-Operated Timer in an Appliance

The cam-operated timer 52 can be configured to be mounted into an appliance 50 in the traditional screw-in mount or in a snap-in mount that has many advantages over traditional mounting. In either mounting configuration, an advantage of the double insulated cam-operated timer is that a ground strap is not required which saves the cost of a ground strap, simplifies assembly into the appliance 50, and increases reliability because there the ground strap and its connection can become ineffective by losing continuity. Often the appliance timer is the only component in an appliance console that requires grounding, so if an insulated cam-operated timer 52 is used as the appliance timer, the ground strap can often be eliminated entirely. The advantages of an insulated cam-operated timer 52 can be illustrated with a dishwasher having an all plastic door. In this dishwasher situation, an insulated cam-operated timer can eliminate the need to run a ground wire for a length of around three feet (0.914 m) from the chassis through the all plastic door to the console containing a timer.

Snap-in mounting is accomplished by first inserting the cam-operated timer 52 into appliance control console rectangular slots. More specifically the first mounting tabs 176 and second mounting tab 178 and inserted into rectangular slots on the appliance control console (not shown) typically until the cam-operated timer first side cover 76 is flush against the appliance control console. The appliance control console typically is a stamped metal plate about 0.030 inch (0.0762 cm) thick or a plastic panel about 0.100 of an inch (0.254 cm). The first mounting tab 176 and second mounting tabs 178 have radiused edges and corners to assist as lead-ins to the appliance control console rectangular slots. The appliance control console rectangular slot that corresponds with the second mounting tab 178 has a second mounting tab slot.

After the cam-operated timer 52 is inserted into the appliance control console rectangular slots, the cam-operated timer 52 is slid about 0.125–0.375 of an inch (0.318–0.953 cm) in the direction of the first mounting tabs 176 to engage the first mounting tabs 176 and the second mounting tab 178 with the appliance console to fasten the cam-operated timer 52 to the appliance console. When the cam-operated timer 52 is slid to fasten the cam-operated timer 52 to the appliance console, the locking tang on the appliance control console rectangular slot that corresponds with the second mounting tab 178 moves into the second mounting tab slot to lock the cam-operated timer 52 against the appliance control console. The locking pin 190 engages the appliance control console to prevent the cam-operated timer 52 from sliding toward the first mounting tab 176 to unlock the cam-operated timer 52 from the appliance control console. The screw mount 182 is for a screw (not shown) that can be used as an additional means to secure the cam-operated timer 52 to the appliance console even when using snap-in mounting.

In either the tradition screw-in mounting or the snap-in mounting of the cam-operated timer 52, the base mount 98 can be offset a predetermined distance from the first side cover 76 to provide a space between the first side cover 76 and the appliance control console for an external component such as a detergent dispensing cam that attaches to the camstack hub extension 452.

Cycle Selection by an Appliance Operator

The control knob 504 is rotated by an appliance operator to selected a desired appliance cycle or function. During rotation of the control knot) the appliance operator is given tactile feedback from vibrations transmitted from the camstack detent 442 to control knob. The tactile feedback assists an operator in selecting desired appliance functions. Tactile assistance to an operator in selecting appliance functions is particularly important when an appliance is placed in a location with poor lighting such as a garage, laundry room, or basement.

The quiet manual selection feature permits an operator to rotate the control knob either clockwise or counter-clockwise to select an appliance function. Since most appliance operators intuitively desire to rotate the control knob the least distance to select an appliance function, the quiet manual selection feature permit the cam-operator timer 52 to operate more ergonomically.

When the appliance operator desires to select an appliance function he or she pushes the control knob in, which is toward the appliance control console, and the quite manual selection feature disengages the pawl drive and the blade switch assembly from the camstack 62.

What is claimed is:

1. A quiet cycle selector for a cam-operated timer, comprising:

(a) a housing;

(b) a camstack carried in the housing for rotation having switch program blades corresponding to predetermined appliance functions and a drive surface;

(c) a camstack drive carried in the housing and operated by a motor to engage the camstack drive surface to rotate the camstack;

(d) blade switches placed in working relationship to the camstack switch program blades having switch blades with electrical contacts, cam-follower blades, cam-follower electrical contacts, and cam-follower riders engaging the switch program blades to open and close the electrical contacts with the cam-follower electrical contacts;

(e) a control shaft axially displaceable in the housing to a depressed position and an extended position providing an axis for rotation of the camstack with a ramped end and a control end;

(f) a switch lifter carried in the housing having a switch lifter ramp operated by the control shaft ramped end and a switch contacter to contact the cam-follower blades to disengage the cam-follower riders from the switch program blades when the control shaft is moved to the depressed position; and, (g) a drive lifter carried in the housing having a drive lifter ramp that is operated by the control shaft ramped end and a drive contacter to contact the camstack drive to disengage the camstack drive from the camstack drive surface when the control shaft is moved to the depressed position.

2. The cam-operated timer quiet cycle selector as in claim 1 wherein the control shaft is moved to the depressed position to activate the quiet cycle selector the control shaft control end is rotated bi-directionally by an appliance operator to select an appliance function.

3. The cam-operated timer quiet cycle selector as in claim 1, further comprising a lift bar slideably carried in the housing having a switch lifter tab operated by the switch lifter contacter and a lift platform that contacts the blade switches to disengage the cam-followers from the camstack program profiles when the control shaft is moved to the depressed position.

4. The cam-operated timer quiet cycle selector as in claim 3, further comprising a rocker pivotly carried in the housing having a rocker lifter contacter actuated by a drive lifter contacter when the control shaft is moved to a depressed position and a rocker lifter notch that engages a lift bar notch to assist in actuating the lift bar to disengage the cam-followers from the camstack profiles.

5. The cam-operated timer quiet cycle selector as in claim 1 wherein when switch lifter disengages the cam-followers from the switch program blades there is still contact between the cam-followers and the switch program blades.

6. The cam-operated timer quiet cycle selector as in claim 1 wherein when the drive lifter disengages the camstack drive from the camstack drive surface there is still contact between the camstack drive and the camstack drive surface.

7. The cam-operated timer quiet cycle selector as in claim 1 wherein the camstack drive surface is a drive blade and the camstack drive is a pawl drive and the drive lifter is a pawl lifter that disengages the pawl drive from the camstack drive blade when the control shaft is moved to a depressed position.

8. The cam-operated timer quiet cycle selector as in claim 1 wherein the camstack drive includes a camstack delay drive pawl and the pawl lifter disengages the camstack delay pawl from a camstack delay blade when the control shaft is moved to a depressed position.

9. The quiet cycle selector as in claim 1 wherein torque required to rotate the control shaft when the quiet cycle selector is activated by placing the control shaft in the depressed position is less than when the quiet cycle selector is deactivated by placing the control shaft in the extended position.

10. The quiet cycle selector as in claim 1 wherein when the quiet cycle selector is activated noise is decreased when the control shaft is rotated compared to when the control shaft is rotated when a master switch is activated.

11. The quiet cycle selector as in claim 10 wherein appliance operator tactile and auditory feedback from a cycle selector detent is enhanced because background vibration and sound created by blade switches and a camstack drive is reduced.

12. The quiet cycle selector as in claim 1 wherein the quiet cycle selector is configured to operate as both a quiet cycle selector and a master switch.

13. The quiet cycle selector as in claim 1 wherein blade switch and camstack drive mechanical life is extended because the blade switches and camstack drive are not engaged during appliance function selection.

14. A method of quiet cycle selection in a cam-operated timer, comprising the steps of:

(a) depressing a control shaft that is axially displaceable and serves as an axis for rotation of a camstack having a camstack drive surface to move the control shaft from an extended position to a depressed position;

(b) disengaging a camstack drive from the camstack drive surface by actuating a drive lifter to move the camstack drive away from the camstack drive surface;

(c) disengaging blade switch cam-followers placed in working relations to the camstack by actuating a switch lifter to move the cam-followers away from engagement with the camstack;

(d) rotating the control shaft which is coupled to the camstack to select an appliance function;

(e) extending a control shaft to move the control shaft from the depressed position to the extended position;

(f) engaging the camstack drive with the camstack drive surface by actuating the drive lifter to move the camstack drive into contact with the camstack drive surface to rotate the camstack; and, (g) engaging the blade switch cam-followers with the camstack by actuating the switch lifter to move the cam-followers into engagement with the camstack to operated the blade switches in accordance with the selected appliance function.

15. The method of quiet cycle selection in a cam-operated timer as in claim 14, further comprising the step of:

(h) latching the control shaft in the depressed position to facilitate rotation of the control shaft during selection of an appliance function; and, (i) unlatching the control shaft from the depressed position when the control shaft is extended to to facilitate rotation of the control shaft during selection of an appliance function.

16. The method of quiet cycle selection in a cam-operated timer as in claim 15 where the control shaft is rotated bi-directionally to select an appliance function.

17. A master switch for a cam-operated timer, comprising:

(a) a housing;

(b) a camstack carried in the housing for rotation having switch program blades corresponding to predetermined appliance functions and a drive surface;

(c) a camstack drive carried in the housing and operated by a motor to engage the camstack drive surface to rotate the camstack;

(d) blade switches placed in working relationship to the camstack switch program blades having switch blades with electrical contacts, cam-follower blades, cam-follower electrical contacts, and cam-follower riders engaging the switch program blades to open and close the electrical contacts with the cam-follower electrical contacts;

(e) a control shaft axially displaceable in the housing providing an axis for rotation of the camstack having a depressed position and an extended position with a ramped end and a control end; and, (f) a switch lifter pivotally carried in the housing having a switch lifter ramp operated by the control shaft ramped end and a switch contacter to contact the cam-follower blades to open electrical.

18. The cam-operated timer master switch as in claim 17, further comprising:

(g) a rocker lifter pivotally carried in the housing having a rocker lifter contacter actuated by a drive lifter contacter when the control shaft is moved to a depressed position and a rocker lifter notch that engages a lift bar notch to assist in actuating the lift bar to disengage the cam-follower riders from the switch program blades; and, (h) a rocker pivotally carried in the housing having a rocker lifter ramp that is operated by the control shaft ramped end and a rocker lifter to contact the rocker tab that in turn contacts the switch lifter to provide additional force to open electrical.

19. The cam-operated timer master switch as in claim 17, further comprising:

(i) a lift bar slideably carried in the housing having a switch lifter tab operated by the switch lifter contacter and a lift platform that contacts the blade switches to disengage the cam-followers from the camstack program blades when the control shaft is moved to the depressed position.

20. The cam-operated timer quiet cycle selector as in claim 19 wherein the lift platform is configured to sequence at least one predetermined blade switch when the master switch is operated.

21. The cam-operated timer quiet cycle selector as in claim 20 wherein the lift platform sequences an appliance motor start switch prior to an appliance motor run switch to select an appliance motor rotation direction.

22. The cam-operated timer quiet cycle selector as in claim 19 wherein the lift plateform is configured to reduce arc tracking.

23. The cam-operated timer master switch as in claim 17 wherein the switch contacter opens all blade switches to turn "off" an appliance.

24. A method of operating a master switch in a cam-operated timer, comprising the steps of:

(a) depressing a control shaft that is axially displaceable and serves as an axis for rotation of a camstack having a camstack drive surface to move the control shaft from an extended position to a depressed position;

(b) opening blade switches electrical contacts by actuating a switch lifter to move blade switches away from cooperating blade switches; and, (e) extending a control shaft to move the control shaft from the depressed position to the extended position to actuate the switch lifter to release blade switches to permit electrical contacts to close according to camstack program blades and to permit cam-follower riders to engage the camstack to operated cam-follower blades.

25. The method of operating a master switch in a cam-operated timer as in claim 24, further comprising the step of:

(f) rotating the control shaft when the control shaft is in a depressed position to select an appliance function.

26. The method of operating a master switch in a cam-operated timer as in claim 24, further comprising the steps of:

(g) latching the control shaft in a depressed position to facilitate rotation of the control shaft during selection of an appliance function; and, (h) unlatching the control shaft from the depressed position when the control shaft is extended for cam-operated timer operation.

27. A quiet cycle selector for a cam-operated timer, comprising:

a housing;

a camstack having program blades rotatably mounted in the housing;

a camstack drive mounted in the housing and being positioned to rotate the camstack;

at least one blade switch cooperating with the camstack program blades to open and close electrical circuits;

a control shaft axially displaceable in the housing between a depressed position and an extended position; when said control shaft is in the depressed position said blade switches being disengaged from said program blades and said camstack drive being disengaged from rotation of said camstack;

a switch lifter contacting the blade switch to disengage the blade switch from the program blades when the control shaft is moved to the depressed position; and, a drive lifter contacting the camstack drive to disengage the camstack drive when the control shaft is moved to the depressed position.

28. The cam-operated timer quiet cycle selector as in claim 27, further comprising a lift bar operated by the switch lifter to contact the blade switches to disengage the blade switches from the program blades when the control shaft is moved to the depressed position.

29. The cam-operated timer quiet cycle selector as in claim 27, further comprising a drive lifter contacting the camstack drive to disengage the camstack drive from rotation of the camstack when the control shaft is moved to the depressed position.

30. The cam-operated timer quiet cycle selector as in claim 28, further comprising a lift bar operated by the switch lifter to contact the blade switch to disengage the blade switch from the camstack program blades when the control shaft is moved to the depressed position.

31. The cam-operated timer quiet cycle selector as in claim 29 wherein the camstack drive further includes a camstack delay drive and the drive lifter disengages the camstack delay drive when the control shaft is moved to a depressed position.

32. The quiet cycle selector as in claim 27 wherein torque required to rotate the control shaft when the control shaft in the depressed position is less than when the quiet cycle selector is deactivated by placing the control shaft in the extended position.

33. The quiet cycle selector as in claim 27 further including a cycle selector detent cooperating with the camstack enhances appliance operator tactile and auditory feedback.

34. The quiet cycle selector as in claim 27 wherein all electrical power to the cam-operated timer is interrupted when the control shaft is in the depressed position.

35. The quiet cycle selector as in claim 34 wherein the switch lifter engages a lift bar to disengage the blade switch from the camstack program blades when the control shaft is moved to the depressed position.

* * * * *